US005869218A

United States Patent [19]

Sakai et al.

[11] Patent Number: 5,869,218

[45] **Date of Patent: *Feb. 9, 1999**

[54] IMAGE FORMATION PROCESS

[75] Inventors: Minoru Sakai; Kazunobu Katoh, both of Kanagawa, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 686,591

[22] Filed: Jul. 26, 1996

[30] Foreign Application Priority Data

Jul. 28, 1995 [JP] Japan ..... 7-211301
Sep. 21, 1995 [JP] Japan ..... 7-266204

[51] Int. Cl.[6] ..... G03C 5/29; G03C 1/06

[52] U.S. Cl. ..... 430/264; 430/440; 430/446; 430/480; 430/484; 430/485

[58] Field of Search ..... 430/264, 480, 430/485, 484, 440, 446

[56] References Cited

U.S. PATENT DOCUMENTS

| | | | |
|---|---|---|---|
| 4,699,873 | 10/1987 | Takahashi et al. | 430/446 |
| 4,929,535 | 5/1990 | Takahashi et al. | 430/264 |
| 5,503,965 | 4/1996 | Okutsu | 430/399 |
| 5,578,433 | 11/1996 | Morishima et al. | 430/436 |
| 5,587,276 | 12/1996 | Katoh | 430/440 |

*Primary Examiner*—Thorl Chea
*Attorney, Agent, or Firm*—Sughrue, Mion, Zinn, Macpeak & Seas, PLLC

[57] ABSTRACT

Disclosed are an image formation process which comprises developing a photographic material comprising a silver halide emulsion layer, and a hydrazine derivative and a specific phosphonium compound of formula (1) with a developer which is substantially free of a dihydroxybenzene developing agent, contains a specific developing agent of formula (2) and at least one p-aminophenol derivative, and has a pH value of not more than 10, and a development process which comprises developing a photographic material comprising a silver halide emulsion layer, and a hydrazine derivative and a nucleation accelerator, with a developer having a pH value of from 9.0 to 10.5 and containing a first developing agent selected from ascorbic acid and a derivative thereof and a second developing agent selected from aminophenol and a derivative thereof, wherein a solution having the same composition as the fresh developer but a higher pH value than the fresh developer is used as a development replenisher. The image formation process enables the formation of a high contrast image desirable in the field of graphic arts with a stable developer which is unharmful to an ecosystem or working atmosphere and shows an extremely small deterioration with time, and the development process is useful for a plate-making silver halide photographic material, accomplishes an ultrahigh contrast, minimizes the pH variation during running processing, and reduces the burden on environment.

7 Claims, No Drawings

IMAGE FORMATION PROCESS

FIELD OF THE INVENTION

The present invention relates to a process for the formation of an ultrahigh contrast image using a silver halide photographic material. More particularly, the present invention relates to a process for the formation of an image which can provide an ultrahigh contrast image with a stable developer free of dihydroxybenzene developing agent. The present invention further relates to a process for the development of a plate-making silver halide photographic material.

BACKGROUND OF THE INVENTION

In the field of graphic arts, in order to optimize the reproduction of a continuous tone image or line image from a halftone image, an image formation system which exhibits an ultrahigh contrast (particularly gamma of 10 or more) is required.

As a process for the formation of a high contrast image there can be used a lithographic development process employing a so-called "infectious development effect". However, this lithographic development process is disadvantageous in that the developer is too instable to be used.

As a solution to the foregoing problem, an approach has been proposed which comprises the use of a stabler developer as described in U.S. Pat. Nos. 4,224,401, 4,168,977, 4,166,742, 4,311,781, 4,272,606, 4,221,857, 4,332,878, 4,634,661, 4,618,574, 4,269,922, 5,650,746, and 4,681,836.

In this image formation system, a surface latent image type silver halide photographic material comprising a hydrazine derivative incorporated therein is developed with a stable MQ developer (developer comprising hydroquinone and p-aminophenol in combination) or PQ developer (comprising hydroquinone and 1-phenyl-3-pyrazolidone in combination) having a pH value of from 11 to 12.3 to obtain an ultrahigh negative image having $\gamma$ of more than 10. In accordance with this process, an ultrahigh contrast and a high photographic sensitivity can be obtained. Further, a high concentration sulfite can be added to the developer. Accordingly, the developer thus obtained exhibits a remarkably improved stability to air oxidation as compared with the conventional lith developers.

With respect to bright room light type photographic light-sensitive materials for contact work for use in plate collection and reflecting steps, too, in order to effect faithful superposition and reflection of halftone original and line image original, a process for the formation of an ultrahigh contrast image is required. To this end, the foregoing image formation system employing a hydrazine derivative can be effectively employed. Specific examples of the application of this system are disclosed in JP-A-62-640 (The term "JP-A" as used herein means an "unexamined published Japanese patent application"), JP-A-62-235938, JP-A-235939, JP-A-63-104046, JP-A-63-103235, JP-A-63-296031, JP-A-63-314541, and JP-A-64-13545.

On the other hand, it is well known that endiols such as ascorbic acid act as a developing agent. Endiols have been noted as an ecologically or toxicologically harmless developing agent. For example, U.S. Pat. Nos. 2,688,549 and 3,826,654 propose that an image can be formed under an alkaline condition having a pH range of not lower than 12. However, these image formation processes cannot provide a high contrast image.

Some attempts have been made to raise contrast in a development system employing ascorbic acid. For example, Zwicky proposes that a lithographic effect is exerted when ascorbic acid is used as the sole developing agent (J. Photo. Sc., Vol. 27, page 185 (1979)). However, this development system provides a remarkably low contrast as compared with the hydroquinone development system. Further, U.S. Pat. No. T 896,022 and JP-B-49-46939 (The term "JP-B" as used herein means an "examined Japanese patent publication") disclose a development system employing bis quaternary ammonium salt and ascorbic acid. However, this development system shows some development accelerating effect but little or no effect of raising contrast. JP-A-3-249756 and JP-A-4-32838 disclose an effect exerted by the combined use of ascorbic acid and quaternary salt. However, the image thus obtained has an insufficient contrast. JP-A-5-88306 proposes that a high contrast can be obtained by keeping the pH value to not less than 12.0 with ascorbic acid as the sole developing agent. However, this development system is disadvantageous in that the developer used has a poor stability.

There is a case where the use of a special developer comprising as main components ascorbic acid and a hydrazine derivative can provide a development system that can give a high sensitivity and minimized generation of stain and fog (U.S. Pat. No. 3,730,727). However, no reference is made to the enhancement of contrast.

JP-A-7-13306 discloses a method which comprises the development of a photographic light-sensitive material comprising a hydrazine compound with a developer containing ascorbic acid. However, this method is disadvantageous in that the developer use has a pH value of not less than 10 and thus leaves something to be desired in stability. Further, when the pH value of the developer is not more than 10, a sufficient hardness in contrast cannot be obtained.

It is well known that a quaternary onium salt compound is incorporated in a photographic light-sensitive material. Such a photographic material is disclosed in JP-A-6-43602, JP-A-6-102633, JP-A-6-161009, and JP-A-5-142687. However, all these photographic light-sensitive materials proposed exhibit a pH value of not less than 10. These photographic light-sensitive materials are apt to air oxidation and variation of properties due to fatigue of the developer with time.

JP-A-5-53231 discloses that a photographic light-sensitive material comprising a special silver halide emulsion and a quaternary onium salt compound is processed in a pH range of not more than 10 to provide a hard contrast. However, when such a silver halide emulsion is used, development proceeds slowly, making it impossible to obtain practically sufficient properties. JP-A-5-273708 discloses that a photographic light-sensitive material comprising a quaternary onium salt compound is processed with a developer containing ascorbic acid (pH 9.6) to provide a hard contrast. However, sine this development system requires the use of a quaternary onium salt in a large amount, development proceeds slowly and reduced Dmax is given, making it impossible to obtain practically sufficient properties.

JP-A-62-250439 and JP-A-62-280733 disclose that a photographic light-sensitive material comprising a hydrazine derivative and a quaternary onium salt compound is processed with a developer having a pH value of not less than 11 to form a hard contrast image. Further, JP-A-61-47945, JP-A-61-47924, JP-A-1-179930, and JP-A-2-2542 disclose that a photographic light-sensitive material comprising an emulsion having a silver bromide content of 50 mol %, a specific hydrazine derivative and a quaternary onium salt compound is developed with a developer having a pH value of not less than 11 to form a hard contrast image. However, since all these development systems employ a developer having a pH value of not less than 11, the photographic light-sensitive material is apt to air oxidation and variation of properties due to fatigue of the developer with time.

The process for the formation of a hard contrast image using a hydrazine derivative is well known and has found wide application to photomechanical process. However, this development system normally requires the use of a developer having a high pH value which is apt to air oxidation and thus is instable.

Attempts have been made to develop a silver halide photographic material comprising a hydrazine compound with a developer having a lower pH value to form a hard contrast image.

JP-A-1-179939 and JP-A-1-179940 disclose a processing method which comprises the development of a photographic light-sensitive material comprising a nucleation and development accelerator containing an adsorption group for silver halide emulsion grains and a nucleating agent containing similar adsorption group with a developer having a pH value of not more than 11.0.

U.S. Pat. Nos. 4,998,604 and 4,994,365 disclose a hydrazine compound having a repeating unit of ethylene oxide and a hydrazine compound having a pyridinium group. However, as shown in examples of these patents, these hydrazine compounds cannot provide a sufficient contrast, and it is difficult to provide a hard contrast and a necessary Dmax under practical development conditions.

Further, the pH value of a developer rises as the concentration of the developer rises due to air oxidation or evaporation of water or drops as the developer absorbs $CO_2$ gas in the air or is used to develop a photographic light-sensitive material. Thus, the pH value of the developer cannot be kept constant. As the pH value of the developer varies, variation occurs in photographic properties, particularly contrast. Thus, the developer must be replenished at a high rate.

Thus, an image formation process has been desired which can employ a developer having a lower pH value and is insusceptible to variation of photographic properties with pH variation. However, the prior art image formation technique leaves something to be desired.

On the other hand, attempts have been made to substitute ascorbic acid for hydroquinone, which has heretofore been commonly used, for the purpose of lessening the adverse effect on environment. JP-A-6-505574 (corresponding to WO 93/11456), and U.S. Pat. Nos. 5,236,816 and 5,264,323 disclose an image formation process which comprises the processing of a silver halide photographic material comprising a hydrazine derivative with a developer containing ascorbic acid. In this description, a hard contrast image cannot be obtained unless a 3-pyrazolidone derivative is used as an ultraforming auxiliary developing agent in combination with an ascorbic acid developing agent and the developer used has a relatively high pH value to obtain a hard contrast image. In fact, as a result of the inventors' supplementary examination, an ultrahigh contrast cannot be obtained unless the pH value of the developer is as high as not less than 11.0. Further, this development system has a great disadvantage that when air-oxidized or fatigued from processing of film, the developer shows a remarkable pH drop that extremely impairs contrast.

EP 573,700 discloses a development process which comprises the replenishment of a developer comprising ascorbic acid and a 3-pyrazolidone derivative in combination with a replenisher having substantially the same composition as the developer but a higher pH value than the developer. However, the above cited European Patent has no reference to an ultrahigh contrast photographic light-sensitive material comprising a hydrazine derivative. As previously mentioned, when the developer comprising ascorbic acid and a 3-pyrazolidone derivative in combination exhibits a pH value of from 9.0 to 10.5, the ultrahigh contrast photographic light-sensitive material comprising a hydrazine compound cannot provide an ultrahigh contrast. When the developer has an alkalinity as high as not less than pH 11.0, an ultrahigh contrast can be obtained. However, the developer shows a remarkable pH drop due to air oxidation. When the replenisher having a high pH value is used, this tendency becomes more remarkable, making it almost impossible to keep the pH value of the developer constant during running processing.

As mentioned above, the ultrahigh image formation system using a hydrazine derivative employs a dihydroxybenzene compound such as hydroquinone as a developing agent and thus is somewhat disadvantageous from the ecological and toxicological standpoints of view. For example, hydroquinone exerts an allergenic effect and thus is an undesirable component. 1-Phenyl-3-pyrazolidones are components having a poor biodegradability. Further, a high concentration sulfite shows a high COD (chemical oxygen demand) value. Moreover, this image formation system normally employs amines described in U.S. Pat. No. 4,975,354 as well. However, these amines are undesirable from the standpoint of toxicity and volatility.

SUMMARY OF THE INVENTION

It is therefore an object of the present invention to provide a novel image formation process which enables the formation of a high contrast image desirable in the field of graphic arts with a stable developer which is unharmful to an ecosystem or working atmosphere and shows an extremely small deterioration with time.

The present invention also concerns a process for the development of a plate-making silver halide photographic material which comprises the use of a developer having a pH value as low as not more than 10.5 to accomplish an ultrahigh contrast, minimize the pH variation during running processing and reduce the burden on environment.

The foregoing objects of the present invention are accomplished by a first and second embodiments described below.

As the first embodiment, there is provided an image formation process which comprises:

exposing a photographic light-sensitive material to light, the photographic light-sensitive material comprising a support having provided thereon at least one photosensitive silver halide emulsion layer, and at least one hydrazine derivative and at least one of phosphonium compounds represented by formula (1) each incorporated in at least one of the silver halide emulsion layer and other hydrophilic colloid layers, and then developing said photographic light-sensitive material with a developer, wherein said developer is substantially free of a dihydroxybenzene developing agent, contains at least one of developing agents represented by formula (2) and at least one of p-aminophenol derivatives, and has a pH value of not more than 10:

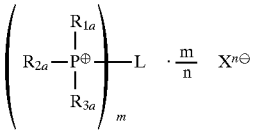

(1)

wherein $R_{1a}$, $R_{2a}$, and $R_{3a}$ each represent an alkyl group, a cycloalkyl group, an aryl group, an alkenyl group, a cycloalkenyl group or a heterocyclic residue, which may have substituent(s); m represents an integer of 1 or 2; L represents an organic group having a valence of m, which is bonded to P atom via its carbon atom; n represents an integer of from 1 to 3; X represents an anion having a valence of n, which may be connected to L;

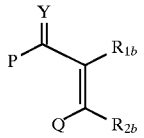

(2)

wherein $R_{1b}$ and $R_{2b}$ each represent a hydroxyl group, an amino group, an acylamino group, an alkylsulfonylamino group, an arylsulfonylamino group, an alkoxysulfonylamino group, a mercapto group or an alkylthio group; P and Q each represent a hydroxyl group, a hydroxyalkyl group, a carboxyl group, a carboxyalkyl group, a sulfo group, a sulfoalkyl group, an amino group, an aminoalkyl group, an alkyl group, an alkoxy group or a mercapto group or an atomic group necessary for the formation of a 5- to 7-membered ring along with two vinyl carbon atoms to which $R_{1b}$ and $R_{2b}$ are connected, respectively, and the carbon atom to which Y is connected; and Y represents =O or =N—$R_{3b}$ in which $R_{3b}$ represents a hydrogen atom, a hydroxyl group, an alkyl group, an acyl group, a hydroxyalkyl group, a sulfoalkyl group or a carboxyalkyl group.

As the second embodiment, there is provided a development process which comprises developing a silver halide photographic material comprising a support having provided thereon at least one silver halide emulsion layer, and a hydrazine derivative and a nucleation accelerator each incorporated in at least one of the silver halide emulsion layer and other hydrophilic colloid layers, with a developer having a pH value of from 9.0 to 10.5 and containing at least one first developing agent selected from the group consisting of ascorbic acid and a derivative thereof and at least one second developing agent selected from the group consisting of aminophenol and a derivative thereof, wherein a solution having the same composition as the fresh developer but a higher pH value than the fresh developer is used as a development replenisher.

Furthermore, it is unexpectedly found that the replenishment rate can be minimized to not more than 200 ml per $m^2$ of the photographic light-sensitive material used.

The general formula (1) will be further described hereinafter.

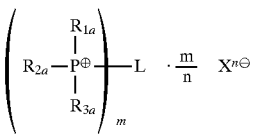

(1)

wherein $R_{1a}$, $R_{2a}$ and $R_{3a}$ each represent an alkyl group, a cycloalkyl group, an aryl group, an alkenyl group, a cycloalkenyl group, or a heterocyclic residue, which may further contain substituent(s).

The suffix m represents an integer. L represents an organic group having a valence of m which is connected to P atom via its carbon atom. The suffix n represents an integer of from 1 to 3. X represents an anion having a valence of n. X may be connected to L.

Examples of the group represented by $R_{1a}$, $R_{2a}$ or $R_{3a}$ include a straight-chain or branched alkyl group such as methyl, ethyl, propyl, isopropyl, butyl, isobutyl, sec-butyl, tert-butyl, octyl, 2-ethylhexyl, dodecyl, hexadecyl and octadecyl, a cycloalkyl group such as cyclopropyl, cyclopentyl and cyclohexyl, an aryl group such as phenyl, naphthyl and phenanthryl, an alkenyl such as allyl, vinyl and 5-hexenyl, a cycloalkenyl group such as cyclopentenyl and cyclohexenyl, and a heterocyclic residue such as pyridyl, quinolyl, furyl, imidazolyl, thiazolyl, thiadiazolyl, benzotriazolyl, benzothiazolyl, morpholyl, pyrimidyl and pyrrolidyl. Examples of the substituent for these groups include the groups represented by $R_{1a}$, $R_{2a}$ and $R_{3a}$, a halogen atom such as fluorine, chlorine, bromine and iodine, a nitro group, a primary amino group, a secondary amino group, a tertiary amino group, an alkylether group, an arylether group, an alkylthioether group, an arylthioether group, a carbonamide group, a carbamoyl group, a sulfonamide group, a sulfamoyl group, a hydroxyl group, a sulfoxy group, a sulfonyl group, a carboxyl group, a sulfonic acid group, a cyano group, and a carbonyl group. Examples of the group represented by L include the groups having the same meaning as $R_{1a}$, $R_{2a}$ and $R_{3a}$, a polymethylene group such as trimethylene, tetramethylene, hexamethylene, pentamethylene, octamethylene and dodecamethylene, a divalent aromatic group such as phenylene, biphenylene and naphtylene group, a polyvalent aliphatic group such as trimethylene methyl and tetramethylenemethyl and a polyvalent aromatic group such as phenylene-1,3,5-toluyl and phenylene-1,2,4,5-tetrayl.

Examples of the anion represented by X include a halogen ion such as chlorine ion, bromine ion and iodine ion, carboxylate ion such as acetate ion, oxalate ion, fumarate ion and benzoate ion, and sulfonate ion such as p-toluene sulfonate, methane sulfonate, butane sulfonate and benzene sulfonate, sulfate ion, perchlorate ion, carbonate ion and nitrate ion.

In the general formula (1), $R_{1a}$, $R_{2a}$ and $R_{3a}$ each preferably represent a group having not more than 20 carbon atoms, particularly an aryl group having not more than 15 carbon atoms. It is preferred that the suffix m represents an integer of 1 or 2. When m is 1, L is preferably a group having not more than 20 carbon atoms, particularly an alkyl or aryl group having not more than 15 carbon atoms. When m is 2, the divalent organic group represented by L is preferably an alkylene group, an arylene group, a divalent group formed by connecting these groups or a divalent group formed by combining these groups with —CO— group, —O— group, —$NR_{4a}$— group (in which $R_{4a}$ represents a hydrogen atom or a group having the same meaning as $R_{1a}$, $R_{2a}$ or $R_{3a}$; if a plurality of $R_{4a}$'s are present in the molecule, they may be the same or different and may be connected to each other), —S— group, —SO— group or —$SO_2$— group. When m is 2, it is particularly preferred that L is a divalent group having not more than 20 carbon atoms connected to P atom via its carbon atom. When m represents an integer of not less than 2, a plurality of $R_{1a}$'s, $R_{2a}$'s and $R_{3a}$'s present in the molecule may be the same or different.

The suffix n preferably is 1 or 2. X may be connected to $R_{1a}$, $R_{2a}$, $R_{3a}$ or L to form an intramolecular salt.

Most of the compounds represented by the general formula (1) of the present invention are known and commercially available as reagents. Examples of an ordinary method for synthesizing these compounds include a method which comprises the reaction of a phosphinic acid with an alkylating agent such as halogenated alkyl and sulfonic acid ester, and a method which comprises replacing paired anion such as phosphonium salt by an ordinary method.
Specific examples of the compound represented by the general formula (1) will be given below, but the present invention should not be construed as being limited thereto.
1-1
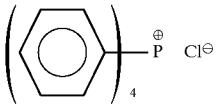
1-2
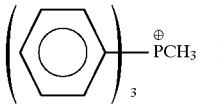
1-3
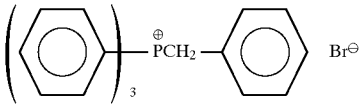
1-4
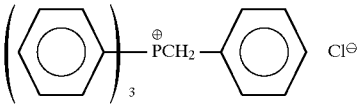
1-5
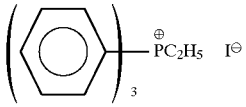
1-6
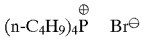
1-7
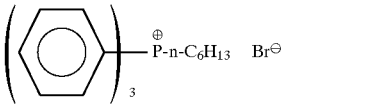
1-8
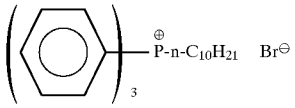
1-9
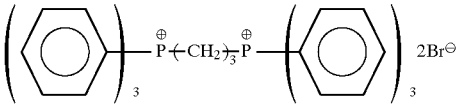
1-10
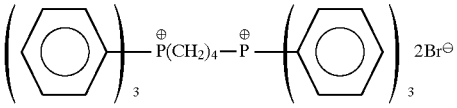
1-11
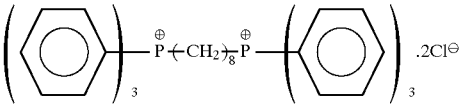
1-12
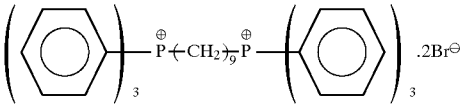
1-13
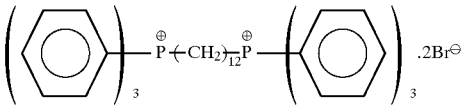
1-14
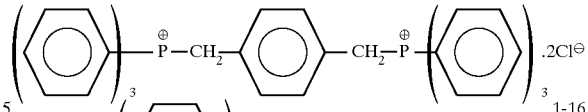
1-15
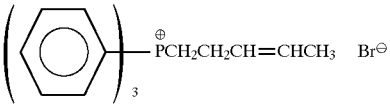
1-16
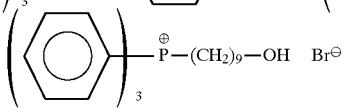
1-17
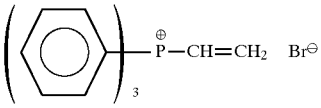
1-18
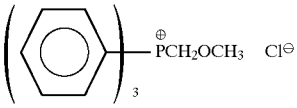
1-19
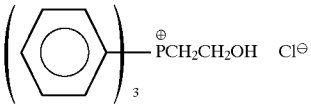
1-20
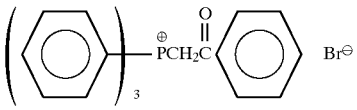
1-21
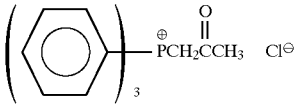
1-22
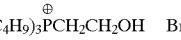
1-23
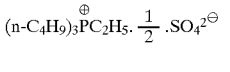
1-24
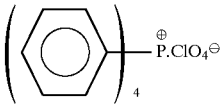
1-25
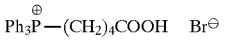
1-26
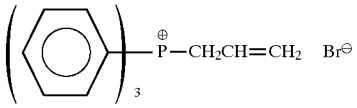
1-27
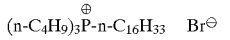
1-28
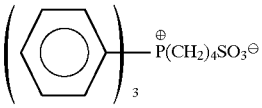

-continued
1-29
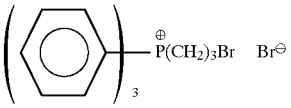
1-30
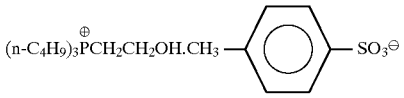
1-31
$(n\text{-}C_4H_9)_3\overset{\oplus}{P}CH_3I^{\ominus}$
1-32
$(HOCH_2)_3\overset{\oplus}{P}CH_3I^{\ominus}$
1-33
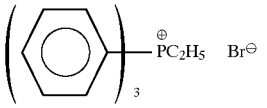
1-34
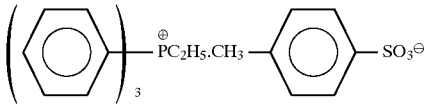
1-35
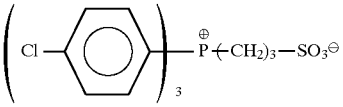
1-36
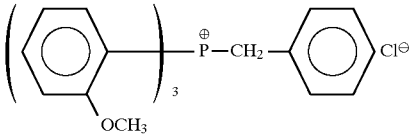
1-37
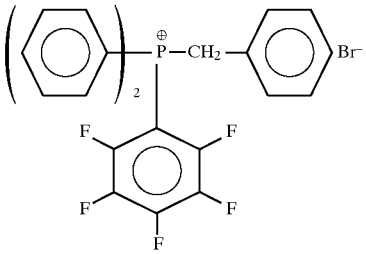
1-38
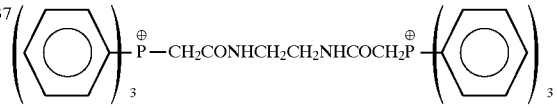
1-39
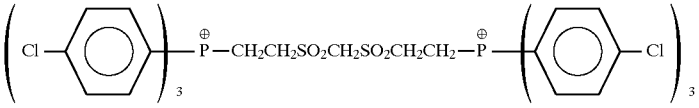
1-40
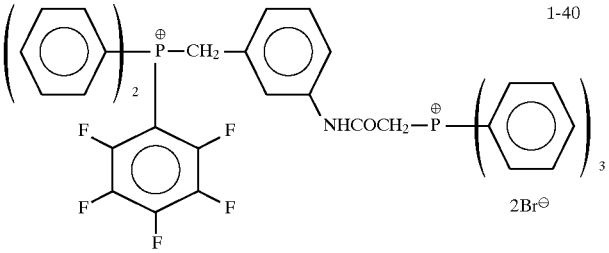
1-41
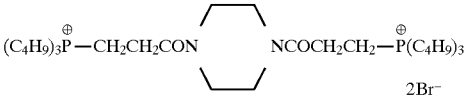
1-42
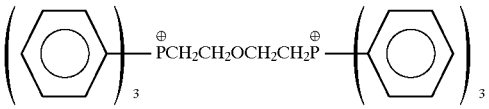
1-43
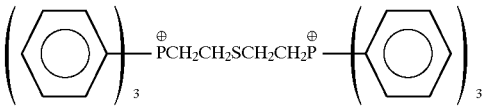
1-44
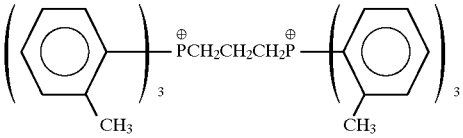
1-45
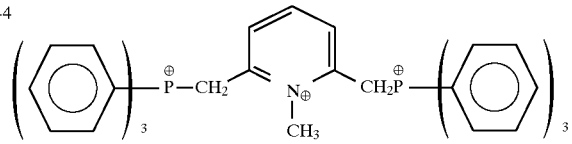
1-46
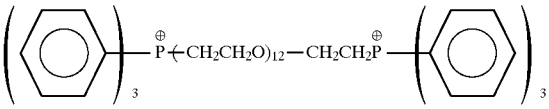

-continued

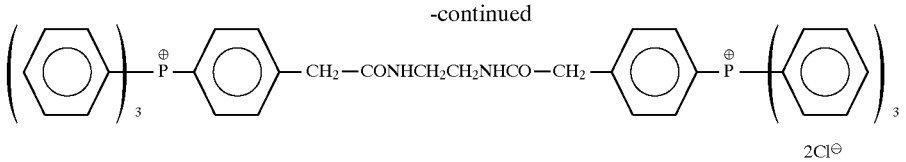

1-47

The amount of the phosphonium compound of formula (1) to be incorporated is not specifically limited but is preferably from $1\times10^{-5}$ to $2\times10^{-2}$ mol, particularly from $2\times10^{-5}$ to $1\times10^{-2}$ mol per mol of silver halide.

The compound represented by formula (1) may be incorporated in the photographic light-sensitive material as follows. In some detail, the compound represented by the general formula (1) of the present invention may be incorporated in a silver halide emulsion solution or hydrophilic colloidal solution in the form of an aqueous solution, if it is water-soluble, or a solution in an organic solvent miscible with water such as alcohol (e.g., methanol, ethanol), ester (e.g., ethyl acetate) and ketone (e.g., acetone), if it is water-insoluble.

The compound represented by the general formula (1) may be incorporated in the silver halide emulsion layer or other hydrophilic colloidal layers, preferably in the same layer as the layer in which the hydrazine derivative is incorporated.

In the present invention, as a material to provide an image with a harder contrast, a compound as described in JP-A-60-140340 or a compound of the general formula (I) or (II) as described in JP-A-6-242534 can be used in combination with the compound represented by the general formula (1) of the present invention.

The developing agent of general formula (2) will be further described hereinafter.

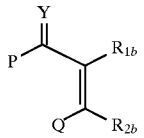

(2)

In the general formula (2), $R_{1b}$ and $R_{2b}$ each represent a hydroxyl group, an amino group, an acylamino group, an alkylsulfonylamino group, an arylsulfonylamino group, an alkoxysulfonylamino group, a mercapto group or an alkylthio group.

P and Q each represent a hydroxyl group, a hydroxyalkyl group, a carboxyl group, a carboxyalkyl group, a sulfo group, a sulfoalkyl group, an amino group, an aminoalkyl group, an alkyl group, an alkoxy group or a mercapto group or an atomic group necessary for the formation of a 5- to 7-membered ring together with two vinyl carbon atoms to which $R_{1b}$ and $R_{2b}$ are connected, respectively, and the carbon atom to which Y is connected.

Y comprises =O or =N—$R_{3b}$ in which $R_{3b}$ represents a hydrogen atom, a hydroxyl group, an alkyl group, an acyl group, a hydroxyalkyl group, a sulfoalkyl group or a carboxyalkyl group.

The compound represented by the general formula (2) will be further described hereinafter.

In the general formula (2), $R_{1b}$ and $R_{2b}$ each represent a hydroxyl group, an amino group which may have substituent (s) such as a $C_{1-10}$ alkyl group (e.g., methyl, n-butyl and hydroxyethyl), an acylamino group (e.g., acetylamino, benzoylamino), an alkylsulfonylamino group (e.g., methanesulfonylamino), an arylsulfonylamino group (e.g., benzenesulfonylamino, p-toluenesulfonylamino), alkoxycarbonylamino group (e.g., methoxycarbonylamino), a mercapto group or an alkylthio group (e.g., methylthio, ethylthio). Preferred examples of the group represented by $R_{1b}$ or $R_{2b}$ include a hydroxyl group, an amino group which may be substituted, an alkyl sulfonylamino group, and an arylsulfonylamino group.

P and Q each represent a hydroxyl group, a hydroxyalkyl group, a carboxyl group, a carboxyalkyl group, a sulfo group, a sulfoalkyl group, an amino group, an aminoalkyl group, an alkyl group, an alkoxy group or a mercapto group or an atomic group necessary for the formation of a 5- to 7-membered ring with two vinyl carbon atoms to which $R_{1b}$ and $R_{2b}$ are connected, respectively, and the carbon atom to which Y is connected. In some detail, the 5- to 7-membered ring is formed by a combination of —O—, —C($R_{4b}$)($R_{5b}$)—, —C($R_{6b}$)=, —C(=O)—, —N($R_{7b}$)—, and/or —N=. $R_{4b}$, $R_{5b}$, $R_{6b}$ and $R_{7b}$ each represent a hydrogen atom, a $C_{1-10}$ alkyl group which may have substituent(s) such as hydroxyl, carboxyl, and sulfo, a hydroxyl group or a carboxyl group. The 5- to 7-membered ring may further form a saturated or unsaturated condensed ring.

Examples of the 5- to 7-membered ring include dihydrofuranone ring, dihydropyrone ring, pyranone ring, cyclopentenone ring, cyclohexenone ring, pyrrolinone ring, pyrazolinone ring, pyridone ring, azacyclohexenone ring, and uracil ring. Preferred examples include a dihydrofuranone ring, a cyclopentenone ring, a cyclohexenone ring, a pyrazolinone ring, an azacyclohexenone ring, and an uracil ring.

Y is a group formed by =O or =N—$R_{3b}$ in which $R_{3b}$ represents a hydrogen atom, a hydroxyl group, an alkyl group (e.g., methyl, ethyl), an acyl group (e.g., acetyl), a hydroxyalkyl group (e.g., hydroxymethyl, hydroxyethyl), a sulfoalkyl group (e.g., sulfomethyl, sulfoethyl) or a carboxyalkyl group (e.g., carboxymethyl, carboxyethyl).

Specific examples of the compound represented by the general formula (2) will be given below, but the present invention should not be construed as being limited thereto.

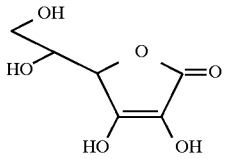

2-1

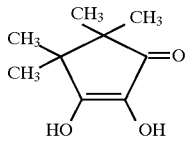

2-2

-continued
2-3
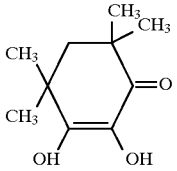
2-4
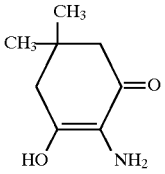
2-5
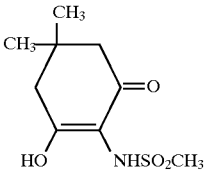
2-6
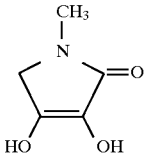
2-7
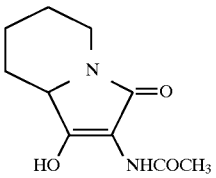
2-8
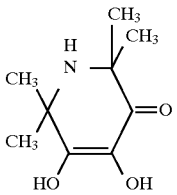
2-9
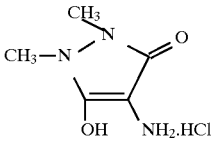
2-10
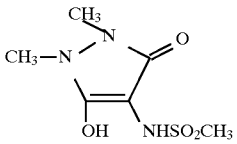
2-11
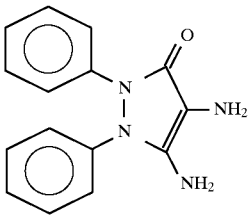
-continued
2-12
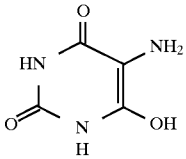
2-13
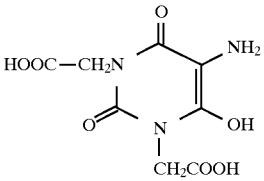
2-14
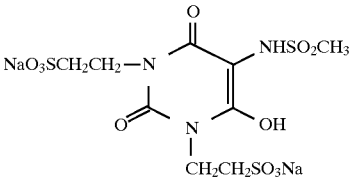
2-15
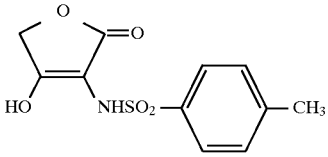
2-16
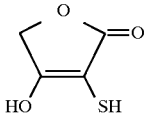
2-17
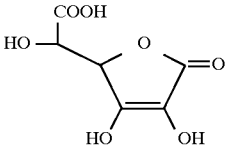
2-18
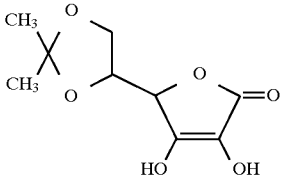
2-19
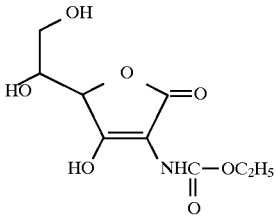
2-20
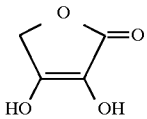

-continued 2-21

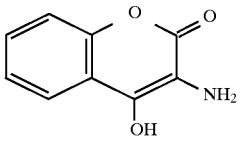

2-22

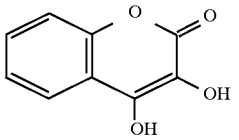

2-23

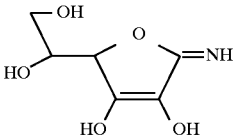

2-24

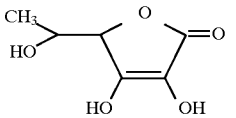

2-25

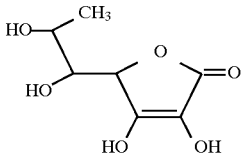

2-26

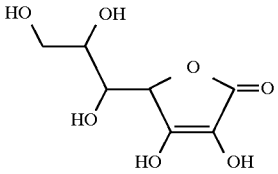

2-27

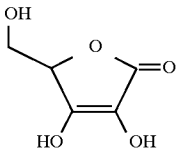

2-28

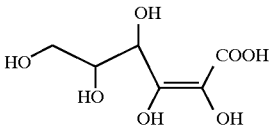

2-29

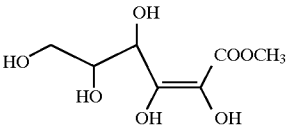

2-30

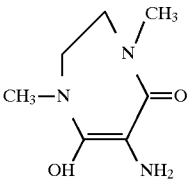

-continued 2-31

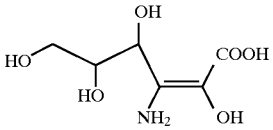

Among these compounds, ascorbic acid or erythorbic acid (diastereomer of ascorbic acid) is preferred.

The amount of the compound of the general formula (2) to be used is normally from $5\times10^{-3}$ mol to 1 mol, preferably from $10^{-2}$ mol to 0.5 mol per l of the developer used.

The hydrazine derivative will be further described hereinafter. In the present invention, hydrazine derivatives represented by the following general formulae (3) to (6) are preferably used.

The general formula (3) will be described hereinafter.

$$R_1-\underset{\underset{A_1}{|}}{N}-\underset{\underset{A_2}{|}}{N}-G_1-R_2 \qquad (3)$$

In the general formula (3), $R_1$ represents an aliphatic group or an aromatic group. $R_2$ represents a hydrogen atom or a block group such as an alkyl group, an aryl group, an unsaturated heterocyclic group, an alkoxy group, an aryloxy group, an amino group, a hydrazino group. $G_1$ represents —CO—, $$-SO_2-,\ -SO-,\ -\overset{\overset{O}{\|}}{\underset{\underset{R_3}{|}}{P}}-,\ -CO-CO-,$$

a thiocarbonyl group or an iminomethylene group. $A_1$ and $A_2$ both represent a hydrogen atom. Alternatively, one of $A_1$ and $A_2$ represents a hydrogen atom and the other represents a substituted or unsubstituted alkylsulfonyl group, a substituted or unsubstituted arylsulfonyl group or a substituted or unsubstituted acyl group. $R_3$ is selected from the groups defined as $R_2$. $R_3$ may be different from $R_2$.

The general formula (3) will be further described hereinafter.

In the general formula (3), the aliphatic group represented by $R_1$ is preferably a $C_{1-30}$ aliphatic group, particularly $C_{1-20}$ straight-chain, branched or cyclic alkyl group. The branched alkyl group may be cyclized to form a saturated heterocyclic group containing one or more hetero atoms. The alkyl group may contain substituent(s).

In the general formula (3), the aromatic group represented by $R_1$ is a monocyclic or bicyclic aryl group or an unsaturated heterocyclic group. The unsaturated heterocyclic group may be condensed with a monocyclic or bicyclic aryl group to form a heteroaryl group. Examples of the aromatic group represented by $R_1$ include benzene ring, naphthalene ring, pyridine ring, pyrimidine ring, imidazole ring, pyrazole ring, quinoline ring, isoquinoline ring, benzimidazole ring, thiazole ring, and benzothiazole ring. Among these aromatic groups, those containing benzene ring are preferred.

Particularly preferred examples of $R_1$ is aryl group.

The aliphatic group or aromatic group represented by $R_1$ may be substituted by substituent(s). Examples of the substituent include an alkyl group, an alkenyl group, an alkynyl group, an aryl group, a group containing heterocyclic group, a pyridinium group, a hydroxyl group, an alkoxy group, an aryloxy group, an acyloxy group, an alkylsulfonyloxy group, an arylsulfonyloxy group, an amino group, a carbonamide group, a sulfonamide group, an ureide group, a thioureide group, a semicarbazide group, a thiosemicarbazide group, an urethane group, a group having hydrazide structure, a group having quaternary ammonium structure, an alkylthio group, an arylthio group, an alkylsulfonyl group, an arylsulfonyl group, an alkylsulfinyl group, an arylsulfinyl group, a carboxyl group, a sulfo group, an acyl group, an alkoxycarbonyl group, an aryloxycarbonyl group, a carbamoyl group, a sulfamoyl group, a halogen atom, a cyano group, a phosphoric acid amide group, a diacylamino group, an imide group, a group having acylurea structure, a group containing selenium atom or tellurium atom, and a group having tertiary sulfonium structure or quaternary sulfonium structure. Preferred examples of the substituent include a straight-chain, branched or cyclic alkyl group (preferably having from 1 to 20 carbon atoms), an aralkyl group (preferably monocyclic or bicyclic aralkyl group having a $C_{1-3}$ alkyl moiety), an alkoxy group (preferably having from 1 to 20 carbon atoms), a substituted amino group (preferably an amino group substituted by $C_{1-20}$ alkyl group), an acylamino group (preferably having from 2 to 30 carbon atoms), a sulfonamide group (preferably having from 1 to 30 carbon atoms), an ureide group (preferably having from 1 to 30 carbon atoms), and a phosphoric acid amide group (preferably having from 1 to 30 carbon atoms).

In the general formula (3), the alkyl group represented by $R_2$ is preferably a $C_{1-4}$ alkyl group. The aryl group represented by $R_2$ is preferably a monocyclic or bicyclic aryl group, e.g., an aryl group containing benzene ring(s).

The unsaturated heterocyclic group represented by $R_2$ is preferably a 5- or 6-membered compound containing at least one nitrogen, oxygen and sulfur atom, such as an imidazolyl group, a pyrazolyl group, a triazolyl group, a tetrazolyl group, a pyridyl group, a pyridinium group, a quinolinium group, and a quinolinyl group. Particularly preferred are a pyridyl group and a pyridinium group.

The alkoxy group represented by $R_2$ is preferably a $C_{1-8}$ alkoxy group. The aryloxy group represented by $R_2$ is preferably a monocyclic aryloxy group. The amino group represented by $R_2$ is preferably an unsubstituted amino group or a $C_{1-10}$ alkylamino or an arylamino group.

$R_2$ may be substituted by substituent(s). Preferred examples of the substituent include those exemplified as substituents for $R_1$.

When $G_1$ is —CO— group, $R_2$ is preferably a hydrogen atom, an alkyl group (e.g., methyl, difluoromethyl, trifluoromethyl, 3-hydroxypropyl, 3-methanesulfonamidepropyl, phenylsulfonylmethyl), an aralkyl group (e.g., o-hydroxybenzyl), and an aryl group (e.g., phenyl, 3,5-dichlorophenyl, o-methanesulfonamidephenyl, 4-methanesulfonylphenyl, 2-hydroxymethylphenyl). Particularly preferred are a hydrogen atom, a difluoromethyl group, and a trifluoromethyl group.

When $G_1$ is —$SO_2$— group, preferred examples of $R_2$ include an alkyl group (e.g., methyl), an aralkyl group (e.g., o-hydroxybenzyl), an aryl group (e.g., phenyl), and a substituted amino group (e.g., dimethylamino).

When $G_1$ is —COCO— group, preferred examples of $R_2$ include an alkoxy group, an aryloxy group, and an amino group.

G in the general formula (3) is preferably —CO— group or —COCO— group, more preferably —CO— group.

$R_2$ may be a group which causes $G_1$—$R_2$ moiety to be cleaved from the rest of the molecule to cause a cyclization reaction thereby producing a cyclic structure containing atoms in —$G_1$—$R_2$— moiety. Examples of such a group include those described in JP-A-63-29751.

$A_1$ and $A_2$ each represent a hydrogen atom, an alkylsulfonyl or arylsulfonyl group having 20 or less carbon atoms (preferably a phenylsulfonyl group or a phenylsulfonyl group which is substituted such that the sum of Hammett's substituent constants is not less than −0.5) or an acyl group having 20 or less carbon atoms (preferably a benzoyl group or a benzoyl group which is substituted such that the sum of Hammett's substituent constants is not less than −0.5 or a straight-chain, branched or cyclic substituted or unsubstituted aliphatic acyl group (examples of the substituent include a halogen atom, an ether group, a sulfonamide group, a carbonamide group, a hydroxyl group, a carboxyl group, and a sulfonic acid group)).

A hydrogen atom is particularly preferred as $A_1$ or $A_2$.

$R_1$ and $R_2$ in the general formula (3) may be further substituted by substituent(s). Examples of the substituents include those exemplified as substituents for $R_1$. These substituents may be substituted by substituent(s) which may be substituted by substituent(s). The repetition of substitution may continue further. Preferred examples of these substituents include those exemplified as substituents for $R_1$.

In $R_1$ or $R_2$ in the general formula (3) may be incorporated a ballast group or a polymer commonly used for an immobile photographic additive such as a coupler. The ballast group is a relatively photographically inactive group having 8 or more carbon atoms. It can selected from the group consisting of an alkyl group, an aralkyl group, an alkoxy group, a phenyl group, an alkylphenyl group, a phenoxy group, and an alkylphenoxy group. Examples of the polymer include those described in JP-A-1-100530.

In $R_1$ or $R_2$ in the general formula (3) may be incorporated a group which accelerates adsorption to the surface of silver halide grains. Examples of such an adsorption group include groups described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, and JP-A-63-234246, such as alkylthio group, arylthio group, thiourea group, heterocyclic thioamide group, mercapto heterocyclic group and triazole group.

A particularly preferred example of the hydrazine derivative of the present invention is a hydrazine derivative wherein $R_1$ is a phenyl group having a ballast group, a group which accelerates adsorption to the surface of silver halide grains, a group having a quaternary ammonium structure or an alkylthio group via a sulfonamide group, an acylamino group or an ureide group, G is —CO— group, and $R_2$ is a hydrogen atom, a substituted alkyl group or a substituted aryl group (preferred examples of the substituent include an electron-withdrawing group and a hydroxymethyl group as a substituent on the 2-position). All combinations of the foregoing options of $R_1$ and $R_2$ are possible and preferred.

Specific examples of the compound represented by the general formula (3) will be given below, but the present invention should not be construed as being limited thereto.

3-1
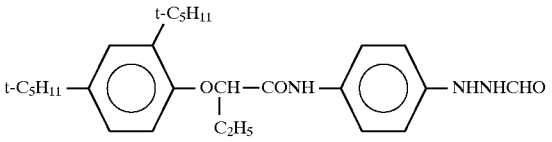
3-2
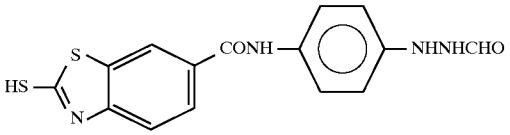
3-3
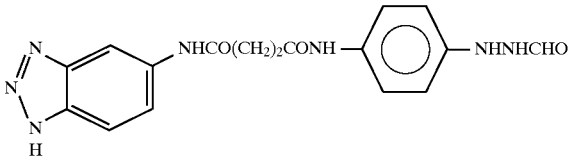
3-4
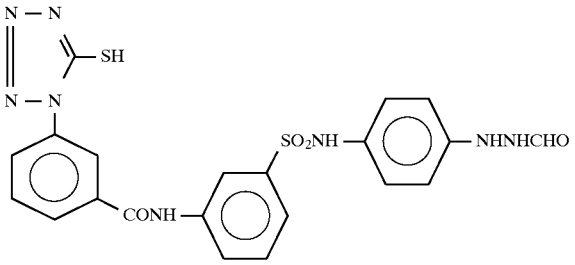
3-5
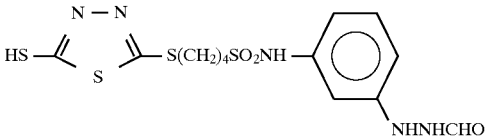
3-6
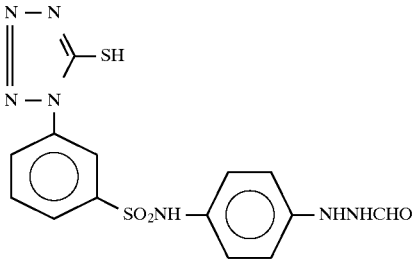
3-7
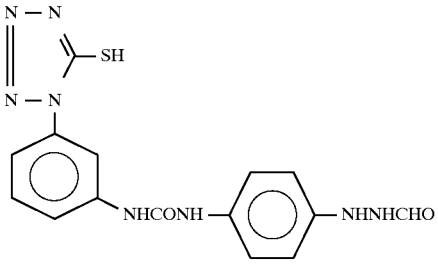
3-8
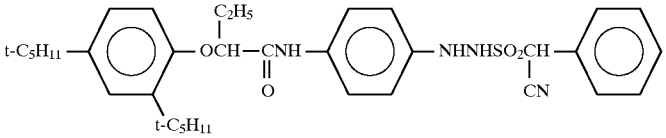

-continued
3-9
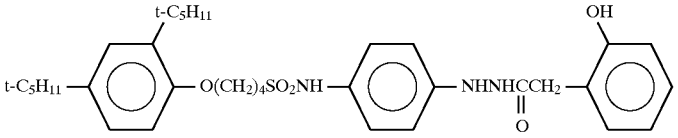
3-10
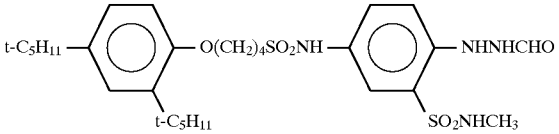
3-11
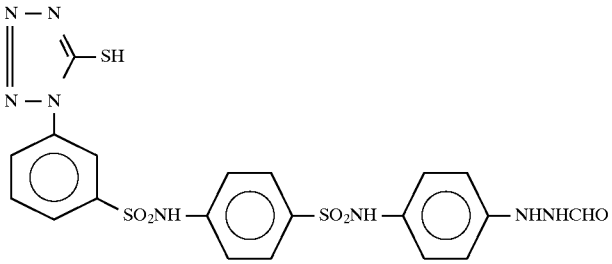
3-12
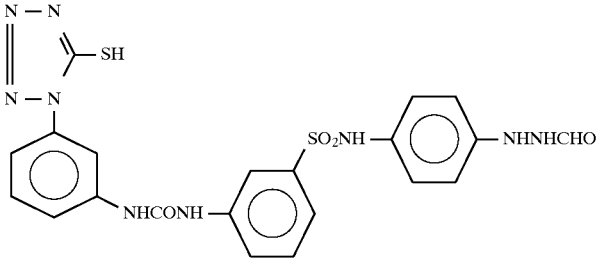
3-13
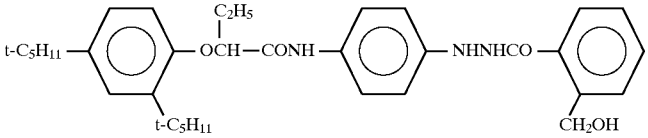
3-14
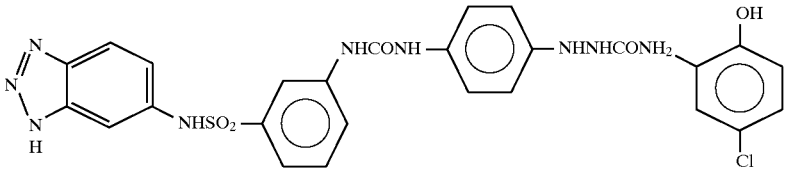
3-15
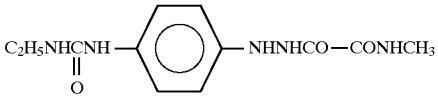
3-16
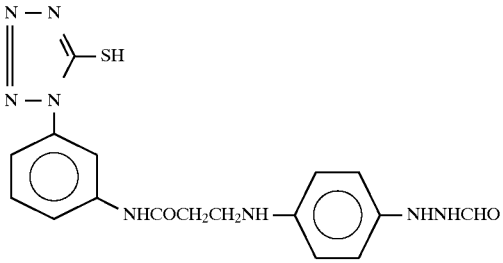

-continued
3-17
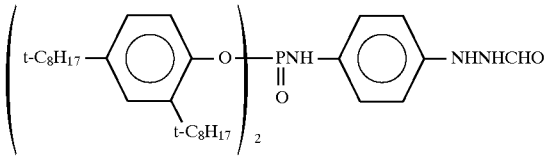
3-18
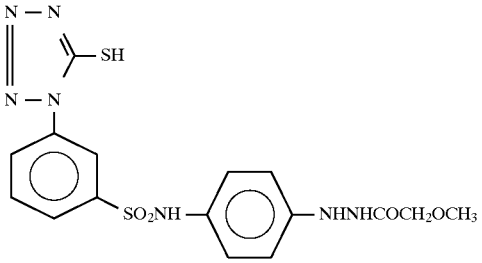
3-19
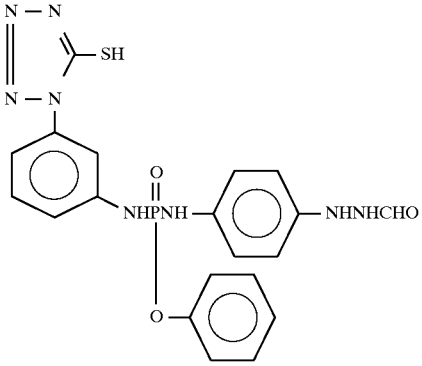
3-20
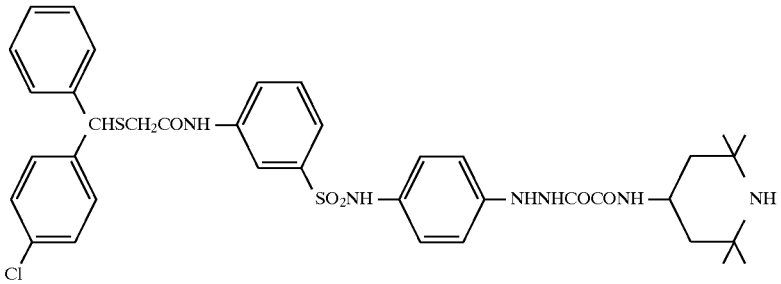
3-21
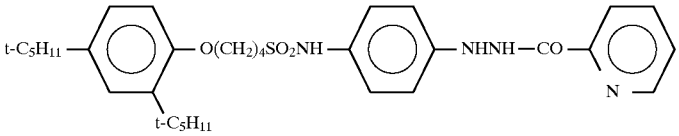
3-22
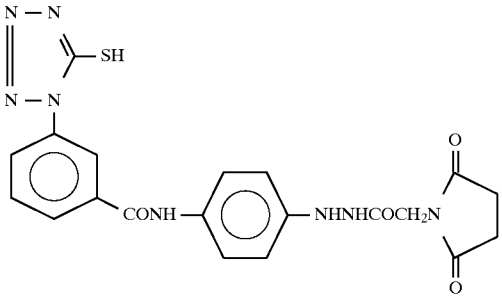

-continued
3-23
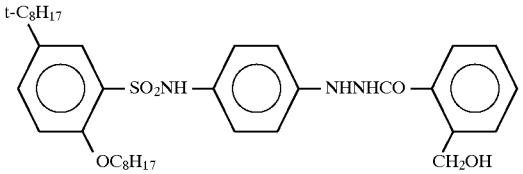
3-24
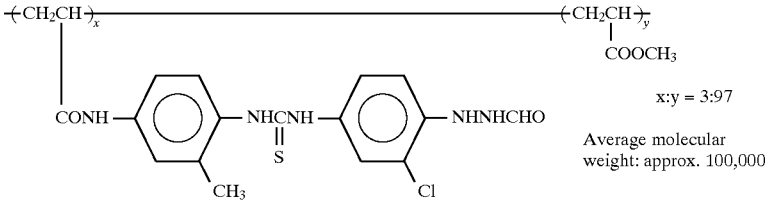
3-25
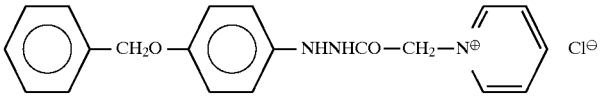
3-26
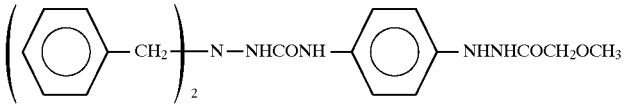
3-27
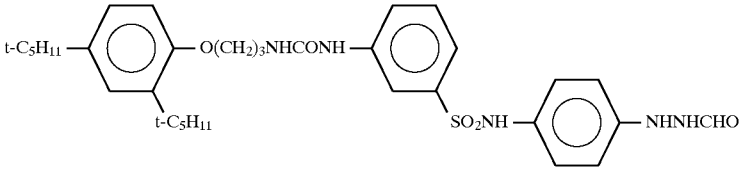
3-28
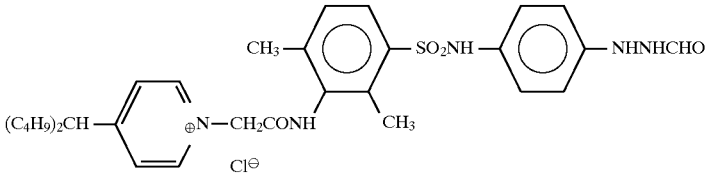
3-29
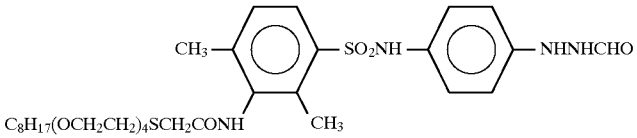
3-30
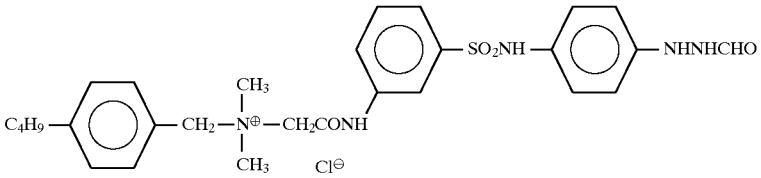
3-31
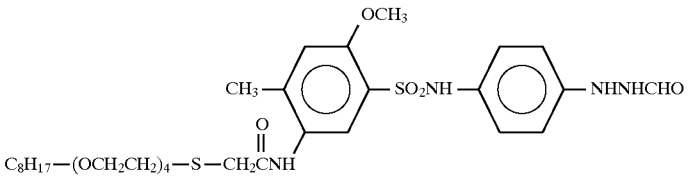

-continued
3-32
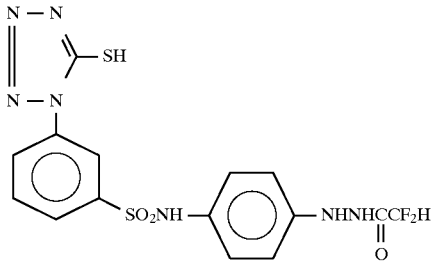
3-33
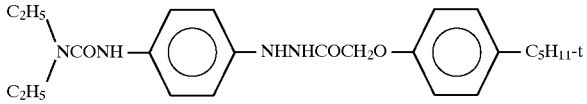
3-34
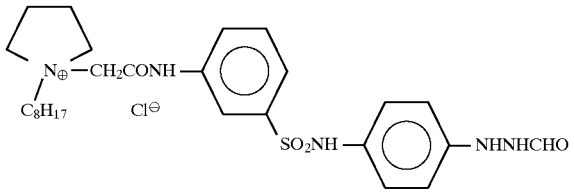
3-35
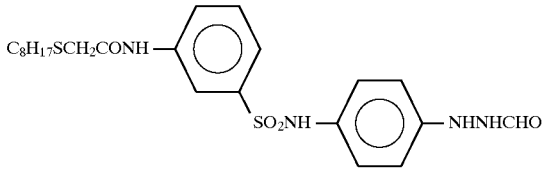
3-36
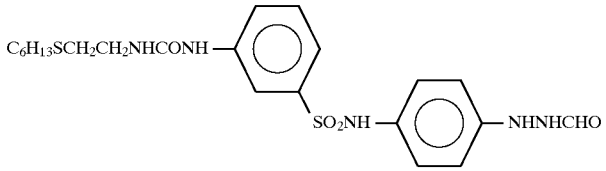
3-37
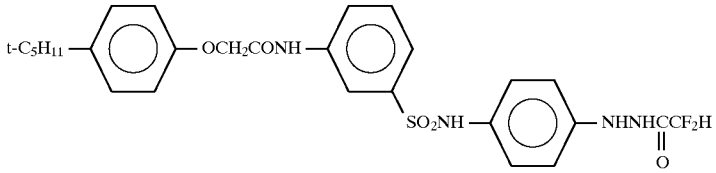
3-38
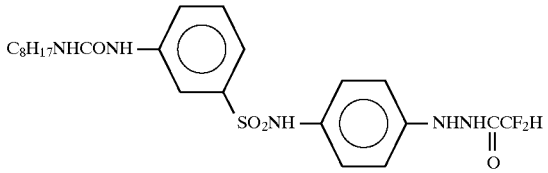
3-39
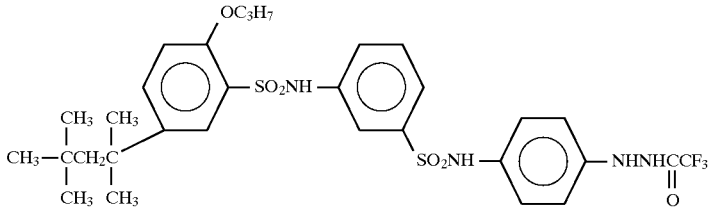

-continued
3-40
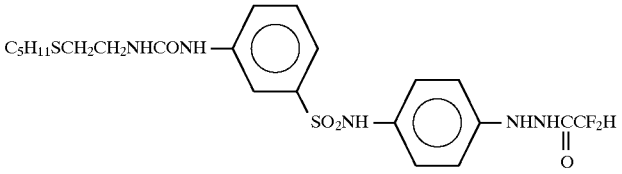
3-41
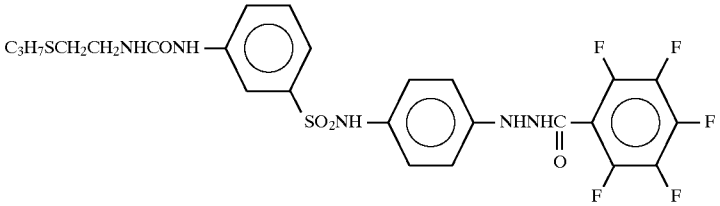
3-42
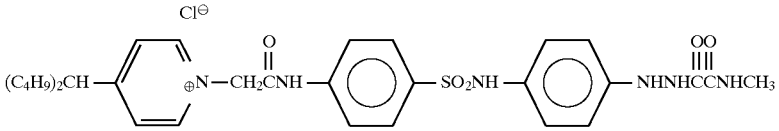
3-43
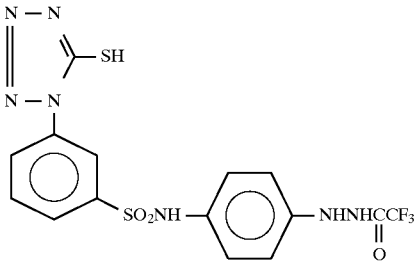
3-44
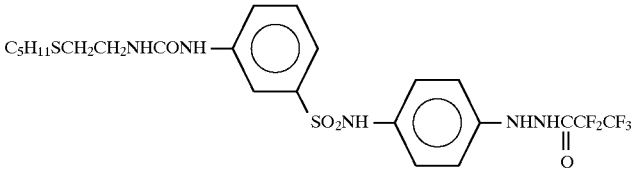
3-45
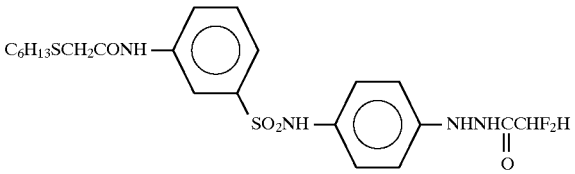
3-46
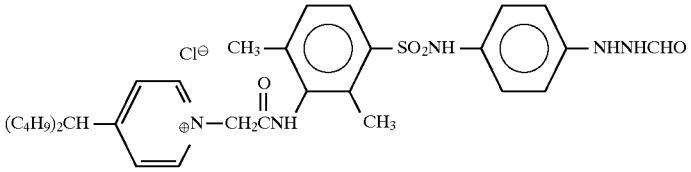
3-47
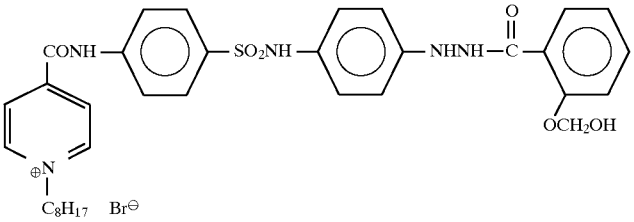

-continued
3-48
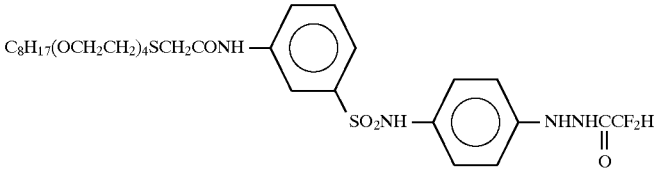
3-49
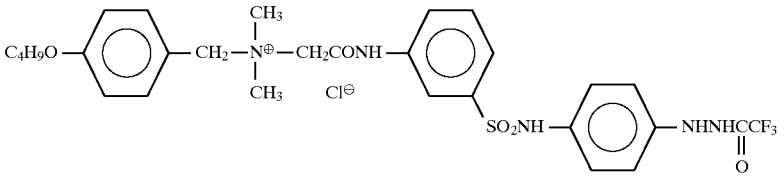
3-50
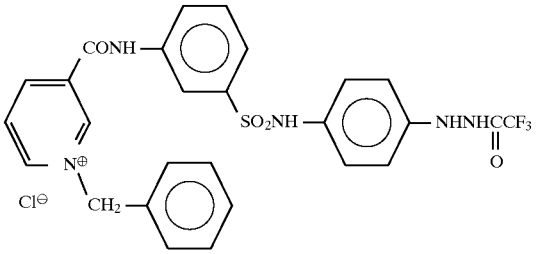
3-51
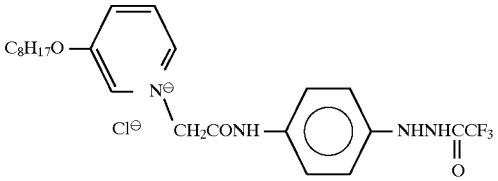
3-52
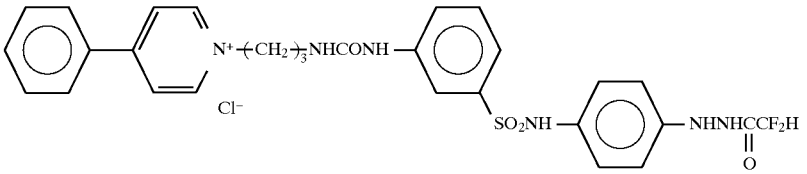
3-53
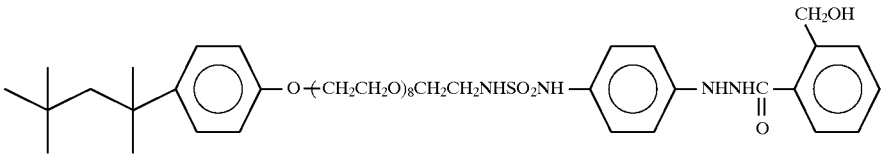
3-54
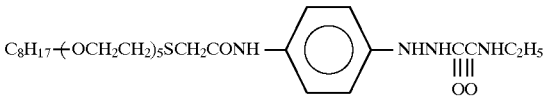
3-55
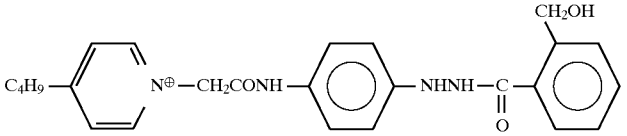
3-56
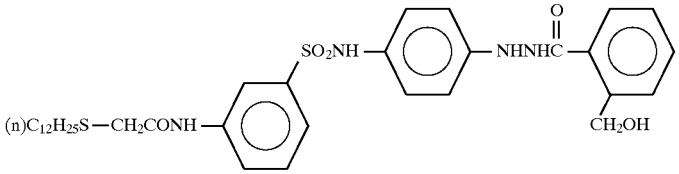

-continued
3-57
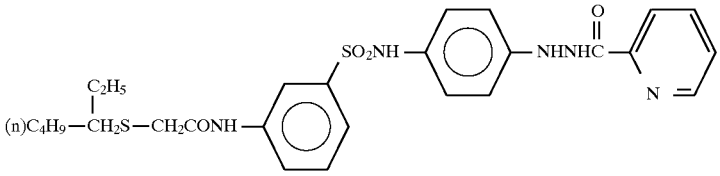
3-58
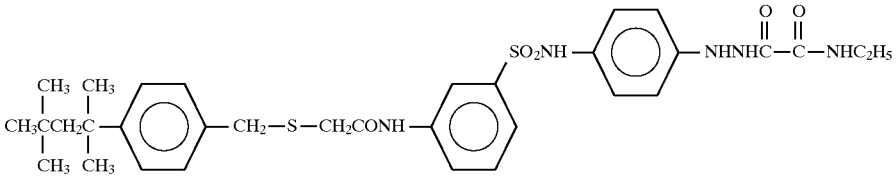
3'-1
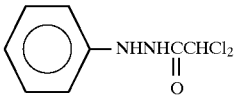
3'-2
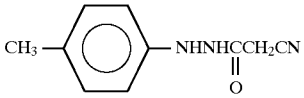
3'-3
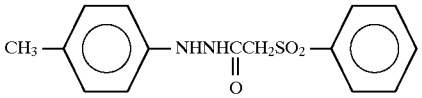
3'-4
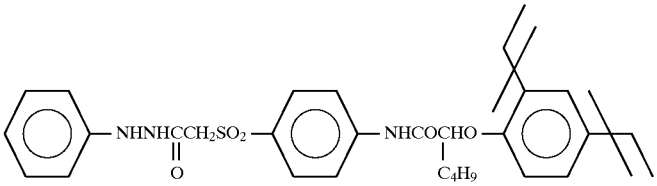
3'-5
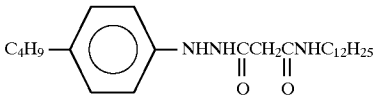
3'-6
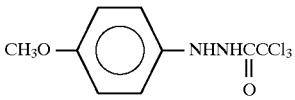
3'-7
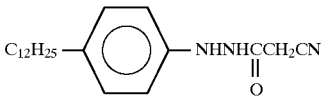
3'-8
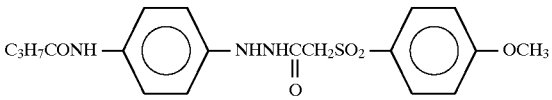
3'-9
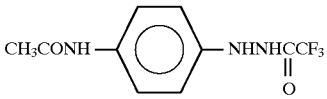
3'-10
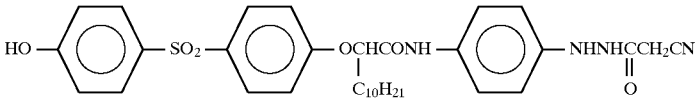

-continued
3'-11
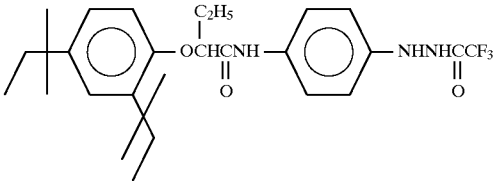
3'-12
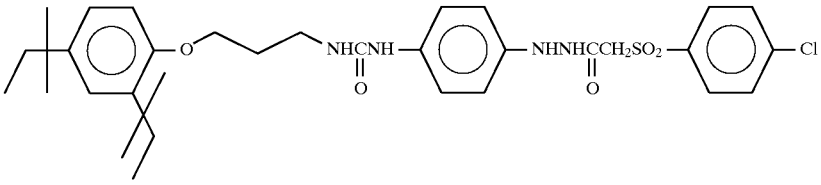
3'-13
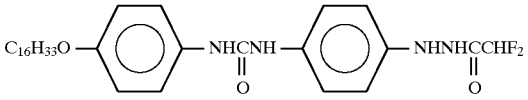
3'-14
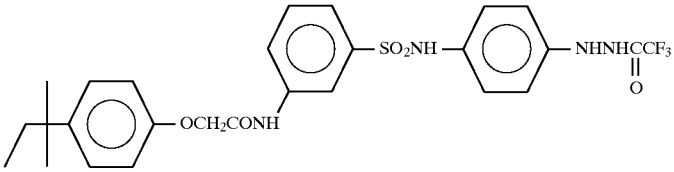
3'-15
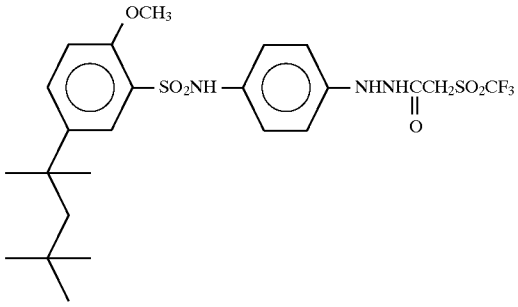
3'-16
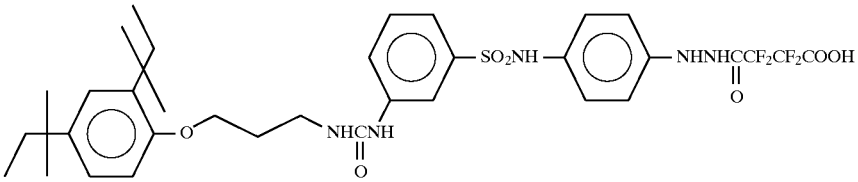
3'-17
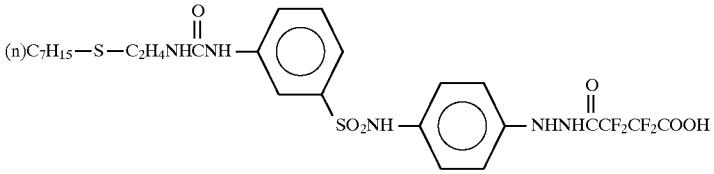
3'-18
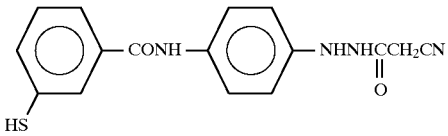
3'-19
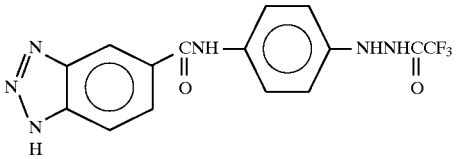

-continued
3'-20
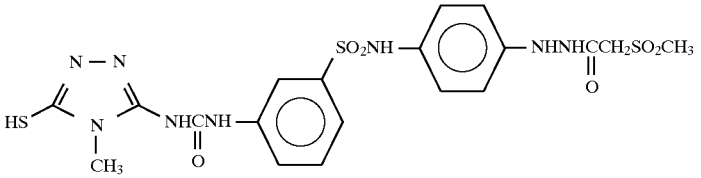
3'-21
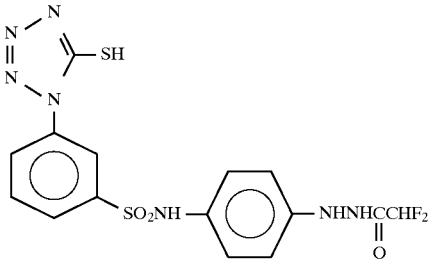
3'-22
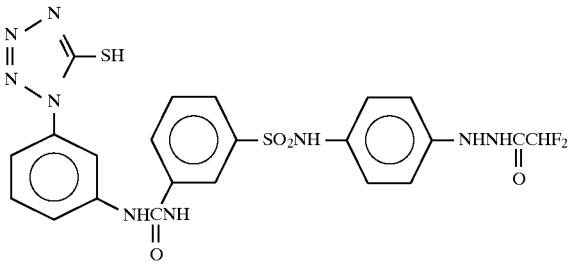
3'-23
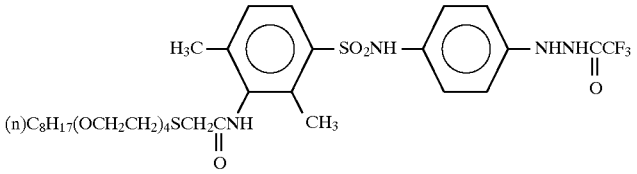
3'-24
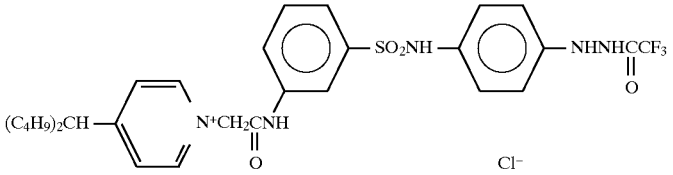
3'-25
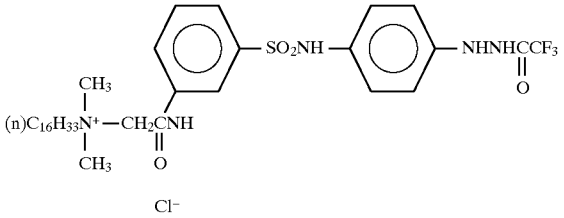
3'-26
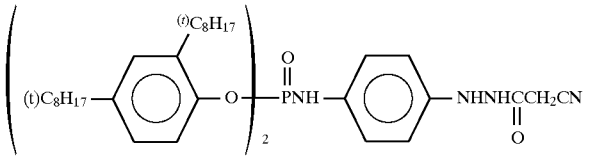

-continued
3'-27
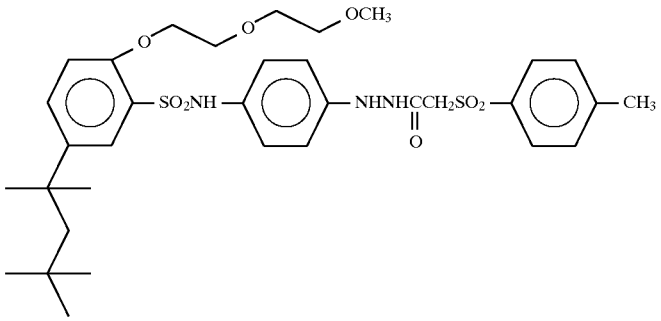
3'-28
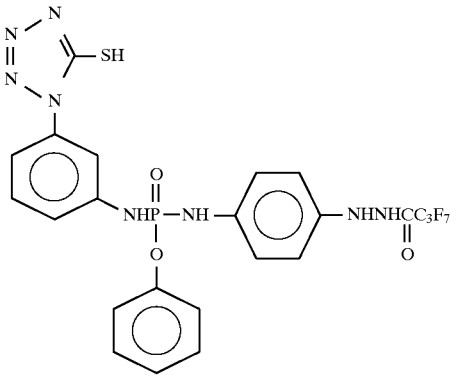
3'-29
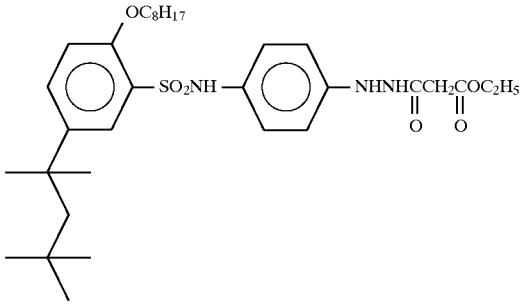
3'-30
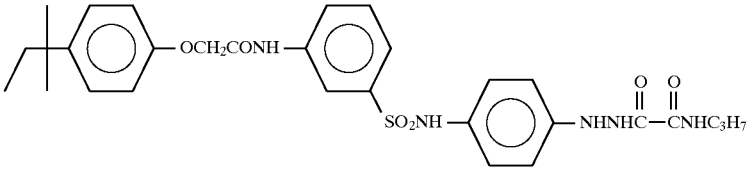
3'-31
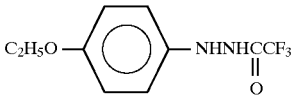
3'-32
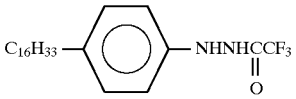
3'-33
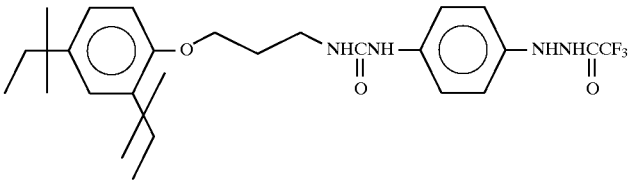

-continued
3'-34
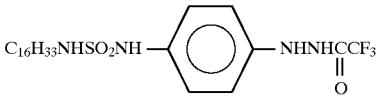
3'-35
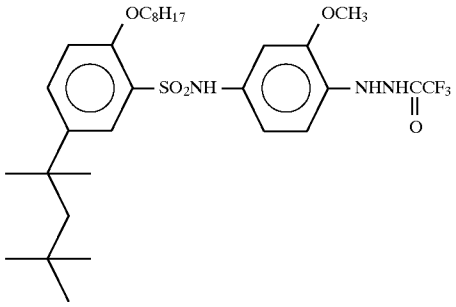
3'-36
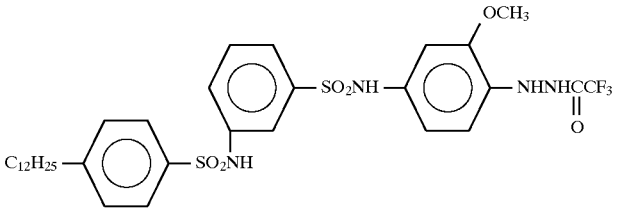
3'-37
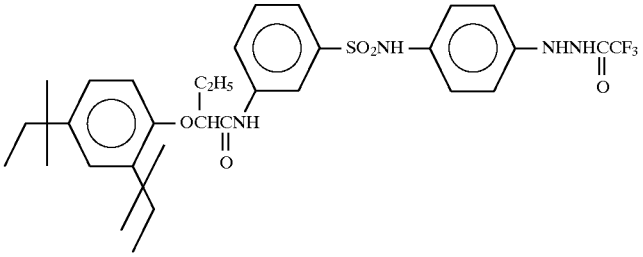
3'-38
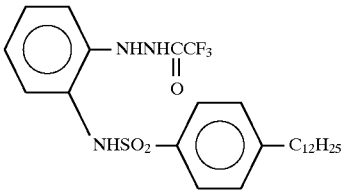
3'-39
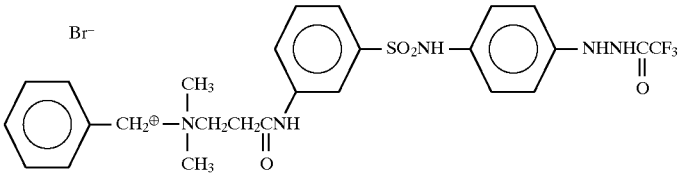
3'-40
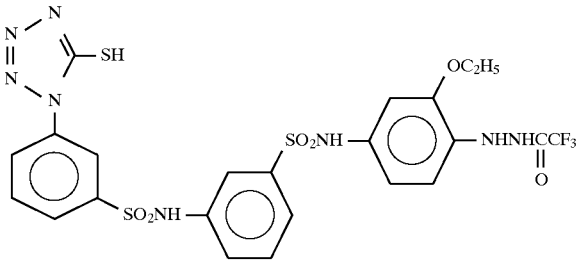

-continued

3'-41

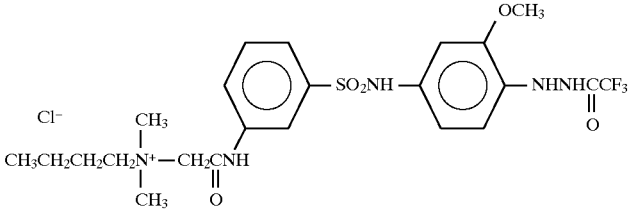

3'-42

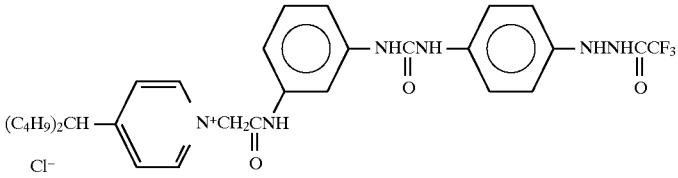

3'-43

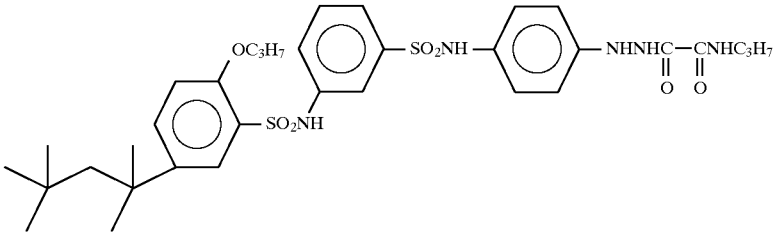

3'-44

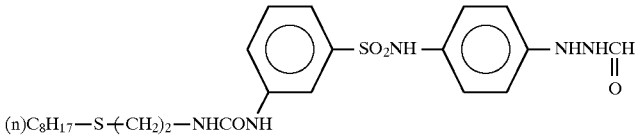

3'-45

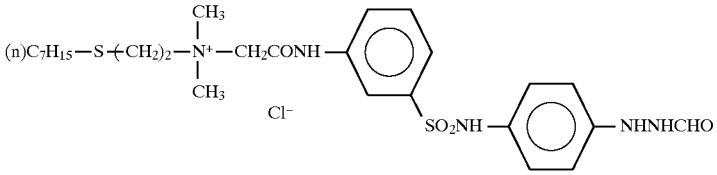

3'-46

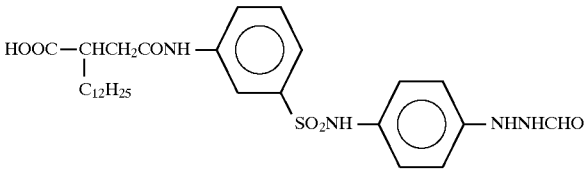

The general formulae (4), (5) and (6) will be further described hereinafter.

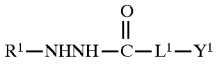

(4)

wherein $R^1$ represents an alkyl group, an aryl group or a heterocyclic group; $L^1$ represents a divalent connecting group having an electron-withdrawing group; and $Y^1$ represents an anionic group or a nonionic group which forms an intramolecular hydrogen bond with a hydrogen atom in the hydrazine.

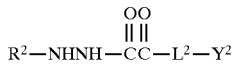

(5)

wherein $R^2$ represents an alkyl group, aryl group or heterocyclic group; $L^2$ represents a divalent connecting group; and $Y^2$ represents an anionic group or a nonionic group which forms an intramolecular hydrogen bond with a hydrogen atom in the hydrazine.

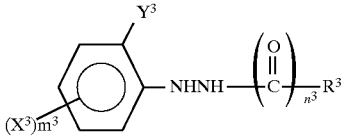

(6)

wherein $X^3$ represents a group capable of becoming a substituent on the benzene ring; $R^3$ represents an alkyl group, an alkenyl group, an alkynyl group, an aryl group, a heterocyclic group, an alkoxy group or an amino group; $Y^3$ represents an anionic group or a nonionic group which forms an intramolecular hydrogen bond with a hydrogen atom in the hydrazine; $m^3$ represents an integer of from 0 to 4; and $n^3$ represents an integer of 1 or 2, with the proviso that when $n^3$ is 1, $R^3$ has an electron-withdrawing group.

The general formulae (4) to (6) will be further described hereinafter.

The alkyl group represented by $R^1$ or $R^2$ is preferably a $C_{1-16}$ straight-chain, branched or cyclic alkyl group, more preferably a $C_{1-12}$ straight-chain, branched or cyclic alkyl group. Examples of such an alkyl group include methyl, ethyl, propyl, isopropyl, t-butyl, allyl, propargyl, 2-butenyl, 2-hydroxyethyl, benzyl, benzhydryl, trityl, 4-methylbenzyl, 2-methoxyethyl, cyclopentyl, and 2-acetamideethyl.

The aryl group represented by $R^1$ or $R^2$ is preferably a $C_{6-24}$ aryl group, more preferably a $C_{6-12}$ aryl group. Examples of such an aryl group include phenyl, naphthyl, p-alkoxyphenyl, p-sulfonamidephenyl, p-ureidephenyl, and p-amidephenyl. The heterocyclic group represented by $R^1$ or $R^2$ is preferably a $C_{1-5}$ 5- or 6-membered saturated or unsaturated heterocyclic group containing one or more oxygen, nitrogen or sulfur atoms. The number and kind of these hetero atoms may be single or plural. Examples of such a heterocyclic group include 2-furyl, 2-chenyl, and 4-pyridyl.

$R^1$ and $R^2$ each is preferably an aryl group, an aromatic heterocyclic group or an aryl-substituted methyl group, more preferably an aryl group (e.g., phenyl, naphthyl). $R^1$ and $R^2$ each may be substituted by substituent(s). Examples of the substituent include alkyl, aralkyl, alkoxy, alkyl-substituted amino, aryl-substituted amino, amide, sulfonamide, ureide, urethane, aryloxy, sulfamoyl, carbamoyl, aryl, alkylthio, arylthio, sulfonyl, sulfinyl, hydroxyl, halogen atom, cyano, sulfo, carboxyl, and phosphoric acid amide. These substituents may be further substituted. Preferred examples include sulfonamide, ureide, amide, alkoxy, and urethane. Particularly preferred are sulfonamide and ureide. These groups may be optionally connected to each other to form a ring.

Examples of the alkyl group, aryl group and heterocyclic group represented by $R^3$ include those listed with reference to $R^1$. The alkenyl group represented by $R^3$ is preferably a $C_{2-18}$ alkenyl group, more preferably a $C_{2-10}$ alkynyl group, such as vinyl and 2-styryl. The alkynyl group represented by $R^3$ is preferably a $C_{2-18}$ alkynyl group, more preferably a $C_{2-10}$ alkynyl group, such as ethynyl and phenylethynyl. The alkoxy group represented by $R^3$ is preferably a $C_{1-16}$ straight-chain, branched or cyclic alkoxy group, more preferably a $C_{1-10}$ straight-chain, branched or cyclic alkoxy group, such as methoxy, isopropoxy and benzyloxy. The amino group represented by $R^3$ is preferably a $C_{0-16}$ amino group, more preferably $C_{1-10}$ amino group, such as ethylamino, benzylamino and phenylamino.

When $n^3$ is 1, $R^3$ is preferably an alkyl group, an alkenyl group or an alkynyl group. When $n^3$ is 2, $R^3$ is preferably an amino group or an alkoxy group.

It is preferred the electron-withdrawing group which $R^3$ has a Hammett's $\sigma_m$ value of not less than 0.2, more preferably not less than 0.3. Examples of such an electron-withdrawing group include a halogen atom (e.g., fluorine, chlorine, bromine), a cyano group, a sulfonyl group (e.g., methanesulfonyl, benzenesulfonyl), a sulfinyl group (e.g., methanesulfinyl), an acyl group (e.g., acetyl, benzoyl), an oxycarbonyl group (e.g., methoxycarbonyl), a carbamoyl group (e.g., N-methylcarbamoyl), a sulfamoyl group (e.g., methylsulfamoyl), a halogen-substituted alkyl group (e.g., trifluoromethyl), a heterocyclic group (e.g., 2-benzoxazolyl, pyrrolo), and a quaternary onium group (e.g., triphenylphosphonium, trialkylammonium, pyridinium). Examples of $R^3$ containing an electron-withdrawing group include trifluoromethyl, difluoromethyl, pentafluoroethyl, cyanomethyl, methanesulfonylmethyl, acetylethyl, trifluoromethylethynyl, and ethoxycarbonylmethyl.

$L^1$ and $L^2$ each represent a divalent connecting group. Examples of the divalent connecting group include an alkylene group, an alkenylene group, an alknylene group, an arylene group, a divalent heterocyclic group, and group having these groups connected via —O—, —S—, —NH—, —CO—, —$SO_2$, etc., singly or in combination. $L^1$ and $L^2$ may be substituted by groups described as substituents for $R^1$. Examples of the alkylene group represented by $L^1$ or $L^2$ include methylene, ethylene, trimethylene, propylene, 2-butene-1,4-yl, and 2-butyne-1,4-yl. Examples of the alkenylene group represented by $L^1$ or $L^2$ include vinylene. Examples of the alkynylene group represented by $L^1$ or $L^2$ include ethynylene. Examples of the arylene group represented by $L^1$ or $L^2$ include phenylene. Examples of the divalent heterocyclic group represented by $L^1$ or $L^2$ include furan-1,4-diyl. $L^1$ is preferably an alkylene group, an alkenylene group, an alkynylene group or an arylene group, more preferably an alkylene group, most preferably an alkylene group having a $C_{2-3}$ chain length. $L^2$ is preferably an alkylene group, arylene group, —NH-alkylene group, —O-alkylene group or —NH-arylene group, more preferably —NH-alkylene group or —O-alkylene group.

Examples of the electron-withdrawing group which $L^1$ has include those described as electron-withdrawing groups which $R^3$ has. Examples of $L^1$ include tetrafluoroethylene, fluoromethylene, hexafluorotrimethylene, perfluorophenylene, difluorovinylene, cyanomethylene, and methanesulfonylethylene.

$Y^1$ to $Y^3$ are as defined above. $Y^1$ to $Y^3$ each represent an anionic group or a nonionic group having a lone pair forming a hydrogen bond with a hydrazine hydrogen in the 5- to 7-membered ring. Specific examples of the anionic group include carboxylic acid, sulfonic acid, sulfinic acid, phosphoric acid, phosphonic acid, and salt thereof with alkaline metal ion (sodium, potassium), alkaline earth metal ion (e.g., calcium, magnesium), ammonium (e.g., ammonium, triethylammonium, tetrabutylammonium, pyridinium), phosphonium (tetraphenylphosphonium), etc. The nonionic group is a group having at least one of oxygen atom, nitrogen atom, sulfur atom and phosphorus atom. Examples of such a nonionic group include an alkoxy group, an amino group, an alkylthio group, a carbonyl group, a carbamoyl group, an alkoxycarbonyl group, an urethane group, an ureide group, an acyloxy group, and an acylamino group. $Y^1$ to $Y^3$ each are preferably an anionic group, more preferably a carboxylic acid or a salt thereof.

Preferred examples of the group represented by $X^3$ which is a group capable of becoming a substituent on the benzene ring include those described as the substituent for $R^1$ in the general formula (4). When $m^3$ is 2 or more, the plurality of $X^3$'s may be the same or different.

$R^1$ to $R^3$, or $X^3$ may have a non-diffusive group which is used for photographic couplers or a group which accelerates adsorption to silver halide. The non-diffusive group has from not less than 8 to not more than 30 carbon atoms, preferably from not less than 12 to not more than 25 carbon atoms. Preferred examples of the group which accelerates adsorption to silver halide include thioamide (e.g., thiourethane, thioureide, thioamide), mercapto (e.g., heterocyclic mercapto such as 5-mercaptotetrazole, 3-mercapto-1,2,4-triazole, 2-mercapto-1,3,4-thiadiazole and 2-mercapto-1,3,4-oxazidazole, alkylmercapto, arylmercapto), and 5- or 6-membered nitrogen-containing heterocyclic group which produces imino silver (e.g., benzotriazole). Examples of $R^1$ to $R^3$, or $X^3$ containing such a group which accelerates adsorption to silver halide include those having a protected adsorption group arranged such that the protective group is removed upon development to enhance the adsorption to silver halide.

With respect to each of formulae (4) to (6), a bis form formed by connecting radicals formed by removing a hydrogen atom from two of these compounds may be used.

Among the compounds of formulae (4) to (6), those of formulae (4) and (5) are preferred, and those of formula (4) are most preferred. Among the compounds of formulae (4) to (6), those represented by formulae (7) to (9) are preferred, and those represented by formula (7) are most preferred.

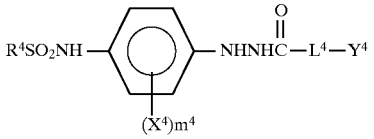

(7)

wherein $R^4$, $X^4$ and $m^4$ have the same meaning as $R^3$, $X^3$ and $m^3$ in the general formula (3), respectively; and $L^4$ and $Y^4$ have the same meaning as $L^1$ and $Y^1$ in the general formula (1), respectively.

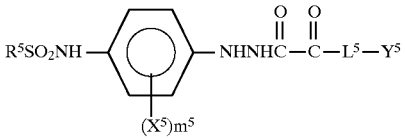

(8)

wherein $R^5$, $X^5$ and $m^5$ have the same meaning as $R^3$, $X^3$ and $m^3$ in the general formula (3), respectively; and $L^5$ and $Y^5$ have the same meaning as $L^2$ and $Y^2$ in the general formula (2), respectively.

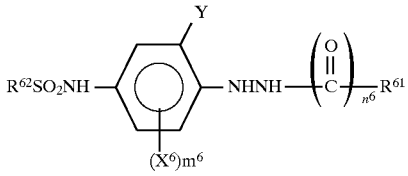

(9)

wherein $R^{61}$, $R^{62}$, $X^6$, $m^6$, $n^6$ and Y have the same meaning as $R^3$, $R^{3,}$ $X^3$, $m^3$, $n^3$ and $Y^3$ in the general formula (3), respectively.

Specific examples of the nucleating agent employable herein will be given below, but the present invention should not be construed as being limited thereto.

4-1.

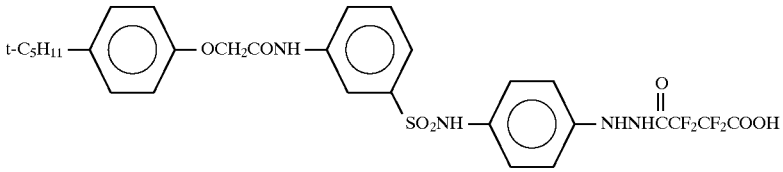

4-2.

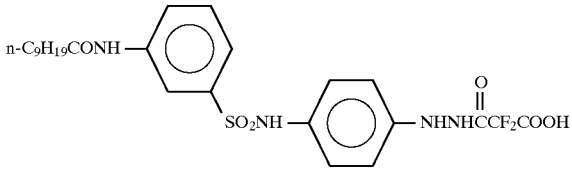

4-3.

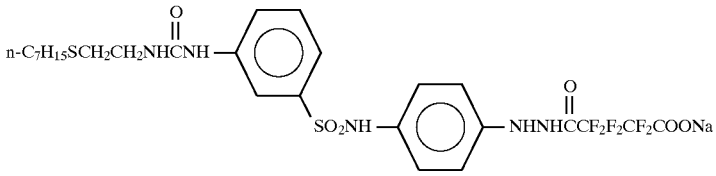

4-4.

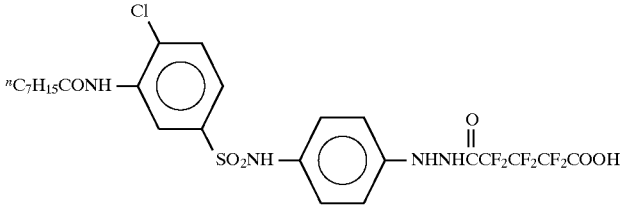

-continued
4-5.
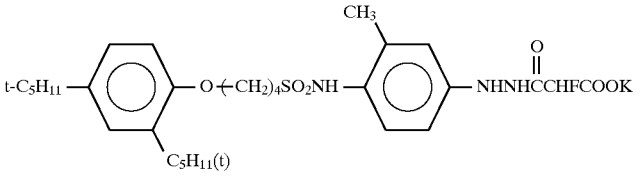
4-6.
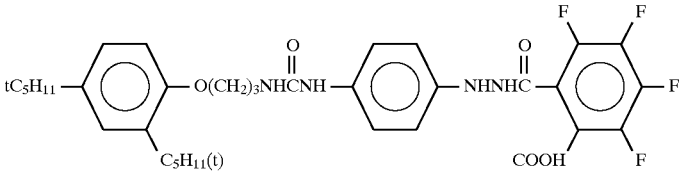
4-7.
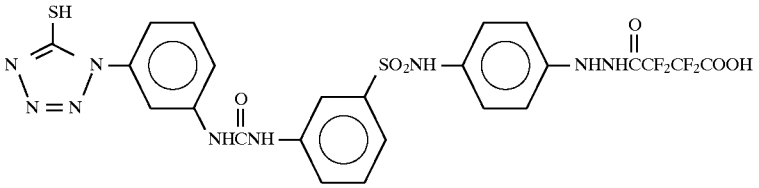
4-8.
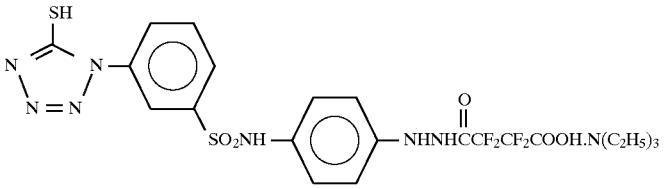
4-9.
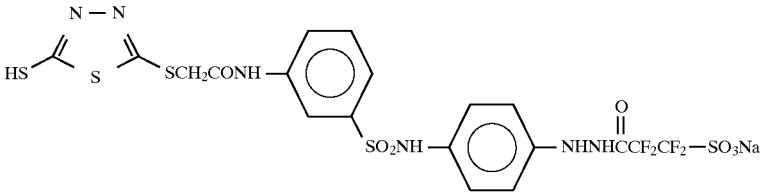
4-10.
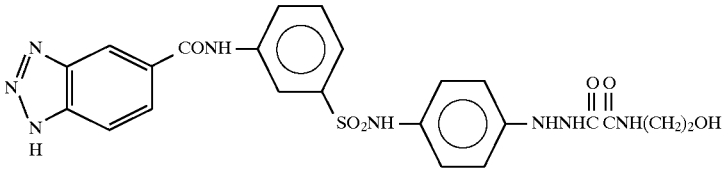
4-11.
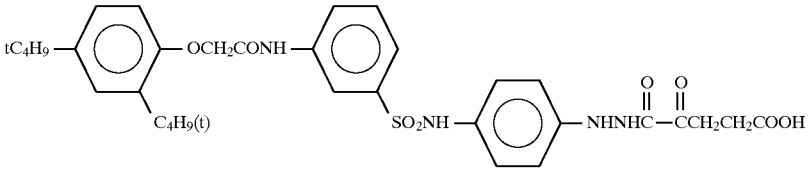
4-12.
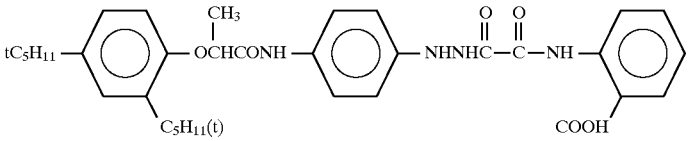

-continued
4-13.
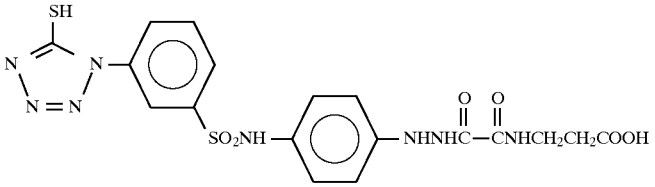
4-14.
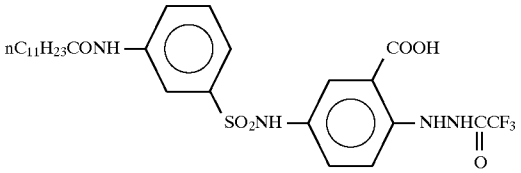
4-15.
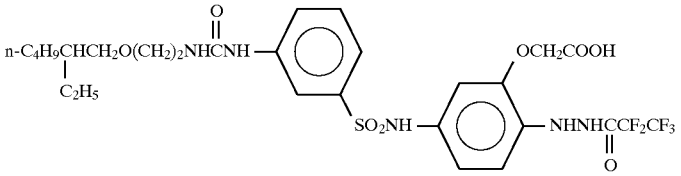
4-16.
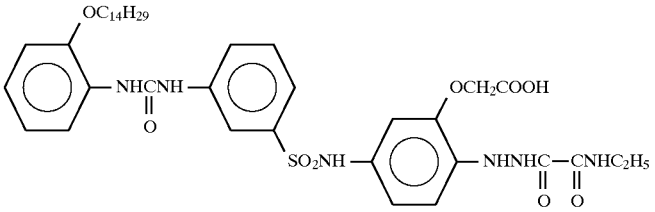
4-17.
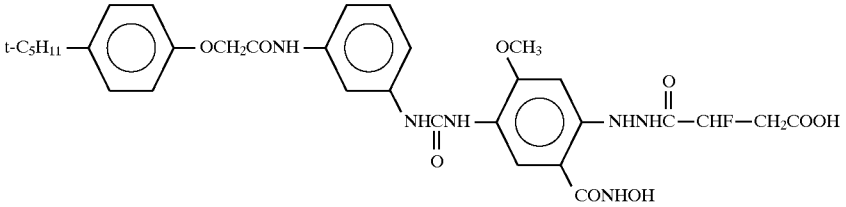
4-18.
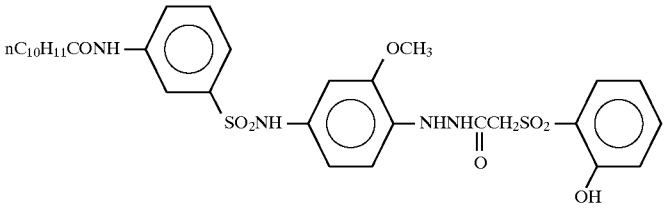
4-19.
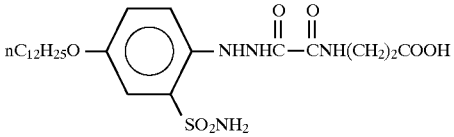

-continued
4-20.
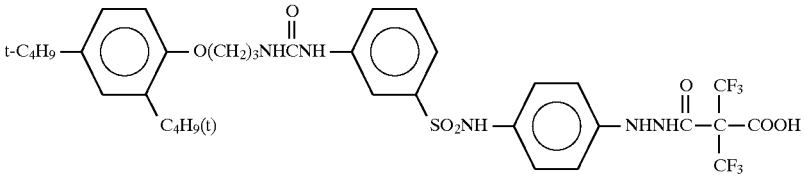
4-21.
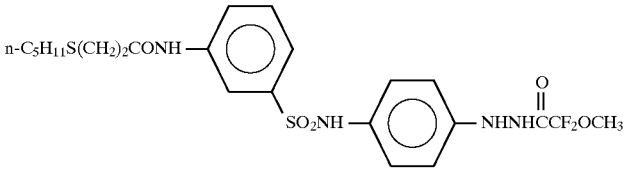
4-22.
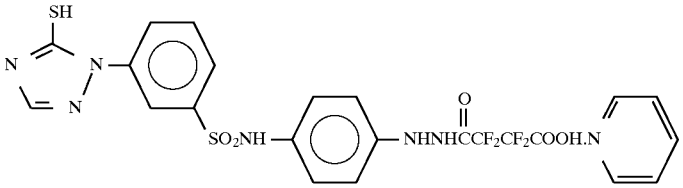
4-23.
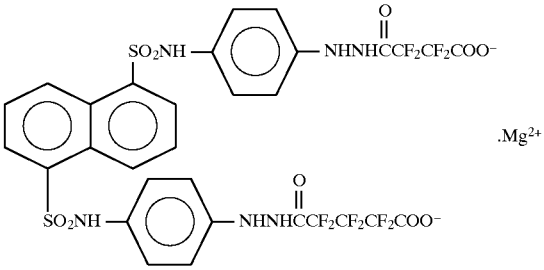
4-24.
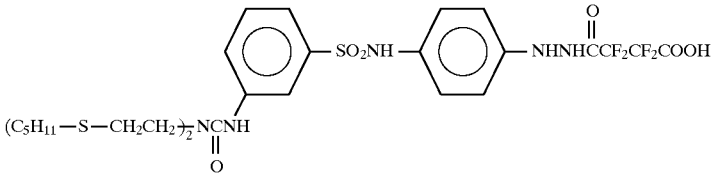
4-25.
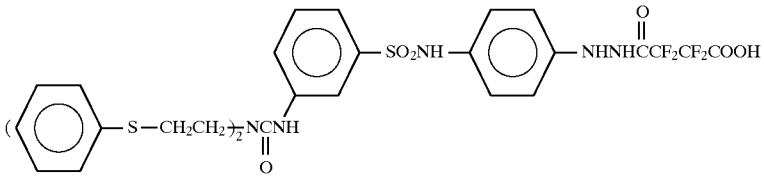
4-26.
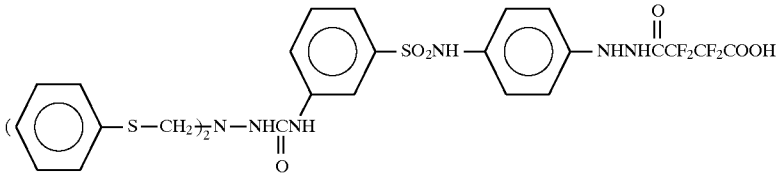

-continued 4-27.

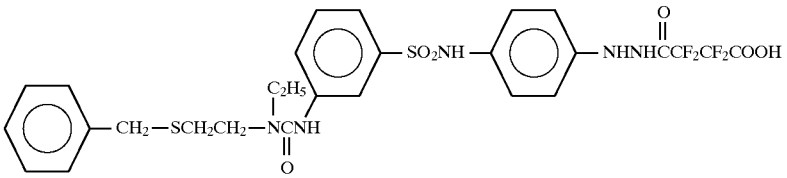

4-28.

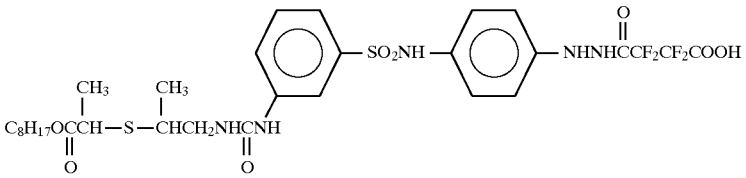

4-29.

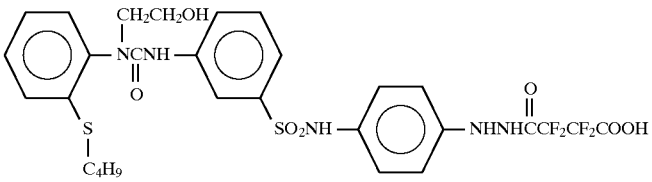

4-30.

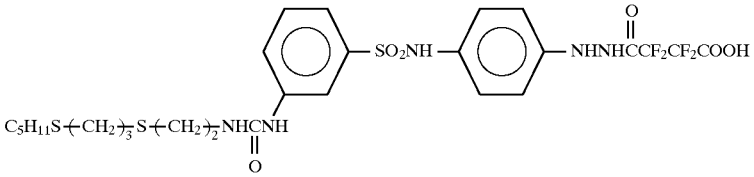

Examples of the hydrazine derivative which can be used in the present invention besides those described above include those described in Research Disclosure Item 23516 (November 1983, page 346) and references cited herein, U.S. Pat. Nos. 4,080,207, 4,269,929, 4,276,364, 4,278,748, 4,385,108, 4,459,347, 4,478,928, 4,560,638, 4,686,167, 4,912,016, 4,988,604, 4,994,365, 5,041,355, and 5,104,769, British Patent 2,011,391B, EP 217,310, EP 301,799, EP 356,898, JP-A-60-179734, JP-A-61-170733, JP-A-61-270744, JP-A-62-178246, JP-A-62-270948, JP-A-63-32538, JP-A-63-104047, JP-A-63-121838, JP-A-63-129337, JP-A-63-223744, JP-A-234244, JP-A-63-234245, JP-A-63-234246, JP-A-63-294552, JP-A-63-306438, JP-A-64-10233, JP-A-1-90439, JP-A-1-100530, JP-A-1-105941, JP-A-1-105943, JP-A-1-276128, JP-A-1-280747, JP-A-1-283548, JP-A-1-283549, JP-A-1-285940, JP-A-2-2541, JP-A-2-77057, JP-A-2-139538, JP-A-2-196234, JP-A-2-196235, JP-A-2-198440, JP-A-2-198441, JP-A-2-198442, JP-A-2-220042, JP-A-2-221953, JP-A-2-221954, JP-A-2-285342, JP-A-2-285343, JP-A-2-289843, JP-A-2-302750, JP-A-2-304550, JP-A-3-37642, JP-A-3-54549, JP-A-3-125134, JP-A-3-184039, JP-A-3-240036, JP-A-3-240037, JP-A-3-259240, JP-A-3-280038, JP-A-3-282536, JP-A-4-51143, JP-A-4-56842, JP-A-4-84134, JP-A-2-230233, JP-A-4-96053, JP-A-4-216544, JP-A-5-45761, JP-A-5-45762, JP-A-5-45763, JP-A-5-45764, JP-A-5-45765, and JP-A-6-289524.

The hydrazine nucleating agent of the present invention may be used in the form of solution in an appropriate water-miscible organic solvent such as an alcohol (e.g., methanol, ethanol, propanol, fluorinated alcohol), ketone (e.g., acetone, methyl ethyl ketone), dimethylformamide, dimethylsulfoxide, methyl cellosolve, etc.

A well known emulsion dispersion method can be used to dissolve the compound in an oil such as dibutyl phthalate, tricresyl phosphate, glyceryl triacetate and diethyl phthalate or an auxiliary solvent such as ethyl acetate and cyclohexanone and mechanically prepare an emulsion dispersion. Alternatively, a method known as solid dispersion method can be used to disperse powdered hydrazine derivative in water by means of a ball mill or colloid mill or by an ultrasonic apparatus.

The hydrazine compound can be incorporated in the emulsion layer and/or other hydrophilic colloidal layers. Examples of the other hydrophilic colloidal layers include a protective layer, a layer provided interposed between an emulsion layer and a support, and an interlayer. It is preferred that the hydrazine compound is incorporated in a silver halide emulsion layer or hydrophilic colloidal layer adjacent thereto.

In the first embodiment of the present invention, the amount of the hydrazine compound is preferably from $1\times10^{-6}$ to $1\times10^{-2}$ mol, more preferably from $1\times10^{-5}$ to $5\times10^{-3}$ mol, most preferably from $5\times10^{-5}$ to $1\times10^{-3}$ mol per mol of silver halide.

In the second embodiment of the present invention, the amount of the hydrazine compound is preferably from $1\times10^{-6}$ to $5\times10^{-2}$ mol, more preferably from $1\times10^{-5}$ to $2\times10^{-2}$ mol per mol of silver halide.

The silver halide photographic material which can be used according to the second embodiment comprises a nucleation accelerator selected from the group consisting of an amine derivative, an onium derivative, a disulfide derivative and a hydroxymethyl derivative, which is incorporated in at least one layer of the silver halide emulsion layer and other hydrophilic colloidal layers.

The nucleation accelerator may be used singly or in combination.

Examples of the amine derivative include compounds disclosed in JP-A-60-140340, JP-A-62-50829, JP-A-62-222241, JP-A-62-250439, JP-A-62-280733, JP-A-63-124045, JP-A-63-133145, and JP-A-63-286840. Preferred examples of the amine derivative include a compound having a group which adsorbs to silver halide as disclosed in JP-A-63-124045, JP-A-63-133145, and JP-A-63-286840, and compounds having 20 or more carbon atoms in all as disclosed in JP-A-62-222241.

The onium salt is preferably an ammonium salt or a phosphonium salt, which includes the phosphonium compounds of formula (1). Preferred examples of the ammonium salt include compounds described in JP-A-62-250439 and JP-A-62-280733. Preferred examples of the phosphonium salt include compounds described in JP-A-61-167939 and JP-A-62-280733.

Examples of the disulfide derivative include compounds described in JP-A-61-198147.

Examples of the hydroxymethyl derivative include compounds described in U.S. Pat. Nos. 4,693,956 and 4,777,118, EP 231850, and JP-A-62-50829. Preferred examples of the hydroxymethyl derivative include diarylmethanol derivative.

Specific examples of the nucleation accelerator will be given below, but the present invention should not be construed as being limited thereto.

A-1

$$(n)C_4H_9-\overset{C_2H_5}{\overset{|}{N}}-C_2H_5OH$$

A-2

$$(n)C_8H_{17}-\overset{CH_3}{\overset{|}{N}}-C_2H_5OH$$

A-3

$$((n)C_4H_9)_2-N-(C_2H_4O)_4H$$

A-4

$$(n)C_8H_{17}-\overset{C_2H_5}{\overset{|}{N}}-(C_2H_4O)_5H$$

A-5

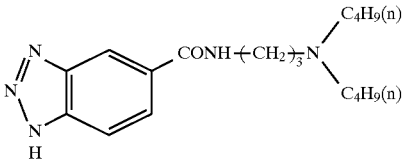

A-6

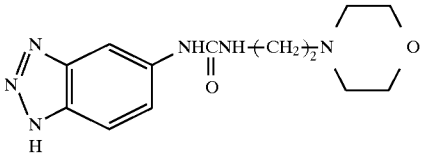

A-7

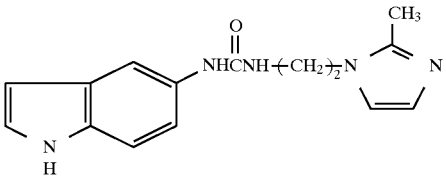

-continued

A-8

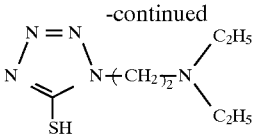

A-9

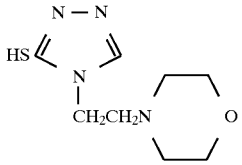

A-10

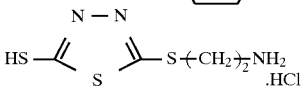

A-11

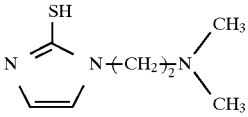

A-12

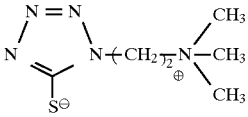

A-13

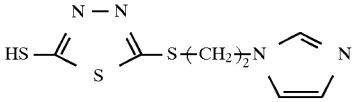

A-14

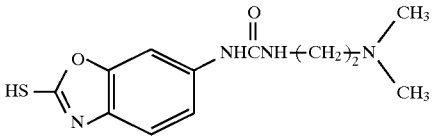

A-15

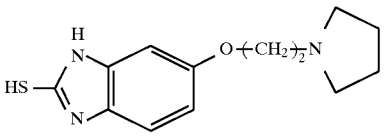

A-16

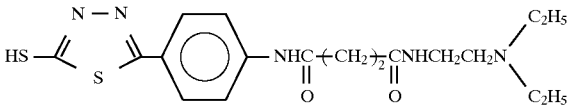

A-17

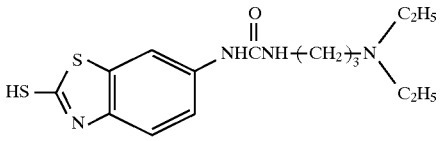

A-18

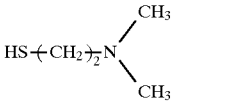

A-19

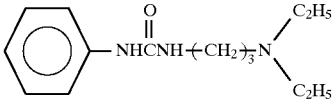

A-20

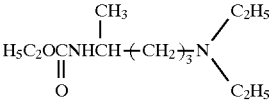

-continued
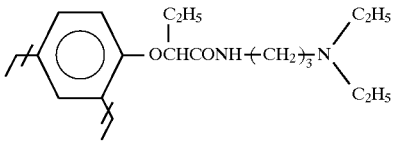
A-21
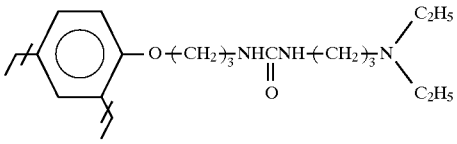
A-22
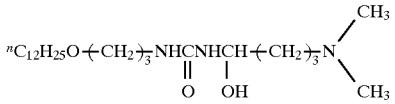
A-23
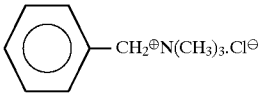
A-24
$^{n}C_{16}H_{33}\overset{\oplus}{N}(CH_3)_3.Br^{\ominus}$
A-25
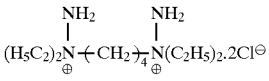
A-26
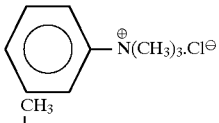
A-27
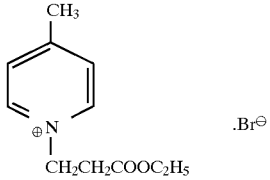
A-28
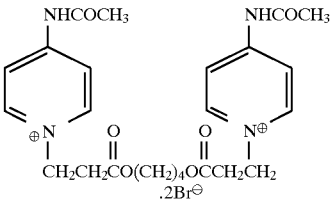
A-29
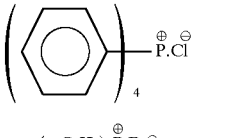
A-30
$(n\text{-}C_4H_9)_4\overset{\oplus}{P}.Br^{\ominus}$
A-31
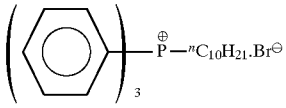
A-32
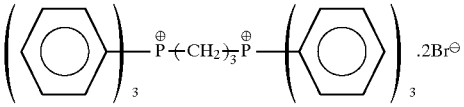
A-33
$^{n}C_4H_9-S-S-^{n}C_4H_9$
A-34
-continued
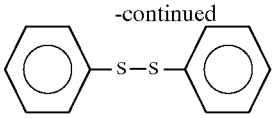
A-35
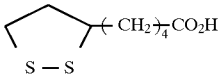
A-36
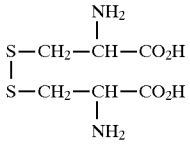
A-37
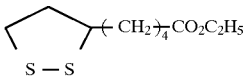
A-38
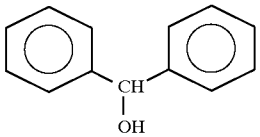
A-39
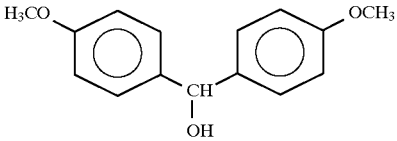
A-40
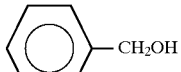
A-41
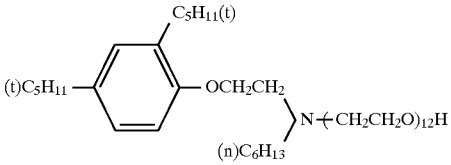
A-42
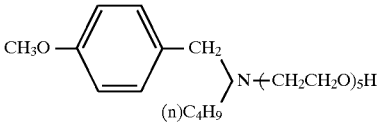
A-43
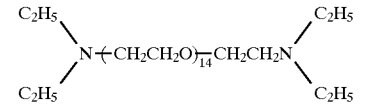
A-44
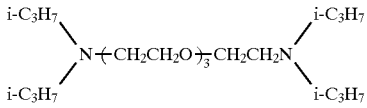
A-45
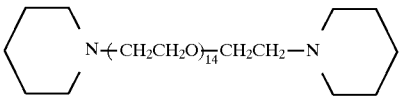
A-46
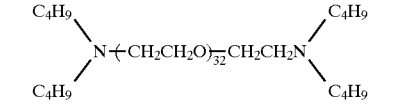
A-47
The optimum amount of the nucleation accelerator to be added depends on its kind but is normally from $1.0\times10^{-2}$ to $1.0\times10^{2}$ mol, preferably from $1.0\times10^{-1}$ to $1.0\times10$ mol per mol of the hydrazine compound.

The foregoing compound may be incorporated in the coating solution in the form of solution in an appropriate solvent such as water, alcohol (e.g., methanol, ethanol), acetone, dimethylformamide and methyl cellosolve.

The halogen composition of the silver halide emulsion to be used according to the first embodiment is not specifically limited. It can be properly selected from the group consisting of silver chloride, silver bromochloride, silver bromochloroiodide and silver bromoiodide. The silver chloride content of the silver halide emulsion is preferably not less than 50 mol %. The average grain size of silver halide grains in the photographic emulsion is preferably not more than 0.5 $\mu$m, more preferably from 0.1 to 0.4 $\mu$m. The silver halide grains may have a relatively wide grain size distribution but preferably have a narrow grain size distribution. In particular, the size of silver halide grains which account for 90% of the total grains by weight or number is preferably within±40% from the average grain size. (Such an emulsion is generally termed monodisperse emulsion.) The emulsion of the present invention is preferably a monodisperse emulsion having a grain size variation coefficient of not more than 20%, particularly not more than 15%. The silver halide grains in the photographic emulsion may have a regular crystal form such as cube and octahedron or an irregular crystal form such as sphere. Alternatively, tabular silver halide grains having a high aspect ratio as described in Research Disclosure 22534 (January 1983) may be used. Silver halide grains having a composite of these crystal forms may be used. The silver halide grains may have the inside and surface which are composed of an uniform layer or different layers. Further, two or more different silver halide emulsions which have been separately formed, e.g., internal latent image type silver halide emulsion and surface latent image type emulsion as described in JP-B-41-2068 may be used in admixture.

The silver halide emulsion to be incorporated in the silver halide photographic material according to the second embodiment may comprise a mixed silver halide such as silver bromochloride, silver bromoiodide and silver bromochloroiodide besides silver chloride and silver bromide. In particular, silver bromochloride or silver bromochloroiodide having a silver chloride content of not less than 50 mol % is preferred. The silver iodide content in the silver halide emulsion is preferably not more than 3 mol %, more preferably not more than 0.5 mol %. The crystal form of silver halide grains is any of cube, tetradecahedron, octahedron, amorphous form and tablet, preferably cube. The average grain diameter of silver halide grains is preferably from 0.01 $\mu$m to 0.7 $\mu$m, more preferably from 0.05 $\mu$m to 0.5 $\mu$m. The grain diameter distribution preferably has a variation coefficient of not more than 15%, more preferably not more than 10% as represented by {(standard deviation of grain diameters)/(average grain diameter)}× 100. The silver halide grains may have the inside and surface which are composed of an uniform layer or different layers.

The preparation of the silver halide emulsion to be used in the first and second embodiments of the present invention can be accomplished by any method known in the field of silver halide photographic material. Such a method is described in P. Glafkides, "Chimie et Physique Photographiqu", Paul Montel, 1967, G. F. Duffin, "Photographic Emulsion Chemistry", The Focal Press, 1966, and V. L. Zelikman et al., "Making and Coating Photographic Emulsion", The Focal Press, 1964.

The reaction of the water-soluble silver salt (aqueous solution of silver nitrate) with the water-soluble halogen salt may be accomplished by the single jet process, double jet process or combination thereof. As one of double jet processes there may be employed a method in which the pAg value of the liquid phase in which silver halide grains are formed is kept constant, i.e., so-called controlled double jet process. Further, the formation of silver halide grains is preferably effected with a silver halide solvent such as ammonia, thioether and 4-substituted thiourea. More preferably, 4-substituted thiourea compounds are used. These compounds are described in JP-A-53-82408 and 55-77737. Preferred examples of thiourea compounds are tetramethylthiourea and 1,3-dimethyl-2-imidazolidinethione. The controlled double jet process with a silver halide solvent facilitates the formation of a silver halide emulsion having a regular crystal form and a narrow grain size distribution. Thus, this process is useful for the preparation of the silver halide emulsion to be used in the present invention.

In order to obtain a uniform grain size, a method as described in British Patent 1,535,016, JP-B-48-36890 and JP-B-52-16364 which comprises changing the addition rate of silver nitrate or alkali halide according to the rate of grain formation or a method as described in British Patent 4,242,445 and JP-A-55-158124 which comprises changing the concentration of aqueous solution is preferably used to provide a rapid grain formation under the critical saturation point.

In both embodiments of the present invention, a photographic light-sensitive material suitable for high intensity exposure such as scanner exposure and a photographic light-sensitive material for line picture taking can comprise a rhodium compound incorporated therein to accomplish a high contrast and a low fog.

As the rhodium compound to be used in the present invention there may be used a water-soluble rhodium compound. Examples of such a water-soluble rhodium compound include halogenated rhodium (III) compounds, and rhodium complexes having halogen, amines, oxalate, etc. as ligands, such as hexachlororhodium (III) complex, hexabromorhodium (III) complex, hexaamminerhodium (III) complex and trioxalaterhodium (III) complex. These rhodium compounds may be dissolved in water or a proper solvent before use. In order to stabilize the rhodium compound solution, a commonly used method may be used, i.e., the addition of aqueous solution of halogenated hydrogen (e.g., hydrochloric acid, bromic acid, fluoric acid) or halogenated alkali (e.g., KCl, NaCl, KBr, NaBr). Instead of using such a water-soluble rhodium, silver halide grains which have been previously doped with rhodium may be added and dissolved in the system during the preparation of silver halide.

The amount of the rhodium compound to be incorporated is normally from $1\times10^{-8}$ to $5\times10^{-6}$ mol, preferably from $5\times10^{-8}$ to $1\times10^{-6}$ mol per mol of silver in the silver halide emulsion.

In both embodiments of the present invention, a photographic light-sensitive material suitable for high intensity exposure such as scanner exposure and a photographic light-sensitive material for line picture taking can comprise an iridium compound incorporated therein to accomplish a high contrast and a low fog.

As the iridium compound there may be used any iridium compound. Examples of such an iridium compound include hexachloroiridium, hexaamineiridium, trioxalateiridium, and hexacyanoiridium. These iridium compounds may be dissolved in water or a proper solvent before use. In order to stabilize the iridium compound solution, a commonly used method may be used, i.e., the addition of aqueous solution of halogenated hydrogen (e.g., hydrochloric acid, bromic acid, fluoric acid) or halogenated alkali (e.g., KCl, NaCl, KBr, NaBr). Instead of using such a water-soluble iridium, silver halide grains which have been previously doped with iridium may be added and dissolved in the system during the preparation of silver halide.

The total amount of the iridium compound to be added is preferably in the range of $1\times10^{-8}$ to $5\times10^{-6}$ mol, more preferably $5\times10^{-8}$ to $1\times10^{-6}$ mol per mol of silver halide eventually formed.

The addition of these compounds may be properly effected at various steps during the preparation of the silver halide emulsion grains and before the coating of the emulsion. In particular, these compounds are preferably added during the preparation of the emulsion so that they are incorporated in the silver halide grains.

The photographic emulsion to be used in the present invention can be prepared by a method described in P. Glafkides, "Chimie et Physique Photographique", Paul Montel, 1967, G. F. Duffin, "Photographic Emulsion Chemistry", The Focal Press, 1966, and V. L. Zelikman et al., "Making and Coating Photographic Emulsion", The Focal Press, 1964.

The silver halide grains to be used in the present invention may comprise a metal atom such as iron, cobalt, nickel, ruthenium, palladium, platinum, gold, thallium, copper, lead and osmium incorporated therein. The amount of the foregoing metal to be incorporated is preferably from $1\times10^{-9}$ to $1\times10^{-4}$ mol per mol of silver halide. The foregoing metal may be incorporated in the silver halide grains in the form of salt such as single salt, double salt and complex salt during the preparation of grains.

The reaction of the soluble silver salt with the soluble halogen salt may be accomplished by the single jet process, double jet process or combination thereof.

It may also be accomplished by a method in which grains are formed in excess silver ions (so-called reverse mixing method). As one of double jet processes there may be employed a method in which the pAg value of the liquid phase in which silver halide grains are formed is kept constant, i.e., so-called controlled double jet process. Further, the formation of silver halide grains is preferably effected with a silver halide solvent such as ammonia, thioether and 4-substituted thiourea. More preferably, 4-substituted thiourea compounds are used. These compounds are described in JP-A-53-82408 and 55-77737. Preferred examples of thiourea compounds are tetramethylthiourea and 1,3-dimethyl-2-imidazolidinethione.

The controlled double jet process with a silver halide solvent facilitates the formation of a silver halide emulsion having a regular crystal form and a narrow grain size distribution. Thus, this process is useful for the preparation of the silver halide emulsion to be used in the present invention.

In order to obtain a uniform grain size, a method as described in British Patent 1,535,016, JP-B-48-36890 and JP-B-52-16364 which comprises changing the addition rate of silver nitrate or alkali halide according to the rate of grain formation or a method as described in British Patent 4,242,445 and JP-A-55-158124 which comprises changing the concentration of aqueous solution is preferably used to provide a rapid grain formation under the critical saturation point.

The silver halide emulsion of the present invention is preferably subjected to chemical sensitization. Any known chemical sensitization methods such as sulfur sensitization, selenium sensitization, tellurium sensitization, and noble metal sensitization may be used singly or in combination. If these methods are employed in combination, preferred examples of combination include combination of sulfur sensitization and gold sensitization, combination of sulfur sensitization, selenium sensitization and gold sensitization, and combination of sulfur sensitization, tellurium sensitization and gold sensitization.

The sulfur sensitization to be used in the present invention is normally carried out by stirring the emulsion with a sulfur sensitizer at a temperature as high as not lower than 40° C. for a predetermined period of time. As the sulfur sensitizer there may be used a known compound. For example, besides sulfur compounds contained in gelatin, various sulfur compounds such as thiosulfate, thiourea, thiazole and rhodanine can be used. Preferred among these sulfur compounds are thiosulfate and thiourea. The amount of the sulfur sensitizer to be incorporated varies with various conditions such as pH, temperature and size of silver halide grains during chemical ripening but is preferably from $10^{-7}$ to $10^{-2}$ mol, more preferably from $10^{-5}$ to $10^{-3}$ mol per mol of silver halide.

As selenium sensitizers to be used in the present invention there may be used a known selenium compound. In particular, an instable selenium compound and/or stable selenium compound may be normally added to the emulsion which is then stirred at a temperature as high as 40 ° C. or higher for a predetermined period of time. As such an instable selenium compound there may be preferably used one described in JP-B-44-15748, JP-B-43-13489, Japanese Patent Application Nos. 2-13097, 2-229300 and 3-121798. In particular, compounds represented by the general formulae (VIII) and (IX) described in Japanese Patent Application No. 3-121798 are preferred.

The tellurium sensitizer to be used in the present invention is a compound which produces on the surface of or inside the silver halide grains silver telluride that possibly becomes sensitizing nuclei. The rate of production of silver telluride in the silver halide emulsion can be examined by a method described in JP-A-5-313284.

In some detail, compounds described in U.S. Pat. Nos. 1,623,499, 3,320,069, and 3,772,031, British Patents 235,211, 1,121,496, 1,295,462, and 1,396,696, Canadian Patent 800,958, Japanese Patent Application Nos. 2-333819, 3-53693, 3-131598, and 4-129787, "Journal of Chemical Society Chemical Communication", 635, 1980, ibid 1102 (1979), ibid 645 (1979), and "Journal of Chemical Society Perkin Transaction", 1, 2191 (1980), and S. Patai, "The Chemistry of Organic Selenium and Tellurium Compounds", Vol. 1, 1986, and Vol. 2, 1987 may be used. In particular, compounds represented by the general formulae (II), (III) and (IV) described in JP-A-5-313284 are preferred.

The amount of the selenium and tellurium sensitizers of the present invention to be used varies with the kind of the silver halide grains used and the chemical ripening conditions but is normally from $10^{-8}$ to $10^{-2}$ mol, preferably from $10^{-7}$ to $10^{-3}$ mol per mol of silver halide. The chemical sensitization conditions used herein are not specifically limited. In the present invention, the chemical sensitization is effected at pH of from 5 to 8, pAg of from 6 to 11, preferably from 7 to 10, and a temperature of from 40° C. to 95° C., preferably from 45° C. to 85° C.

Examples of the noble metal sensitizer employable herein include gold, platinum, palladium, and iridium. Particularly preferred among these noble metal sensitizers is a gold sensitizer. Specific examples of gold sensitizer employable herein include chloroauric acid, potassium chlorate, potassium aurithiocyanate, and gold sulfide. The amount of the gold sensitizer to be used is preferably from $10^{-7}$ to $10^{-2}$ mol per mol of silver halide.

The silver halide emulsion to be used in the present invention may comprise a cadmium salt, sulfite, lead salt, thallium salt or the like incorporated therein during the formation or physical ripening of silver halide grains.

In the present invention, a reduction sensitizer may be used. As such a reduction sensitizer there may be used a stannous salt, amine, formamidinesulfinic acid, silane compound or the like.

The silver halide emulsion of the present invention may comprise a thiosulfonic acid compound incorporated therein in a manner as described in EP 293,917.

The photographic light-sensitive material of the present invention may comprise a single silver halide emulsion or two or more silver halide emulsions (e.g., those having different average grain sizes, halogen compositions, crystal habits or those obtained under different chemical sensitization conditions) in combination.

In the present invention, the silver halide emulsion particularly useful as a photographic light-sensitive material for contact work is a silver halide emulsion comprising silver chloride in a proportion of not less than 90 mol %, preferably not less than 95 mol %, more preferably silver bromochloride or silver bromochloroiodide having a silver bromide content of from 0 to 10 mol %. If the proportion of silver bromide or silver iodide rises, the safety to safelight in a bright room or γ is deteriorated.

A contact film or contact paper which can be handled under bright room light is generally called a bright room light photographic material for contact work. Such a photographic light-sensitive material preferably comprises a silver chloride emulsion incorporated therein.

The silver halide emulsion to be incorporated in the photographic light-sensitive material for contact work of the present invention preferably comprises a transition metal complex incorporated therein. Examples of such a transition metal include Rh, Ru, Re, Os, Ir, and Cr.

Examples of ligands in the transition metal complex include nitrosyl or thionitrosyl crosslinking ligand, halide ligand (e.g., fluoride, chloride, bromide, iodide), cyanide ligand, cyanate ligand, thiocyanate ligand, selenocyanate ligand, tellurocyanate ligand, acid ligand, and aquo ligand. If any aquo ligand is present, it preferably accounts for one or two of ligands.

In some detail, rhodium atom may be incorporated in the silver halide in the form of metal salt such as single salt and complex salt during the preparation of grains.

Examples of such a rhodium salt include rhodium monochloride, rhodium dichloride, rhodium trichloride, and ammonium hexachlororhodium. Preferred examples of these rhodium salts include water-soluble trivalent halogen complex compound of rhodium, e.g., hexachlororhodiumic acid (III) or salt thereof with ammonium, sodium, potassium, etc.

The amount of such a water-soluble rhodium salt to be incorporated is from $1.0\times10^{-6}$ to $1.0\times10^{-3}$ mol, preferably from $1.0\times10^{-5}$ to $1.0\times10^{-3}$, particularly from $5.0\times10^{-5}$ to $5.0\times10^{-4}$ mol per mol of silver halide.

Further examples of transition metal complexes employable herein will be given below.

1. $[Ru(NO)Cl_5]^{2}$
2. $[Ru(NO)_2Cl_4]^{-1}$
3. $[Ru(NO)(H_2O)Cl_4]^{-1}$
4. $[Ru(NO)Cl_5]^{-2}$
5. $[Rh(NO)Cl_5]^{-2}$
6. $[Re(NO)CN_5]^{-2}$
7. $[Re(NO)ClCN_4]^{-2}$
8. $[Rh(NO)_2Cl_4]^{-1}$
9. $[Rh(NO)(H_2O)C_4]^{-1}$
10. $[Ru(NO)CN_5]^{-2}$
11. $[Ru(NO)Br_5]^{-2}$
12. $[Rh(NS)Cl_5]^{-2}$
13. $[Os(NO)Cl_5]^{-2}$
14. $[Cr(NO)Cl_5]^{-3}$
15. $[Re(NO)Cl_5]^{-1}$
16. $[Os(NS)Cl_4(TeCN)]^{-2}$
17. $[Ru(NS)l_5]^{-2}$
18. $[Re(NS)Cl_4(SeCN)]^{-2}$
19. $[Os(NS)Cl(SCN)_4]^{-2}$
20. $[Ir(NO)Cl_5]^{-2}$

The spectral sensitizing dye to be used in the present invention is not specifically limited.

The amount of the sensitizing dye varies with the shape and size of the silver halide grains but is normally from $4\times10^{-6}$ to $8\times10^{-3}$ mol per mol of silver halide. For example, if the size of silver halide grains is from 0.2 to 1.3 μm, the amount of the sensitizing dye to be incorporated is preferably from $2\times10^{-7}$ to $3.5\times10^{-6}$ mol, particularly from $6.5\times10^{-7}$ to $2.0\times10^{-6}$ mol per $m^2$ surface area of silver halide grains.

The photographic silver halide emulsion of the present invention may be spectrally sensitized with a sensitizing dye to a relatively long wavelength range, e.g., blue, green, red or infrared range. Examples of such a sensitizing dye employable herein include cyanine dye, melocyanine dye, complex cyanine dye, complex melocyanine dye, holopolar cyanine dye, styryl dye, hemicyanine dye, oxonol dye, and hemioxonol dye.

Examples of useful sensitizing dyes which can be used in the present invention are described in Research Disclosure Item 17643, IV-A, December 1978, page 23, Item 1831, X, August 1978, page 437, and references cited therein.

In particular, sensitizing dyes having a spectral sensitivity suitable for the spectral characteristics of various scanner light sources can be advantageously selected.

For example, for argon laser source, simple melocyanines as described in JP-A-60-162247, JP-A-2-48653, U.S. Pat. No. 2,161,331, West German Patent 936,071 and Japanese Patent Application No. 3-189532 can be advantageously selected. For helium-neon laser source, trinuclear cyanine dyes as described in JP-A-50-62425, JP-A-54-18726, and JP-A-59-102229 can be advantageously selected. For LED source and red semiconductor laser source, thiacarbocyanines as described in JP-B-48-42172, JP-B-51-9609, JP-B-55-39818, JP-A-62-284343, and JP-A-2-105135 can be advantageously selected. For infrared semiconductor laser source, tricarboncyanines as described in JP-A-59-191032 and JP-A-60-80841 and dicarbocyanines containing 4-quinoline nucleus of the general formulae (IIIa) and (IIIb) as described in JP-A-59-192242 and JP-A-3-67242 can be advantageously selected.

These sensitizing dyes may be used singly or in combination. In particular, a combination of sensitizing dyes is often used for the purpose of supersensitization. In combination with the sensitizing dye, a dye which does not exhibit a spectral sensitizing effect itself or a substance which does not substantially absorb visible light but exhibits a supersensitizing effect can be incorporated in the emulsion.

Useful sensitizing dyes, combinations of supersensitizing dyes, and supersensitizing substances are described in Research Disclosure Vol. 176, 17643, December 1978, page 23, IV-J.

For helium-neon light source, sensitizing dyes represented by the general formula (I) as described from line 1 from the bottom of page 8 to line 4 on page 13 in Japanese Patent Application No. 4-228745 are particularly preferred besides those described above. Further, sensitizing dyes represented by the general formula (I) described in Japanese Patent Application No. 6-103272 can be preferably used.

For white light source for picture taking, sensitizing dyes represented by the general formula (IV) described in Japanese Patent Application No. 5-201254 can be preferably used.

Further examples of sensitizing dyes which can used in the present invention will be given below.

SO-1) 1-(2-Diethylaminoethyl)-5-[(ethylnaphtho[2,1-d]oxazoline-2-iridene)ethylidene]-3-(pyridine-2-yl)-2-thiohydantoin SO-2) 1-(2-Diethylaminoethyl)-3-(pyridine-4-yl)-5-[3-ethyl-2-benzooxazolinidene)ethylidene]-2-thiohydantoin SO-3) 1-(2-Hydroxyethyl)-3-(4-sulfobutyl-pyridine-2-yl)-5-[(3-sulfopropyl-2-benzooxazolinidene)ethylidene]-2-thiohydantoin sodium salt SO-4) 1-(2-Acetylbutyl)-3-(pyridine-2-yl)-5-[(3-sulfodiethyl-2-benzooxazolinidene)ethylidene]-2-thiohydantoin sodium salt SO-5) 1-(2-Hydroxyethyl-3-pyridine-2-yl)-5-[(3-sulfopropyl-2 -benzooxazolinidene)ethylidene]-2-thiohydantoin sodium salt SO-6) 1-(2,3-dihydroxypropyl)-3-(pyridine-2-yl)-5-[(3-sulfoamideethyl-2-benzooxazolinidene)ethylidene]-2-thiohydantoin sodium salt SO-7) 1-(2-Hydroxyethoxyethyl)-3-(pyridine-2-yl)-5-[(3-sulfobutyl-5-chloro-2-benzooxazolinidene)ethylidene]-2-thiohydantoin sodium salt SO-8) 1-(2-Hydroxyethoxyethoxyethyl)-3-(pyridine-2-yl)-5-[(3-sulfobutyl-5-chloro-2-benzooxazolinidene) ethylidene ]-2-thiohydantoin sodium salt SO-9) l-(2-Hydroxyethylaminoethyl)-3-(4-chloropyridine-2-yl)-5-[(3-sulfobutyl-5-methyl-2-benzooxazolinidene) ethylidene]-2-thiohydantoin sodium salt SO-10) 1-(2-Hydroxyethoxyethyl)-3-(p-ethoxypyridine-2-yl-5-[(3-sulfobutylnaphtho[2,1-d]oxazoline-2-ilidene) ethylidene]-2-thiohydantoin sodium salt SO-11) 1-(2-Carbamideethyl)-3-(4-methylpyridine-3-yl)-5-[(3-sulfobutylnaphtho[2,1-d]oxazoline-2-ilideneethylidene]-2-thiohydantoin sodium salt The sensitizing dye to be used in the present invention may be incorporated in the silver halide emulsion in the form of aqueous solution or solution in an organic solvent miscible with water such as methanol, ethanol, propyl alcohol, methyl cellosolve and pyridine.

The sensitizing dye to be used in the present invention may be dissolved in a solvent by an ultrasonic vibration method as described in U.S. Pat. No. 3,485,634. Other examples of the method for dissolving or dispersing the sensitizing dye of the present invention in a solvent before being incorporated in the emulsion include those described in U.S. Pat. Nos. 3,482,981, 3,585,195, 3,469,987, 3,425,835, and 3,342,605, British Patents 1,271,329, 1,038,029, and 1,121,174, U.S. Pat. Nos. 3,660,101, and 3,658,546.

The time at which the sensitizing dye of the present invention is incorporated in the emulsion is normally before the application of the emulsion to an appropriate support but may be during the chemical ripening step or the formation of silver halide grains.

The amount of the sensitizing dye of the present invention to be incorporated is preferably from $10^{-6}$ to $10^{-1}$ mol, more preferably from $10^{-4}$ to $10^{-2}$ mol per mol of silver.

These sensitizing dyes may be used singly or in combination. In particular, a combination of sensitizing dyes is often used for the purpose of supersensitization.

Combinations of supersensitizing dyes, and supersensitizing substances are described in Research Disclosure Vol. 176, 17643, December 1978, page 23, IV-J.

The silver halide photographic material according to the present invention may comprise a water-soluble dye incorporated in the hydrophilic colloidal layer as a filter dye or anti-irradiation dye or for other various purposes. Examples of such a water-soluble dye include oxonol dye, hemioxonol dye, styryl dye, melocyanine dye, cyanine dye, and azo dye, with oxonol dye, hemioxonol dye, and melocyanine dye being preferred. Specific examples of the dye employable herein include those described in West German Patent 616,007, British Patents 584,609, and 1,117,429, JP-B-26-7777, JP-B-39-22069, JP-B-54-38129, JP-A-48-85130, JP-A-49-99620, JP-A-49-114420, JP-A-49-129537, PB report 74175, and Photographic Abstract 128 ('21).

As a binder or protective colloid to be incorporated in the emulsion layer or interlayer in the photographic light-sensitive material of the present invention there may be advantageously used gelatin. Other hydrophilic colloids may be used. Examples of such hydrophilic colloids which can be used in the present invention include protein such as gelatin derivatives, graft polymer of gelatin with other high molecular compounds, albumine, and casein, saccharide derivative such as hydroxyethyl cellulose, carboxymethyl cellulose, cellulose ester sulfate, sodium alginate, and starch derivative, monopolymer or copolymer such as polyvinyl alcohol, polyvinyl alcohol partial acetal, poly-N-vinylpyrrolidone, polyacrylic acid, polymethacrylic acid, polyacrylamide, polyvinyl imidazole, and polyvinyl pyrazole, and other various synthetic hydrophilic high molecular compounds. As gelatin there may be used lime-treated gelatin as well as acid-treated gelatin or enzyme-treated gelatin as described in "Bulletin of the Society of Scientific Photographic Japan", No. 16, page 30, 1966. Further, a hydrolyzation product or enzymatic decomposition product of gelatin may be used.

The photographic emulsion to be used in the present invention may comprise various compounds for the purpose of inhibiting fogging during the preparation, storage or photographic processing of light-sensitive material or stabilizing photographic properties. In particular, there can be used many compounds known as fog inhibitors or stabilizers. Examples of these fog inhibitors or stabilizers include azoles such as benzothiazolium salt, nitroimidazoles, nitrobenzimidazoles, chlorobenzimidazoles, bromobenzimidazoles, mercaptothiazoles, mercaptobenzothiazoles, mercaptbenzimidazoles, mercaptothiadiazoles, aminotriazoles, benzotriazoles and nitrobenzotriazoles, mercaptotetrazoles (particularly 1-phenyl-5-mercaptotetrazole), mercaptopyrimidines, mercaptotriazoles, thioketo compounds such as oxazolinethione, azaindenes such as triazaindenes, tetraazaindenes (particularly 4-hydroxy-substituted (1,3,3a,7) tetraazaindenes), and pentaazaindenes, and benzenesulfonic acid amide. Particularly preferred among these compounds are benzotriazoles (e.g., 5-methyl-benzotriazole). These compounds may be incorporated in the processing solution.

The photographic light-sensitive material of the present invention may comprise an inorganic or organic film hardener incorporated in the photographic emulsion layer or other hydrophilic colloidal layers. For example, chromium salts (e.g., chrome alum, chromium acetate), aldehydes (e.g., formaldehyde, glyoxal, glutaraldehyde), N-methylol compounds (e.g., dimethylol urea, methyloldimethylhydantoin), dioxane derivatives (e.g., 2,3-dihydroxydioxane), active vinyl compounds (e.g., 1,3,5-triacryloyl-hexahydro-s-triazine), and mucohalogenic acids (e.g., mucochloric acid, mucophenoxychloric acid) may be used singly or in combination.

The photographic light-sensitive material prepared according to the present invention may comprise various surface active agents incorporated in the photographic emulsion layer or other hydrophilic colloidal layers for various purposes, e.g., aiding coating, inhibiting electrification, improving slipping property, emulsifying and dispersing, preventing adhesion, and improving photographic properties (e.g., acceleration of development, contrast increase, sensitization).

The photographic light-sensitive material to be used in the present invention may comprise a water-insoluble or sparingly water-soluble synthetic polymer dispersion incorporated in the photographic emulsion layer or other hydrophilic colloidal layers for the purpose of improving the dimensional stability thereof. For example, alkyl(meth) acrylate, alkoxyalkyl(meth)acrylate, glycidyl(meth)acrylate, (meth)acrylamide, vinylester (e.g., vinyl acetate), acrylonitrile, olefin, styrene, etc. may be used singly or in combination. Alternatively, polymers comprising as monomer components combinations of these compounds and acrylic acid, methacrylic acid, α,β-unsaturated dicarboxylic acid, hydroxylalkyl (meth)acrylate, sulfoalkyl (meth) acrylate, styrenesulfonic acid, etc. may be used.

Examples of the support to be incorporated in the photographic light-sensitive material of the present invention include flexible support such as paper laminated with α-olefin polymer (e.g., polyethylene, polypropylene, ethylene/butene copolymer) and synthetic paper, and metal. Particularly preferred among these materials is polyethylene terephthalate. Examples of the undercoating layer employable herein include an undercoating layer made of an organic solvent containing a polyhydroxybenzene ring as described in JP-A-49-3972, and aqueous latex undercoating layer as described in JP-A-49-11118 and JP-A-52-10491. The undercoating layer may be normally subjected to chemical or physical treatment. Examples of such chemical or physical treatment include surface activation treatment such as chemical treatment, mechanical treatment and corona discharge treatment.

The developer which can be used according to the first embodiment of the present invention is described below.

Examples of p-aminophenol auxiliary developing agent to be used according to the first embodiment include p-aminophenol, N-methyl-p-aminophenol, N-ethyl-p-aminophenol, N-propyl-p-aminophenol, N-(β-hydroxyethyl)-p-aminophenol, N-benzyl-p-aminophenol, N,N-dimethyl-p-aminophenol, N,N-diethyl-p-aminophenol, N,N-dipropyl-p-aminophenol, N,N-di(β-hydroxyethyl)-p-aminophenol, 2-methyl-N-methyl-p-aminophenol, N-(4'-hydroxyphenyl)pyrrolidine, 6-hydroxyl-1,2,3,4-tetrahydroquinoniline, and compounds as described in "The Theory of the Photographic Process", Vol. 4, pp. 311–315 (Developing Agents of the Type $HO—(CH{=}CH)_n—NH_2$). Preferred among these compounds are N-methyl-p-aminophenol, N-ethyl-p-aminophenol, and N-(β-hydroxyethyl)-p-aminophenol. Particularly preferred among these compounds is N-methyl-p-aminophenol.

The amount of the auxiliary developing agent to be incorporated is normally from 0.005 mol/l to 0.5 mol/l, preferably from 0.01 mol/l to 0.3 mol/l.

The term "substantially free of dihydroxybenzene" as used herein is meant to indicate that the concentration of dihydroxybenzene in the developer is insignificant in comparison with the amount of the compound of the general formula (II) or the foregoing auxiliary developing agent (e.g., not more than $5\times10^{-4}$ mol/l). The developer of the present invention preferably is free of dihydroxybenzene.

The developer of the present invention may comprise a sulfite such as sodium sulfite, potassium sulfite, lithium sulfite, sodium bisulfite, potassium metabisulfite and sodium formaldehydesulfite. Such a sulfite may be used in an amount of not less than 0.01 mol/l. However, if it is used in a large amount, such a sulfite can dissolve silver halide emulsion grains therein, causing silver stain. Further, it causes the rise in COD (chemical oxygen demand). Accordingly, the amount of such a sulfite to be added should not exceed the least required value.

The pH value of the developer to be used in the development process of the present invention is preferably from 8.7 to 10.0, more preferably from 9.0 to 9.8. If the pH value of the developer exceeds 10.0, the developing agent shows a remarkable deterioration with time. On the contrary, if the pH value of the developer falls below 8.7, a sufficient contrast cannot be obtained.

The replenishment rate of the developer of the present invention is preferably from 50 ml to 300 ml/$m^2$, more preferably from 75 ml to 200 ml/$m^2$ of developed area.

The replenishment rate of the fixing solution of the present invention is preferably from 120 ml to 350 ml/$m^2$, more preferably from 180 ml to 300 ml/$m^2$ of developed area.

Examples of the alkaline agent to be used in the adjustment of the pH value during the preparation of the developer of the present invention include sodium hydroxide, potassium hydroxide, sodium carbonate, and potassium carbonate. The developer of the present invention may comprise a pH buffer such as saccharides as described in JP-A-60-93433 (e.g., saccharose), oxims (e.g., acetoxim), phenols (e.g., 5-sulfosalicylic acid), silicate, sodium tertiary phosphate and potassium tertiary phosphate incorporated therein. The concentration of such a pH buffer is preferably not less than 0.3 mol/l.

The developer of the present invention may comprise a development inhibitor such as potassium bromide and potassium iodide, an organic solvent such as ethylene glycol, diethylene glycol, triethylene glycol, dimethylformamide, methyl cellosolve, hexylene glycol, ethanol and methanol, an indazole compound such as 5-nitroindazole, and a fog inhibitor such as benzimidazole compound (e.g., sodium 2-mercaptobenzimidazole-5-sulfonate) and benztriazole compound (e.g., 5-methylbenztriazole). The developer of the present invention may also comprise a development accelerator described in Research Disclosure Vol. 176, No. 17643, XXI, December 1978. The developer of the present invention may comprise an amine compound described in U.S. Pat. No. 4,269,929, JP-A-61-267759, and Japanese Patent Application No. 1-29418 incorporated therein. The developer of the present invention may further comprise a color toner, a surface active agent, a film hardener, etc. incorporated therein as necessary. The developer of the present invention may comprise an amino compound such as alkanolamine described in EP 136582, British Patent 958678, U.S. Pat. No. 3,232,761, and JP-A-56-106244 incorporated therein for the purpose of accelerating development, enhancing contrast or like purposes.

The developer which can be used according to the second embodiment is described below.

The developer contains ascorbic acid and a derivative thereof as a first developing agent and an aminophenol as a second developing agent.

Examples of ascorbic acid and a derivative thereof as the first developing agent include a developing agent represented by formula (2), with ascorbic acid and erythorbic acid being preferred. The concentration of the first developing agent of formula (2) in the developer is generally $5\times10^{-3}$ to 1 mol/liter, preferably from $10^{-2}$ to 0.5 mol/liter.

As the second developing agent there may be used an aminophenol. Examples of the aminophenol employable herein include 4-aminophenol, 4-amino-3-methylphenol, 4-(N-methyl)aminophenol, 2,4-diaminophenol, N-(4-hydroxyphenyl)glycine, N-(2'-hydroxyethyl)-2-aminophenol, 2-hydroxymethyl-4-aminophenol, 2-hydroxymethyl-4-(N-methyl)aminophenol, 2-amino-6-phenylphenol, 2-amino-4-chloro-6-phenylphenol, N-β-hydroxyethyl-4-aminophenol, N-(4'-hydroxyphenyl) pyrrolidine, N-γ-hydroxypropyl-4-aminophenol, 6-hydroxyl-1,2,3,4-tetrahydroquinoline, N,N-dimethyl-4-aminophenol, N,N-diethylaminophenol, and hydrochloride or sulfate thereof.

The amount of the aminophenol to be used is normally from $5\times10^{-4}$ mol to 0.5 mol, preferably from $10^{-3}$ mol to 0.1 mol per l of developer used.

The ratio of the added amount of the first developing agent to that of the second developing agent may be arbitrarily selected.

The developer may auxiliarily comprise hydroquinone or derivative thereof (e.g., hydroquinonemonosulfonic acid, hydroquinonedisulfonic acid, methylhydroquinone, chlorohydroquinone) or 3-pyrazolidone or derivative thereof (e.g., 1-phenyl-3-pyrazolidone, 1-phenyl-4-methyl-3-pyrazolidone, 1-phenyl-5-methyl-3-pyrazolidone, 1-phenyl-4-methyl-hydroxymethyl-3-pyrazolidone) incorporated therein. The amount of such an additive to be incorporated is normally from $1\times10^{-3}$ to 0.8 mol/l, preferably from $1\times10^{-2}$ to 0.4 mol/l.

The developer preferably comprises a preservative and an alkali incorporated therein besides the foregoing essential components. As the preservative there may be used a sulfite. Examples of such a sulfite include sodium sulfite, potassium sulfite, lithium sulfite, ammonium sulfite, sodium bisulfite, potassium bisulfite, and potassium metabisulfite.

The more the added amount of the preservative is, the higher is the preservability of the developer. On the other hand, when the added amount of the preservative increases, the amount of silver ion eluted from the photographic light-sensitive material with the developer increases, causing a gradual accumulation of silver sludge in the developer. Since the developer of the present invention has a high stability, the added amount of the sulfite can be minimized to provide a sufficient preservability. Accordingly, the added amount of the sulfite is preferably not more than 0.5 mol, more preferably from 0.02 to 0.4 mol, particularly from 0.02 to 0.3 mol per l of developer.

Examples of additives other than those described above include development inhibitor such as sodium bromide and potassium bromide, organic solvent such as ethylene glycol, diethylene glycol, triethylene glycol and dimethylformamide, development accelerator such as alkanolamine (e.g., diethanolamine, triethanolamine), imidazole and derivative thereof, and fog inhibitor or black pepper inhibitor such as mercapto compound, indazole compound, benzotriazole compound and benzoimidazole compound. Specific examples of these additives include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenztriazole, sodium 4-[(2-mercapto-1,3,4-thiadiazole-2-yl)thio]butanesulfonate, 5-amino-1,3,4-thiadiazole-2-thiol, methylbenzotriazole, 5-methylbenzotriazole, and 2-mercaptobenzotriazole. The amount of such a fog inhibitor to be used is normally from 0.01 to 10 mmol, preferably from 0.05 to 2 mmol per l of the developer used.

The developer may comprise various inorganic or organic chelating agents incorporated therein. As such an inorganic chelating agent there may be used sodium tetrapolyphosphate, sodium hexametaphosphate or the like.

As the organic chelating agent there may be used an organic carboxylic acid, aminopolycarboxylic acid, organic phosphonic acid, aminophosphonic acid or organic phosphonocarboxylic acid.

Examples of the organic carboxylic acid employable herein include acrylic acid, oxalic acid, malonic acid, succinic acid, glutaric acid, adipic acid, pimelic acid, azelaic acid, sebacic acid, nonanedicarboxylic acid, decanedicarboxylic acid, undecanedicarboxylic acid, maleic acid, itaconic acid, malic acid, citric acid, and tartaric acid. However, the present invention is not limited to these compounds.

Examples of the aminopolycarboxylic acid employable herein include iminodiacetic acid, nitrilotriacetic acid, nitrilotripropionic acid, ethylenediaminemonohydroxy ethyltriacetic acid, ethylenediaminetetraacetic acid, glycolethertetraacetic acid, 1,2-diaminopropanetetraacetic acid, diethylenetriaminepentaacetic acid, triethylene tetraminehexaacetic acid, 1,3-diamino-2-propanoltetraacetic acid, glycoletherdiaminetetraacetic acid, and compounds described in JP-A-52-25632, JP-A-55-67747, JP-A-57-102624, and JP-B-53-40900.

Examples of the organic phosphonic acid employable herein include hydroxyalkylidene-diphosphonic acid described in U.S. Pat. Nos. 3,214,454 and 3,794,591, and West German Patent 2,227,639, and compounds described in Research Disclosure Vol. 181, Item 18170, May 1979.

Examples of the aminophosphonic acid employable herein include aminotris(methylenephosphonic acid), ethylenediaminetetramethylenephosphonic acid, and aminotrimethylenephosphonic acid. Further examples of the aminophosphonic acid include compounds described in Research Disclosure No. 18170, JP-A-57-208554, JP-A-54-61125, JP-A-55-29883, and JP-A-56-97347.

Examples of the organic phosphonocarboxylic acid employable herein include compounds described in JP-A-52-102726, JP-A-53-42730, JP-A-54-121127, JP-A-55-4024, JP-A-55-4025, JP-A-55-126241, JP-A-55-65955, JP-A-55-65956, and Research Disclosure No. 18170.

These chelating agents may be used in the form of alkaline metal salt or ammonium salt. The amount of such a chelating agent to be incorporated is preferably from $1\times10^{-4}$ to $1\times10^{-1}$ mol, more preferably from $1\times10^{-3}$ to $1\times10^{-2}$ mol per l of the developer used.

The developer of the present invention may further comprise a color toner, a surface active agent, an anti-foaming agent, a film hardener, etc. incorporated therein as necessary.

The developer to be used in the present invention may comprise as a pH buffer a carbonate, boric acid, borate (e.g., boric acid, borax, sodium metaborate, potassium borate), saccharides described in JP-A-60-93433 (e.g., saccharose), oxims (e.g., acetoxim), phenols (e.g., 5-sulfosalicylic acid), tertiary phosphate (e.g., sodium salt, potassium salt), aluminic acid (e.g., sodium salt) or the like. Preferred among these pH buffers are carbonate and borate. The amount of such a pH buffer to be used is normally from 0.1 to 1.2 mol/l, preferably from 0.2 to 0.8 mol/l.

The development temperature and the development time are mutually related to each other and determined in connection with the total processing time. In general, the development temperature is from about 20° C. to about 50° C., preferably from 25° C. to 45° C., and the development time is from 5 seconds to 2 minutes, preferably from 7 seconds to 60 seconds.

The pH value of the fresh developer of the present invention is from 9.0 to 10.5. As an alkaline agent to be used for the adjustment of pH there may be used an ordinary water-soluble inorganic alkaline metal salt (e.g., sodium hydroxide, potassium hydroxide, lithium hydroxide, sodium carbonate, potassium carbonate).

The composition of the development replenisher is essentially the same as that of the fresh developer except for pH. The pH value of the development replenisher is predetermined to a value higher than that of the fresh developer. The pH value of the development replenisher is preferably predetermined to 0.2 to 1.5 units, particularly 0.3 to 1.0 unit higher than that of the fresh developer. However, if the pH value of the development replenisher is too high, the replenisher itself can be easily oxidized by air. Accordingly, the upper limit of the pH value of the replenisher is preferably 11.2.

By carrying out running processing with the supply of such a development replenisher, the variation of the pH value of the developer which is actually used to process the photographic light-sensitive material can be substantially eliminated, making it possible to process the photographic light-sensitive material at almost the same pH value as that predetermined at the beginning of development (i.e., pH value of the fresh developer).

The pH value of the fresh developer and the development replenisher can be adjusted as follows. In some detail, the foregoing alkaline agent may be further added to the fresh developer to produce the development replenisher. Alternatively, an acid such as acetic acid, glacial acetic acid, sulfamic acid and sulfuric acid may be added to the development replenisher as a base to lower the pH value of the base to produce a fresh developer. Alternatively, the fresh development and the development replenisher may be separately prepared to have an optimized composition falling within the foregoing range.

In the processing of the present invention, the development replenisher is supplied depending on the processed amount of the silver halide photographic material. The replenishment rate of the development replenisher is normally not more than 500 ml per $m^2$ of the photographic light-sensitive material but may be less than the normal value. Even if the replenishment rate of the development replenisher is not more than 200 ml, even not more than 150 ml, stable processing can be effected.

The photographic light-sensitive material which has thus been developed is normally fixed, rinsed (stabilized), and then dried.

The fixing solution to be used according to the first embodiment of the present invention is an aqueous solution containing a thiosulfate having a pH value of not less than 3.8, preferably from 4.2 to 7.0. Examples of the fixing agent include sodium thiosulfate and ammonium thiosulfate. Particularly preferred among these fixing agents is ammonium thiosulfate in the light of fixing rate. The amount of the fixing agent to be incorporated can be properly changed and is normally from about 0.1 to about 6 mol/l. The fixing solution may contain a water-soluble aluminum salt which acts as a film hardener. Examples of such a water-soluble aluminum salt include aluminum chloride, aluminum sulfate, and potassium alum. The fixing solution may also comprise tartaric acid, citric acid, gluconic acid and derivatives thereof incorporated therein, singly or in combination. The effective content of such a compound in the fixing solution is normally not less than 0.005 mol/l, particularly from 0.01 mol/l to 0.03 mol/l. The fixing solution may optionally comprise a preservative (e.g., sulfite, bisulfite), a pH buffer (e.g., acetic acid, boric acid), a pH adjustor (e.g., sulfuric acid, ammonia), a chelating agent having a water softening capacity, a surface active agent, a wetting agent, a fixing accelerator, and a compound described in JP-A-62-78551 incorporated therein. Examples of the fixing accelerator include thiourea derivatives and alcohols having triple bond in its molecule as described in JP-A-45-35754, JP-A-58-122535, and JP-A-58-122536, thioether compounds as described in U.S. Pat. No. 4,126,459, and compounds as described in JP-A-2-44355. As a dye elution accelerator there may be used a compound described in JP-A-64-4739.

In the development process of the present invention, development and fixing are followed by processing with rinsing water or stabilizing solution which is in turn followed by drying. The rinsing or stabilizing process may be effected at a replenishment rate of not more than 3 l per $m^2$ of silver halide photographic material (including zero, i.e., reservoir rinsing). In other words, water-saving processing can be effected. Further, no piping for the installation of an automatic processor is required. As a method for minimizing the replenishment rate of rinsing water there has been heretofore known a multi-stage countercurrent process (e.g., two-stage, three-stage countercurrent process). When this multi-stage counter-current process is applied to the present invention, the photographic light-sensitive material which has been subjected to fixing can be sequentially brought into contact with the processing solution towards cleaner, i.e., less stained with fixing solution, making it possible to effect rinsing with a greater efficiency. When a small amount of rinsing water is used in the rinsing process, it is preferred that a squeeze roller rinsing tank or crossover roller rinsing tank as described in JP-A-63-18350 and JP-A-62-287252 be provided. In order to lessen the burden of environmental pollution arising from the rinsing with a small amount of rinsing water, the addition of various oxidizers or filtration may be combined. In the foregoing water-saving processing or pipeless processing, the rinsing water or stabilizing solution may be rendered mildew resistant.

As the mildew-proofing method there may be used an ultraviolet-light irradiation method as described in JP-A-60-263939, a process using a magnetic field as described in JP-A-60-263940, a process which comprises the use of an ion exchange resin to provide pure water as described in JP-A-61-131632, and a process using a bactericide as described in JP-A-62-115154, JP-A-62-153952, JP-A-62-220951, and JP-A-62-209532. Bactericides, mildew-proofing agents and surface active agents as described in L. E. West, "Water Quality Criteria", Photo Sci. & Eng. Vol. 9, No. 6 (1965), M. W. Beach, "Microbiological Growths in Motion-Picture Processing", SMPTE Journal Vol. 85 (1976), R. O. Deegan, "Photo Processing Wash Water Biocides", J. Imaging Tech. Vol. 10, No. 6 (1984), JP-A-57-8542, JP-A-57-56143, JP-A-58-105145, JP-A-57-132146, JP-A-58-18631, JP-A-57-97530, and JP-A-57-157244 can be used in combination. Further, the rinsing bath or stabilizing bath may comprise an isothiazoline compound as described in R. T. Kreiman, "J. Imaging Tech.", Vol. 10 (6), No. 242 (1984), and a compound as described in Research Disclosure Vol. 205, No. 20526 (1981, No. 4) as a microbicide. The rinsing bath may comprise a compound as described in Hiroshi Horiguchi, "Boukin-Boubai no Kagaku (Chemistry of Microbiocidal and Mildew-proofing Technology)", Sankyo Shuppan, 1982, and "Boukin-Boubai Gijutu Handbook (Handbook of Microbiocidal and Mildew-proofing Technology)", Hakuhodo, 1986, incorporated therein.

When a small amount of rinsing water is used in the process, it is preferred that a rinsing step configured as described in JP-A-63-143548 be provided. The overflow from the rinsing or stabilizing bath caused by the replenishment of mildew-proofing water can be partially or entirely used as a processing solution having a fixing capacity at the preceding processing step as described in JP-A-60-235133. In the development process, the development time is from 5 seconds to 3 minutes, preferably from 8 seconds to 2 minutes, and the development temperature is preferably from 18° C. to 50° C, more preferably from 24° C. to 40° C.

The fixing temperature and time are preferably from about 18° C. to about 50° C. and from 5 seconds to 3 minutes, more preferably from 24° C. to 40° C. and from 6 seconds to 2 minutes, respectively. In this range, sufficient fixing can be effected. The temperature and time of rinsing (or stabilization) which can elute a sensitizing dye to such an extent that no residual color can occur are preferably from 5° C. to 50° C. and from 6 seconds to 3 minutes, more preferably from 15° C. to 40° C. and from 8 seconds to 2 minutes, respectively. The photographic light-sensitive material which has been subjected to development, fixing and rinsing (or stabilization) is then squeezed to remove the rinsing water away, i.e., dried via squeeze roller. The drying is conducted at a temperature of from about 40° C. to 100° C. The drying time may be properly varied depending on the environmental conditions but is normally from about 4 seconds to 3 minutes, particularly from about 5 seconds to 1 minute at a temperature of 40° C. to 80° C. When the development process is effected for 100 seconds or less on a dry-to-dry basis, a roller made of a rubber material as described in JP-A-63-151943 may be used as a roller at the outlet of the development tank to inhibit uneven development inherent to rapid processing. Alternatively, the discharge flow rate for agitating the developer in the development tank may be raised to not less than 10 m/min. as described in JP-A-63-151944. Alternatively, the processing solution may be agitated more vigorously at least during development than during waiting as described in JP-A-63-264758. In order to further expedite processing, the roller in the fixing tank is preferably composed of opposing rollers to provide a higher fixing rate. The arrangement of opposing rollers makes it possible to reduce the required number of rollers and hence reduce the size of the processing tank. This can provide a compact automatic processor.

The fixing solution to be used in the fixing step according to the second embodiment of the present invention is an aqueous solution containing sodium thiosulfate or ammonium thiosulfate, and optionally tartaric acid, citric acid, gluconic acid, boric acid, iminodiacetic acid, 5-sulfosalicylic acid, glucoheptanic acid, tiron, ethylenediaminetetraacetic acid, diethylenetriaminepentaacetic acid, nitrilotriacetic acid or salt thereof. From the standpoint of recent environmental protection, the fixing solution is preferably free of boric acid.

Examples of the fixing agent to be incorporated in the fixing solution include sodium thiosulfate, and ammonium thiosulfate. From the standpoint of fixing rate, ammonium thiosulfate is preferred. From the standpoint of recent environmental protection, sodium thiosulfate may be used. The amount of such a known fixing agent to be used may appropriately vary but is normally from about 0.1 to about 2 mol/l, particularly from 0.2 to 1.5 mol/l.

The fixing solution may optionally comprise a film hardener (e.g., water-soluble aluminum compound), a preservative (e.g., sulfite, bisulfite), a pH buffer (e.g., acetic acid), a pH adjustor (e.g., ammonia, sulfuric acid), a chelating agent, a surface active agent, a wetting agent, and a fixing accelerator incorporated therein.

Examples of the surface active agent include an anionic surface active agent such as sulfate and sulfonate, a polyethylene surface active agent, and an amphoteric surface active agent described in JP-A-57-6740. The fixing solution of the present invention may comprise a known anti-foaming agent incorporated therein. Examples of the wetting agent include alkanolamine, and alkylene glycol. Examples of the fixing accelerator include thiourea derivatives and alcohols having triple bond in its molecule described in JP-B-45-35754, JP-B-58-122535, and JP-B-58-122536, thioether compounds described in U.S. Pat. No. 4,126,459, and mesoionic compounds described in JP-A-4-229860. Further, compounds described in JP-A-2-44355 may be used.

Examples of the pH buffer employable herein include organic acids such as acetic acid, malic acid, succinic acid, tartaric acid, citric acid, oxalic acid, maleic acid, glucolic acid and adipic acid, and inorganic buffers such as boric acid, phosphate and sulfite. Preferred among these pH buffers are acetic acid, tartaric acid, and sulfite.

The pH buffer is used herein for the purpose of inhibiting the rise in the pH value of the fixing agent caused by the carrying of the developer. The amount of the pH buffer to be incorporated in the fixing solution is normally from 0.01 to 1.0 mol/l, preferably from 0.02 to 0.6 mol/l.

The pH value of the fixing solution is preferably from 4.0 to 6.5, particularly from 4.5 to 6.0.

As the dye elution accelerator there may be used a compound described in JP-A-64-4739.

Examples of the film hardener to be incorporated in the fixing solution include water-soluble aluminum salt and chromium salt. Preferred among these film hardeners is water-soluble aluminum salt. Preferred examples of such a water-soluble aluminum salt include aluminum chloride, aluminum sulfate, and potassium alum. The amount of such a film hardener to be incorporated is preferably from 0.01 to 0.2 mol/l, more preferably from 0.03 to 0.08 mol/l.

The fixing temperature is normally from about 20° C. to about 50° C., preferably from 25° C. to 45° C. The fixing time is normally from 5 seconds to 1 minute, preferably from 7 seconds to 50 seconds.

The replenishment rate of the fixing solution replenisher is preferably not more than 500 ml/m$^2$, particularly not more than 300 ml/m$^2$ based on the processed amount of the photographic light-sensitive material.

As the processing proceeds, silver salts are accumulated in the fixing solution. The fixing solution thus fatigued can then be freed of silver salts by a known silver recovering method so that it can be recycled. Examples of such a known silver recovering method include a method which comprises the electrolytic reduction of silver ion to metallic silver which is then removed by filtration, a method which comprises allowing silver ion to be adsorbed by a compound having a strong adsorptivity so that it is removed, and a method which comprises allowing silver ion to be deposited on the surface of a metal filament so that it is removed. Such a silver recovering apparatus may be mounted on the fixing solution cyclization line. Alternatively, the recovery of silver may be effected on an off-line basis.

The photographic light-sensitive material which has been developed and fixed is then rinsed and stabilized.

The rinsing or stabilizing process may be effected at a replenishment rate of not more than 20 l, even not more than 3 l per $m^2$ of silver halide photographic material (including zero, i.e., reservoir rinsing). In other words, water-saving processing can be effected. Further, no piping for the installation of an automatic processor is required.

As a method for minimizing the replenishment rate of rinsing water there has been heretofore known a multi-stage countercurrent process (e.g., two-stage, three-stage counter-current process). When this multi-stage counter-current process is applied to the present invention, the photographic light-sensitive material which has been subjected to fixing can be sequentially brought into contact with the processing solution towards cleaner, i.e., less stained with fixing solution, making it possible to effect rinsing with a greater efficiency.

When a small amount of rinsing water is used in the rinsing process, it is preferred that a squeeze roller rinsing tank or crossover roller rinsing tank as described in JP-A-63-18350 and JP-A-62-287252 be provided. In order to lessen the burden of environmental pollution arising from the rinsing with a small amount of rinsing water, the addition of various oxidizers or filtration may be combined.

The overflow from the rinsing or stabilizing bath caused by the replenishment of mildew-proofing water can be partially or entirely used as a processing solution having a fixing capacity at the preceding processing step as described in JP-A-60-235133.

In order to inhibit uneven foaming arising from the rinsing with a small amount of rinsing water and/or prevent components of the fixing agent attached to the squeeze roller from being transferred to the film, the rinsing or stabilizing bath may comprise a water-soluble surface active agent or anti-foaming agent incorporated therein.

In order to inhibit the contamination by dyes eluted from the photographic light-sensitive material, a dye adsorbent as described in JP-A-63-163456 may be provided in the rinsing tank.

The foregoing rinsing step may be optionally followed by a stabilizing step. For example, a bath containing a compound described in JP-A-2-201357, JP-A-2-132435, JP-A-1-102553, and JP-A-46-44446 may be used as the final bath in the processing of the photographic light-sensitive material.

The stabilizing bath may optionally comprise an ammonium compound, a compound of metal such as Bi and Al, a fluorescent brightening agent, various chelating agents, a film pH adjustor, a film hardener, a germicide, a mildew-proofing agent, alkanolamine or a surface active agent incorporated therein. As water to be used in the rinsing step or stabilizing step there may be preferably used tap water, deionized water or water sterilized by halogen lamp, ultraviolet germicidal lamp or various oxidizers (e.g., ozone, hydrogen peroxide, chlorate). Alternatively, a rinsing water containing a compound described in JP-A-4-39652 and JP-A-5-241309 may be used.

The rinsing or stabilizing bath temperature and the rinsing or stabilizing time are preferably from 0° C. to 50° C. and from 5 seconds to 1 minute, respectively.

The processing solution to be used in the present invention is preferably stored in a wrapping material having a low oxygen permeability as described in JP-A-61-73147.

For the purpose of reducing the transportation cost of the processing solution and the wrapping material cost and saving the space, the processing solution is preferably stored in a concentrated form which is diluted before use. To this end, salt components contained in the developer are preferably in the form of potassium salt.

The processing solution to be used in the present invention may be in the form of powder or solid. The powdering or solidification of the processing solution may be accomplished by any known method. Methods described in JP-A-61-259921, JP-A-4-85533, and JP-A-4-16841 are preferred. Particularly preferred among these methods is one described in JP-A-61-259921.

When the processing is effected at a reduced replenishment rate, the contact area of the processing solution with air is preferably reduced to inhibit the evaporation and air oxidation of the processing solution. A roller carrying type automatic processor is described in U.S. Pat. Nos. 3,025,779 and 3,545,971. The present invention will be described hereinafter with reference to roller carrying type processor. The roller carrying type processor operates through four steps, i.e., development, fixing, rinsing and drying. The process of the present invention, though not excluding other steps (e.g., stop), comprises the foregoing four steps in the most preferred embodiment. The rinsing step may be replaced by the stabilizing step.

Various additives to be incorporated in the photographic light-sensitive material of the present invention are not specifically limited. For example, those described below may be preferably used.

| Item | References |
|---|---|
| 1) Nucleation accelerator | Compounds of the general formulae (II-m) to (II-p) and (II-1) to (II-22) described in line 13, upper right column, page 9 - line 10, upper left column, page 16 of JP-A-2-103536; compounds as described in JP-A-1-179939. |
| 2) Silver halide emulsion and process for the preparation thereof | Selenium sensitizing methods described in line 12, lower right column, page 20 - line 14, lower left column, page 21 of JP-A-2-97937, line 19, upper right column, page 7 - line 12, lower left column, page 8 of JP-A-2-12236, and JP-A-5-11389. |
| 3) Spectral sensitizing dye | Spectral sensitizing dyes described in line 13, lower left column - line 4, lower right column, page 8 of JP-A-2-12236, line 3, lower right column, page 16 - line 20, lower left column, page 17 of JP-A-2-103536, JP-A-1-112235, JP-A-2-124560, JP-A-3-7928, JP-A-5-11389 and Japanese Patent Application No. 3-411064. |
| 4) Surface active agent | Line 7, upper right column, page 9 - line 7, lower right column, page 9 of JP-A-2-122363; line 13, lower left column, page 2 - line 18, lower right column, page 4 of JP-A-2-185424. |
| 5) Fog inhibitor | Line 19, lower right column, page 17 - line 4, upper right column, page 18 and line 1–line 5, lower right column, page 18 of JP-A-2-103536; thiosulfinic compounds as described in JP-A-1-237538. |
| 6) Polymer latex | Line 12–line 20, lower left column; page 18 of JP-A-2-103536. |
| 7) Acid group-containing compound | Line 6, lower right column, page 18 - line 1, upper left column, page 19 of JP-A-2-2-103536. |
| 8) Mat agent, lubricant, | Line 15, upper left column, |

-continued

| Item | References |
|---|---|
| plasticizer | page 19 - line 15, upper right column, page 19 of JP-A-2-103536. |
| 9) Film hardener | Line 5–line 17, upper right column, page 18 of JP-A-2-103536. |
| 10) Dye | Dyes as described in line 1–line 18, lower right column, page 17 of JP-A-2-103536; solid dyes as described in JP-A-2-294638 and JP-A-5-11382. |
| 11) Binder | Line 1–line 20, lower right column, page 3 of JP-A-2-18542. |
| 12) Black pepper inhibitor | Compounds as described in U.S. Pat. No. 4,956,257 and JP-A-1-118832. |
| 13) Redox compound | Compounds of the general formula (I) (particularly Exemplary Compounds 1 to 50) as described in JP-A-2-301743; Compounds of the general formulae (R-1), (R-2) and (R-3) Exemplary Compounds 1 to 75 as described in JP-A-3-174143, pp. 3–20; compounds as described in Japanese Patent Application Nos. 3-69466 and 3-15648. |
| 14) Monomethine compound | Compounds of the general formula (II) (particularly Exemplary Compounds II-1 to II-26) as described in JP-A-2-2-287532. |
| 15) Dihydroxybenzenes | Compounds as described in JP-A-3-39948, upper left column, page 11 - lower left column, page 12, and EP452772A. |

The present invention will be further described in the following examples, but the present invention should not be construed as being limited thereto.

EXAMPLES

The preparation of Emulsion A will be further described hereinafter.

To Solution 1 set forth in Table 1 which had been kept at 38° C. and pH 4.5 were added simultaneously Solutions 2 and 3 set forth in Table 1 with stirring over a period of 24 minutes to form grains having a grain size of 0.18 $\mu$m. Subsequently, to the grains were added Solutions 4 and 5 set forth in Table 1 over a period of 8 minutes. To the mixture was then added 0.15 g of potassium iodide to complete the formation of grains.

The emulsion was then rinsed by an ordinary flocculation method. To the emulsion was then added gelatin. The emulsion was then adjusted to pH 5.2 and pAg 7.5. The emulsion was then subjected to chemical sensitization with 4 mg of sodium thiosulfate, 2 mg of N,N-dimethylselenourea, 10 mg of chloroauric acid, 4 mg of sodium benzenethiosulfonate and 1 mg of sodium benzenethiosulfinate at 55° C. to effect an optimum sensitization.

To the emulsion were then added 50 mg of 2-methyl-4-hydroxy-1,3,3a,7-tetraazaindene as a stabilizer and 100 ppm of phenoxyethanol as a preservative. Eventually, an emulsion of cubic grains of silver bromochloroiodide having a silver chloride content of 80 mol % and an average grain size of 0.20 $\mu$m was obtained. (Variation coefficient: 9%)

| | |
|---|---|
| <Solution 1> | |
| Water | 1.0 l |
| Gelatin | 20 g |
| Sodium chloride | 2 g |
| 1,3-Dimethylimidazolidine-2-thione | 20 mg |
| Sodium benzenethiosulfonate | 3 mg |
| <Solution 2> | |
| Water | 600 ml |
| Silver nitrate | 150 g |
| <Solution 3> | |
| Water | 600 ml |
| Sodium chloride | 45 g |
| Potassium bromide | 21 g |
| Potassium hexachloroiridiumate (III) (0.001% aqueous solution) | 15 ml |
| Ammonium hexabromorhodiumate (III) (0.001% aqueous solution) | 1.5 ml |
| <Solution 4> | |
| Water | 200 ml |
| Silver nitrate | 50 g |
| <Solution 5> | |
| Water | 200 ml |
| Sodium chloride | 15 g |
| Potassium bromide | 7 g |
| $K_4Fe(CN)_6$ | 30 mg |

Example 1

<Preparation of Silver Halide Photographic Material>

To a polyethylene terephthalate film support having a moistureproof undercoating layer containing vinylidene chloride were applied sequentially UL layer, EM layer, PC layer and OC layer to prepare a specimen.

The preparation method and coated amount of these layers will be described hereinafter.

(UL Layer)

To an aqueous solution of gelatin was added a polyethyl acrylate dispersion in an amount of 30% by weight based on gelatin. The coating solution thus obtained was applied to the support in such an amount that the coated amount of gelatin reached 0.5 g/m$^2$.

(EM Layer)

To Emulsion A was added the following compound (S-1) as a sensitizing dye in an amount of $2.5\times10^{-4}$ mol per mol of silver. To the emulsion were then added a mercapto compound represented by the following general formula (a) in an amount of $3\times10^{-4}$ mol per mol of silver, KBr in an amount of $3.0\times10^{-3}$ mol per mol of silver, 4-hydroxy-6-methyl-1,3,3a,7-tetraazaindene in an amount of $7.0\times10^{-4}$ mol per mol of silver, a mercapto compound represented by the following formula (b) in an amount of $4\times10^{-4}$ mol per mol of silver, a triazine compound represented by the following formula (c) in an amount of $4\times10^{-4}$ mol per mol of silver, 5-chloro-8-hydroxyquinoline in an amount of $2\times10^{-3}$ mol per mol of silver, a nucleating agent (hydrazine derivative) set forth in Table 1 in an amount of $7.0\times10^{-5}$ mol per mol of silver, a nucleation accelerator set forth in Table 1 in an amount of $4.2\times10^{-4}$ mol per mol of silver, sodium p-dodecylbenzenesulfonate in an amount of $9\times10^{-3}$ mol per mol of silver, and hydroquinone in an amount of $3\times10^{-2}$ mol per mol of silver. To the emulsion were then added a polyethylacrylate dispersion in an amount of 200 mg/m$^2$, a latex copolymer of methyl acrylate, sodium 2-acrylamide-2-methylpropanesulfonate and 2-acetoacetoxyethyl methacrylate (weight ratio: 88:5:7) in an amount of 200 mg/m$^2$, a colloidal silica having an average grain diameter of 0.02 $\mu$m in an amount of 200 mg/m2, and a film hardener (d) in an amount of 200 mg/m$^2$.

The coating solution thus prepared was applied in such an amount that the coated amount of silver reached 3.5 g/m$^2$. The coating solution thus completed exhibited a pH value of 5.7.

(PC Layer)

To an aqueous solution of gelatin were added an ethyl acrylate dispersion in an amount of 50% by weight based on gelatin, the following surface active agent (e) in an amount of 5 mg/m$^2$, and 1,5-dihydroxy-2-benzaldoxim in an amount of 10 mg/m$^2$. The coating solution thus prepared was then applied in such an amount that the coated amount of gelatin reached 0.5 g/m$^2$.

(OC Layer)

Gelatin, an amorphous $SiO_2$ matting agent having an average grain size of about 3.5 $\mu$m, methanol silica, a polyacrylamide, and a silicone oil were applied in an amount of 0.5 g/m$^2$, 40 mg/m$^2$, 0.1 g/m$^2$, 100 mg/m$^2$ and 20 mg/m$^2$, respectively. As coating aids there were applied a fluorine surface active agent represented by the following formula (f), sodium dodecylbenzenesulfonate, and a compound represented by the following structural formula (g) in an amount of 5 mg/m$^2$, 100 mg/m$^2$ and 20 mg/m$^2$, respectively.

Additives of Example 1

(S-1)

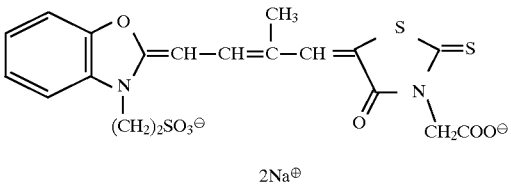

(a)

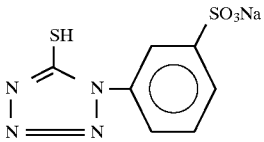

(b)

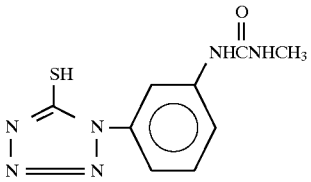

(c)

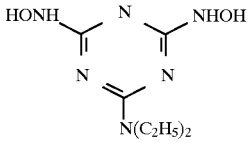

(d)

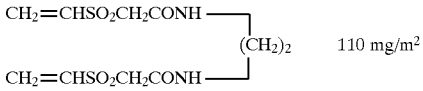

110 mg/m$^2$ (e)

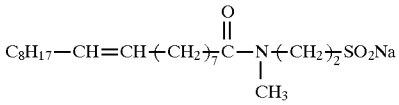

(f)

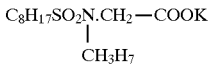

(g)

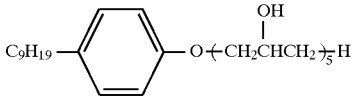

Compound (m)

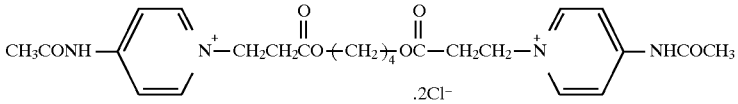

These coated specimens had a back layer and back protective layer having the following composition:

| Back layer | |
|---|---|
| Gelatin | 3 g/m$^2$ |
| Latex: Polyethyl acrylate | 2 g/m$^2$ |
| Surface active agent: Sodium p-dodecylbenzenesulfonate | 40 mg/m$^2$ |
| Film hardener: Compound (d) | 200 mg/m$^2$ |
| $SnO_2$/Sb (weight ratio: 90/10; average grain diameter: 0.20 $\mu$m) | 200 mg/m$^2$ |
| Dye: Mixture of Dye (a), Dye (b) and Dye (c) | |
| Dye (a) | 70 mg/m$^2$ |
| Dye (b) | 70 mg/m$^2$ |
| Dye (c) | 90 mg/m$^2$ |

Dye (a)

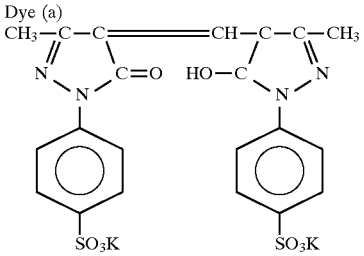

Dye (b)

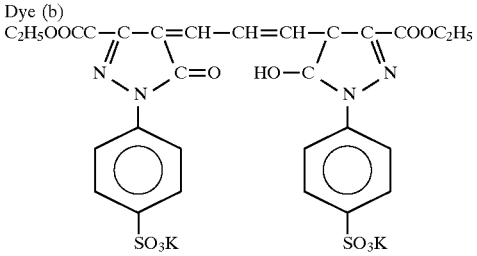

Dye (c)

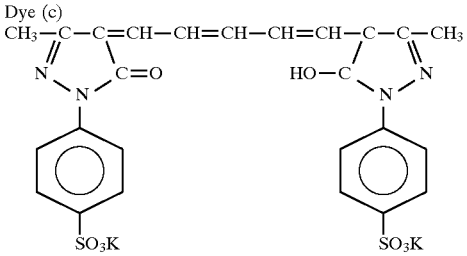

| Back Protective Layer | |
|---|---|
| Gelatin | 0.8 mg/m$^2$ |
| Particulate polymethyl methacrylate (average grain diameter: 4.5 $\mu$m) | 30 mg/m$^2$ |
| Sodium dihexyl-$\alpha$-sulfosuccinate | 15 mg/m$^2$ |
| Sodium p-dodecylbenzenesulfonate | 15 mg/m$^2$ |
| Sodium acetate | 40 mg/m$^2$ |

The formulation of the developers of the present invention will be given below.

| Developer A | |
|---|---|
| NaOH | 2.6 g |
| Diethylenetriaminepentaacetic acid | 4.0 g |
| $K_2CO_3$ | 53.0 g |
| $Na_2CO_3 \cdot H_2O$ | 3.0 g |
| $Na_2SO_3$ | 5.0 g |
| Compound 2-1 | 30.0 g |
| N-methyl-p-aminophenol · ½ sulfate | 4.0 g |

-continued

| Developer A | |
|---|---|
| KBr | 3.0 g |
| 5-Methylbenzotriazole | 0.04 g |
| 2,5-Dimercapto-1,3,4-thiadiazole | 0.075 g |
| Diethylene glycol | 25.0 g |
| Compound (A) | 0.72 g |
| Acetic acid and water to make | 1 l |
| pH | 9.5 |

Compound (A) (Chemical to be Incorporated in Developer A)

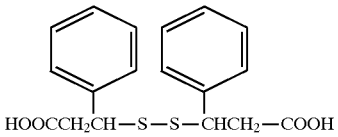

Developer B

Developer B was prepared in the same manner as Developer A except that N-methyl-p-aminophenol.½ sulfate was replaced by 4-hydroxymethyl-4-methyl-1-phenyl-3-pyrazolidone.

Developer C

Developer C was prepared in the same manner as Developer A except that pH was changed to 10.5.

Developer D

Developer D was prepared in the same manner as Developer A except that Compound 2-1 was replaced by Compound 2-18.

Developer E

Developer E was prepared in the same manner as Developer A except that N-methyl-p-aminophenol.½ sulfate was replaced by N-hydroxyethyl-p-aminophenol hydrochloride.

As the fixing solution there was used the following formulation.

| Fixing Solution | |
|---|---|
| Ammonium thiosulfate | 359.1 ml |
| Disodium ethylenediaminetetraacetate dihydrate | 0.09 g |
| Sodium thiosulfate pentahydrate | 32.8 g |
| Sodium sulfite | 64.8 g |
| NaOH | 37.2 g |
| Glacial acetic acid | 87.3 g |
| Tartaric acid | 8.76 g |
| Sodium gluconate | 6.6 g |
| Aluminum sulfate | 25.3 g |
| pH adjusted with sulfuric acid or sodium hydroxide to | 4.85 |
| Water to make | 3 l |

<Evaluation of Performance>

The foregoing specimen was exposed to light from a xenon flash lamp having an emission time of $10^{-6}$ sec. through an interference filter having a peak at 633 nm and a stepwedge. The specimen was developed with the developer having the foregoing formulation at 35° C. for 30 seconds, fixed, rinsed, and then dried.

The processed specimen thus obtained was then measured for density to determine gradation (gamma).

Gamma (G0330) is represented by the following formula:

$$\text{Gamma; } D(3.0-0.3)\div\{(\log(D3.0)-\log(D0.3))\}$$

wherein log(3.0) and log(0.3) represent an exposure amount required to give a density of 3.0 and 0.3, respectively.

The results are set forth in Table 1.

TABLE 1

| No. | Hydrazine Derivative No. | Compound No. of Formula (1) | Gamma | Developer | Remarks |
|---|---|---|---|---|---|
| 101 | 4-3 | — | 8.0 | A | Comparison |
| 102 | " | 1-1* | 18 | A | Invention |
| 103 | " | 1-9 | 20 | A | " |
| 104 | " | 1-12 | 21 | A | " |
| 105 | " | 1-43 | 17 | A | " |
| 106 | " | 1-46 | 18 | A | " |
| 107 | " | 1-12 + Compound-m (4 × $10^{-4}$ mol/mol Ag) | 23 | A | " |
| 108 | 3-38 | 1-12 + Compound-m (4 × $10^{-4}$ mol/mol Ag) | 20 | A | " |
| 109 | 3-40 | 1-12 + Compound-m (4 × $10^{-4}$ mol/mol Ag) | 21 | A | " |
| 110 | 3-56 | 1-12 + Compound-m (4 × $10^{-4}$ mol/mol Ag) | 17 | A | " |
| 111 | 3-58 | 1-12 + Compound-m (4 × $10^{-4}$ mol/mol Ag) | 18 | A | " |
| 112 | 4-2 | 1-12 + Compound-m (4 × $10^{-4}$ mol/mol Ag) | 20 | A | " |
| 113 | 4-16 | 1-12 + Compound-m (4 × $10^{-4}$ mol/mol Ag) | 18 | A | " |
| 114 | 4-27 | 1-12 + Compound-m (4 × $10^{-4}$ mol/mol Ag) | 20 | A | " |
| 101 | 4-3 | — | 8.0 | B | Comparison |
| 103 | " | 1-9 | 9.0 | B | " |
| 104 | " | 1-12 | 9.5 | B | " |
| 105 | " | 1-43 | 9.5 | B | " |
| 108 | 3-38 | 1-12 | 9.0 | B | " |
| 111 | 3-58 | " | 8.5 | B | " |
| 112 | 4-2 | " | 9.0 | B | " |

*Added twice as much as standard

Table 1 shows that the present invention provided an ultrahigh contrast of not less than 10 as calculated in terms of gamma. The additional use of Compound m provided a higher contrast. On the contrary, the processing with Developer B provides a gamma value of not more than 10 and thus could not provide a sufficient contrast.

Example 2

Developer A and Developer C were charged in a Type FG-460A automatic processor (available from Fuji Photo Film Co., Ltd.). Immediately after charging (fresh) and after 10 days of storage, the photographic light-sensitive material Nos. 102, 104, 109, 112 and 113 of Example 1 which had been exposed to light in the same manner as in Example 1 were developed. Thus, the change in sensitivity between fresh and after aged (ΔlogE) was determined.

ΔlogE is the difference in the exposure amount required to give an optical density of 1.5 between fresh and after aged. The more this value is, the more is the sensitivity change.

The results are set forth in Table 2.

TABLE 2

| Developer | Specimen No. | $\Delta S_{1.5}$ | Remarks |
|---|---|---|---|
| Developer A | 102 | 0.03 | Invention |
| " | 104 | 0.02 | " |
| " | 109 | 0.04 | " |
| " | 112 | 0.02 | " |
| " | 113 | 0.03 | " |
| Developer C | 102 | 0.14 | Comparison |
| " | 104 | 0.12 | " |
| " | 109 | 0.15 | " |
| " | 112 | 0.12 | " |
| " | 113 | 0.16 | " |

Table 2 shows that Developer C provided a great sensitivity change with time while Developer A provided a small sensitivity change in all the specimens and was stable.

Example 3

(Preparation of Emulsion B)

250 cc of an aqueous solution of silver nitrate having 64 g of silver nitrate dissolved therein and 250 cc of an aqueous solution of halide having 20 g of potassium bromide and 14 g of sodium chloride dissolved therein and containing $K_2Rh(H_2O)Cl_5$ and $K_3IrCl_6$ in an amount of $1\times10^{-7}$ mol and $2\times10^{-7}$ mol per mol of silver in the entire emulsion, respectively, were added to a 2% aqueous solution of gelatin containing 0.3% of sodium chloride, 002% of 1,3-dimethyl-2-imidazolithione and 0.05% of citric acid by a double jet process at a temperature of 38° C. for 12 minutes to obtain silver bromochloride grains having an average grain size of 0.16 μm and a silver chloride content of 55 mol % as nuclei. Subsequently, to the emulsion were added 300 cc of an aqueous solution of silver nitrate having 106 g of silver nitrate dissolved therein and 300 cc of an aqueous solution of halide having 28 g of potassium bromide and 26 g of sodium chloride dissolved therein by a double jet process over a period of 20 minutes to form grains.

Thereafter, to the emulsion was added KI solution in an amount of $1\times10^{-3}$ mol per mol of silver to effect conversion. The emulsion was then rinsed by an ordinary flocculation method. To the emulsion was then added gelatin in an amount of 40 g per mol of silver. The emulsion was then adjusted to pH 5.9 and pAg 7.5. To the emulsion were then added sodium benzenethiosulfonate, sodium benzenesulfinate, sodium thiosulfate, a compound represented by the following structural formula (h) and chloroauric acid in an amount of 3 mg, 1 mg, 2 mg, 2 mg and 8 mg per mol of silver, respectively. The emulsion was then heated to a temperature of 60° C. for 70 minutes to undergo chemical sensitization. Thereafter, to the emulsion were added 150 mg of 4-hydroxy-6-methyl-1,3,3a,7-tetraazaindene as a stabilizer and 100 mg of proxel as a preservative. To the emulsion was then added 400 mg of a dye represented by the following structural formula (i). After 10 minutes, the emulsion was cooled. As a result, an emulsion of cubic grains of silver bromochloroiodide having an average grain size of 0.22 μm and a silver chloride content of 60 mol % was obtained (variation coefficient: 10%).

(Preparation of Coating Solution for Emulsion Layer)

To the emulsion were then added a short wave cyanine dye represented by the following structural formula (j), potassium bromide, 1-phenyl-5-mercaptotetrazole, a mercapto compound represented by the following structural formula (k), a triazine compound represented by the following structural formula (1), a compound represented by the general formula (3) set forth in Table 3, and a nucleating agent set forth in Table 3 in an amount of $2\times10^{-4}$ mol, $5\times10^{-3}$ mol, $2\times10^{-4}$ mol, $2\times10^{-4}$ mol, $3\times10^{-4}$ mol, $6\times10^{-4}$ mol, and $2\times10^{-4}$ mol per mol of silver, respectively. To the emulsion were then added hydroquinone, sodium p-dedecylbenzenesulfonate, colloidal silica (Snowtex C, available from Nissan Chemical Industries, Ltd.), a polyethyl acrylate dispersion, and 1,2-bis (vinylsulfonylacetamide)ethane in such an amount that the coated amount reached 100 mg/m$^2$, 10 mg/m$^2$, 150 mg/m$^2$, 500 mg/m$^2$, and 80 mg/m$^2$, respectively. The coating solution was adjusted to pH 5.6.

Additives of Example 3

(h)

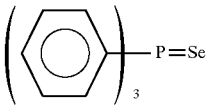

(i)

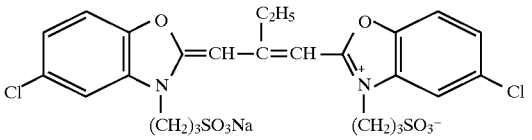

(j)

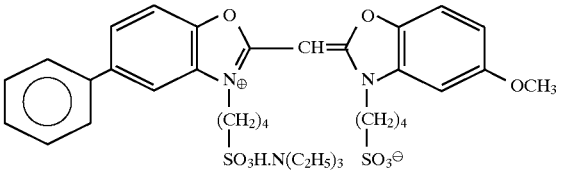

(k)

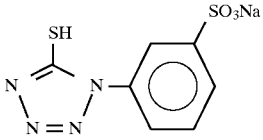

(l)

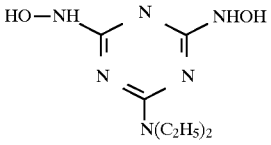

(Preparation of PC and OC Coating Solutions)

To a gelatin solution containing proxel as a preservative were added a compound represented by the general formula (n), a compound represented by the general formula (o) and a polyethyl acrylate dispersion in such an amount that the coated amount reached 10 mg/m$^2$, 100 mg/m$^2$ and 300 mg/m$^2$, respectively. Thus, PC solution was prepared.

To a gelatin solution containing proxel as a preservative were added an amorphous $SiO_2$ matting agent having an average grain size of about 3.5 $\mu$m, colloidal silica (Snowtex C, available from Nissan Chemical Industries, Ltd.), a liquid paraffin, and a fluorine surface active agent represented by the following structural formula (p) and sodium p-dodecylbenzenesulfonate as coating aids in such an amount that the coated amount reached 50 mg/m$^2$, 100 mg/m$^2$, 30 mg/m$^2$, 5 mg/m$^2$ and 30 mg/m$^2$, respectively. Thus, OC solution was prepared.

(n)

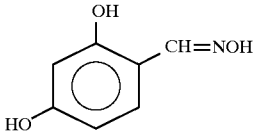

(o)

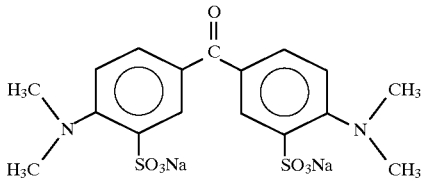

(p)

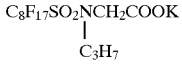

These coating solutions were then applied to a polyethylene terephthalate film having a moistureproofing undercoating layer containing vinylidene chloride provided on both sides thereof in such a manner that an emulsion layer (coated amount of silver: 3.0 g/m$^2$; coated amount of gelatin: 1.5 g/m$^2$) as a lowermost layer, PC layer (coated amount of gelatin: 0.5 g/m$^2$) and OC layer (coated amount of gelatin: 0.4 g/m$^2$) were sequentially provided. The surface of the emulsion surface of the specimen thus obtained exhibited pH 5.8.

The back layer had the following formulation.

| Back Layer | |
|---|---|
| Gelatin | 1.5 g/m$^2$ |
| Surface active agent: Sodium p-dodecylbenzenesulfonate | 30 mg/m$^2$ |
| Gelatin hardener: 1,2-Bis(vinylsulfonylacetamide)ethane | 100 mg/m$^2$ |
| Dye: Mixture of Dye (q), Dye (r), Dye (s) and Dye (t) | |
| Dye (q) | 50 mg/m$^2$ |
| Dye (r) | 100 mg/m$^2$ |
| Dye (s) | 30 mg/m$^2$ |
| Dye (t) | 50 mg/m$^2$ |
| Proxel | 1 mg/m$^2$ |
| **Back Protective Layer** | |
| Gelatin | 1.5 g/m$^2$ |
| Particulate polymethyl methacrylate (average grain diameter: 2.5 $\mu$m) | 20 g/m$^2$ |
| Sodium p-dodecylbenzenesulfonate | 15 mg/m$^2$ |
| Sodium dihexyl-$\alpha$-sulfosuccinate | 15 mg/m$^2$ |
| Sodium acetate | 50 mg/m$^2$ |
| Proxel | 1 mg/m$^2$ |

(q)

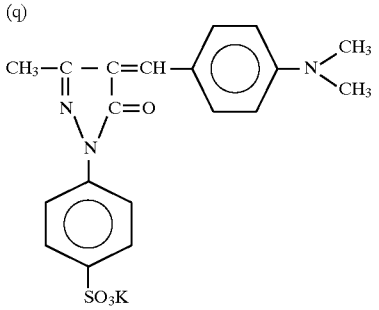

-continued (r)

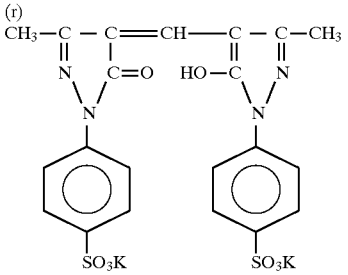

(s)

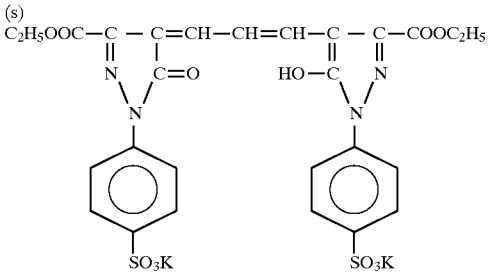

(t)

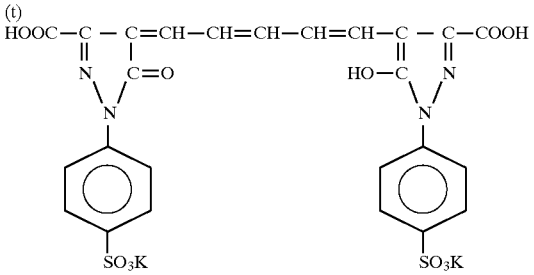

<Evaluation of Performance>

(1) Sensitometry

The foregoing specimen was exposed to tungsten light of 3,200° K through a stepwedge. The specimen thus exposed was developed with Developer A described in Example 1 at a temperature of 35° C. for 30 seconds, fixed, rinsed, and then dried. As the fixing solution there was used a solution having the same formulation as used in Example 1.

The processed specimen thus obtained was then measured for density. Gamma was determined in the same manner as in Example 1.

The results are set forth in Table 3.

TABLE 3

| No. | Hydrazine Derivative No. | Compound No. of Formula (1) | Gamma | Developer | Remarks |
|---|---|---|---|---|---|
| 301 | 3-48 | — | 8.0 | A | Comparison |
| 302 | " | 1-12 | 21.5 | A | Invention |
| 303 | 3-47 | " | 17.2 | A | " |
| 304 | 3-52 | " | 21.0 | A | " |
| 305 | 4-2 | " | 23.6 | A | " |
| 306 | 4-16 | " | 17.8 | A | " |
| 307 | 4-28 | " | 22.0 | A | " |
| 302 | 3-48 | " | 22.8 | D | " |
| 305 | 4-2 | " | 24.1 | D | " |
| 307 | 4-28 | " | 23.2 | D | " |
| 302 | 3-48 | " | 23.5 | E | " |
| 305 | 4-2 | " | 24.5 | E | " |
| 307 | 4-28 | " | 24.0 | E | " |
| 302 | 3-48 | " | 8.2 | B | Comparision |

TABLE 3-continued

| No. | Hydrazine Derivative No. | Compound No. of Formula (1) | Gamma | Developer | Remarks |
|---|---|---|---|---|---|
| 305 | 4-2 | " | 8.8 | B | " |
| 307 | 4-28 | " | 8.5 | B | " |

Table 3 shows that all the specimens of the present invention processed with Developer A, Developer D and Developer E provided an ultrahigh contrast. On the contrary, Developer B could not provide a sufficient contrast.

Example 4

(Preparation of Emulsion C)

A 1.5% aqueous solution of gelatin having pH 2.0 containing sodium chloride, sodium benzenesulfonate in an amount of $3\times10^{-5}$ mol per mol of silver and 4-hydroxy-6-methyl-1,3,3a,7-tetraazaindene in an amount of $5\times10^{-3}$ mol per mol of silver and an aqueous solution of sodium chloride containing $K_2Ru(NO)Cl_5$ in an amount of $2.0\times10^{-6}$ mol per mol of silver which had been kept at 40° C. were simultaneously added to the system by a double jet process at a potential of 95 mV in such a manner that half of the amount of silver required for the formation of final grains was reached in 3 minutes and 30 seconds. Thus, cores having a grain size of 0.12 μm were prepared. Thereafter, to the emulsion were then added an aqueous solution of silver nitrate and an aqueous solution of sodium chloride containing $K_2Ru(NO)Cl_5$ in an amount of $6.0\times10^{-6}$ mol per mol of silver in 7 minutes in the same manner as above to prepare an emulsion of cubic grains of silver chloride having an average grain size of 0.15 μm (variation coefficient: 12%).

The emulsion was then rinsed by a flocculation method well known in the art to remove soluble salts therefrom. To the emulsion was then added gelatin. To the emulsion were then added Compound A and phenoxyethanol as preservatives each in an amount of 60 mg per mol of silver. The emulsion was then adjusted to pH 5.7 and pAg 7.5. To the emulsion were then added chloroauric acid and Compound Z each in an amount of $4\times10^{-5}$ mol per mol of silver. To the emulsion were then added sodium thiosulfate and potassium selenocyanide each in an amount of $1\times10^{-5}$ mol per mol of silver. The emulsion was then heated to a temperature of 60° C. for 60 minutes to undergo chemical sensitization. To the emulsion was then added 4-hydroxy-6-methyl-l,3,3a,7-tetraazaindene as a stabilizer in an amount of $1\times10^{-3}$ mol per mol of silver. (The final grains exhibited a pH value of 5.7, a pAg value of 7.5 and an Ru content of $4.0\times10^{-6}$ mol/mol Ag.)

Compound Z

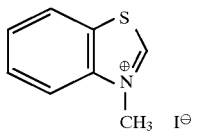

EM, PC, and OC layers were then sequentially applied to the following support.

(EM Layer)

To Emulsion C were added the following compounds. The coating solution thus obtained was then applied to the support in such an amount that the coated amount of gelatin and silver reached 0.9 g/m$^2$ and 2.7 g/m$^2$, respectively, to form a silver halide emulsion layer.

| | |
|---|---|
| 1-Phenyl-5-mercapto-tetrazole | 1 mg/m$^2$ |
| Compound of formula (1) set forth in Table 4 | 8 × 10$^{-4}$ mol/mol Ag |
| Sodium salt of N-oleyl-N-methyltaurin | 10 mg/m$^2$ |
| Compound B | 10 mg/m$^2$ |
| Compound C | 10 mg/m$^2$ |
| Compound D | 10 mg/m$^2$ |
| n-Butyl acrylate/2-acetoacetoxyethy methacrylate/acrylic acid copolymer (89/8/3) | 760 mg/m$^2$ |
| Compound E (film hardener) | 105 mg/m$^2$ |
| Sodium polystyrenesulfonate | 57 mg/m$^2$ |
| Nucleating agent set forth in Table 4 | 1.2 × 10$^{-3}$ mol/mol Ag |

(PC Layer)

To an aqueous solution of gelatin were added the following compounds. The coating solution thus obtained was then applied in such an amount that the coated amount of gelatin reached 0.6 g/m$^2$.

| | |
|---|---|
| Gelatin (Ca$^{++}$ content: 2,700 ppm) | 0.6 g/m$^2$ |
| Sodium p-dodecylbenzenesulfonate | 10 mg/m$^2$ |
| Sodium polystyrenesulfonate | 6 mg/m$^2$ |
| Compound A | 1 mg/m$^2$ |
| Compound F | 14 mg/m$^2$ |
| n-Butyl acrylate/2-acetoacetoxyethy methacrylate/acrylic acid copolymer (89/8/3) | 250 mg/m$^2$ |

(OC Layer)

To an aqueous solution of gelatin were added the following compounds. The coating solution thus obtained was then applied in such an amount that the coated amount of gelatin reached 0.45 g/m$^2$.

| | |
|---|---|
| Gelatin (Ca$^{++}$ content: 2,700 ppm) | 0.45 g/m$^2$ |
| Amorphous silica matting agent (average grain diameter: 3.5 μm; pore diameter: 25Å; surface area: 700 m$^2$/g) | 40 mg/m$^2$ |
| Amorphous silica matting agent (average grain diameter: 2.5 μm; pore diameter: 170Å; surface area: 300 m$^2$/g) | 10 mg/m$^2$ |
| N-perfluorooctanesulfonyl-N-propylglycine potassium | 5 mg/m$^2$ |
| Sodium p-dodecylbenzenesulfonate | 30 mg/m$^2$ |
| Compound A | 1 mg/m$^2$ |
| Liquid paraffin | 40 mg/m$^2$ |
| Solid Dispersed Dye $G_1$ | 30 mg/m$^2$ |
| Solid Dispersed Dye $G_2$ | 150 mg/m$^2$ |
| Sodium polystyrenesulfonate | 4 mg/m$^2$ |

Subsequently, the following electrically-conductive layer and back layer were simultaneously applied to the back side of the support.

<Preparation and Coating of Electrically-conductive Layer Coating Solution>

To an aqueous solution of gelatin were added the following compounds. The coating solution thus obtained was then applied in such an amount that the coated amount of gelatin reached 0.06 g/m$^2$.

| | |
|---|---|
| $SnO_2$/Sb (9/1 by weight; average grain diameter: 0.25 μm) | 186 mg/m$^2$ |
| Gelatin (Ca$^{++}$ content: 3,000 ppm) | 60 mg/m$^2$ |
| Sodium p-dodecylbenzenesulfonate | 13 mg/m$^2$ |

-continued

| | |
|---|---|
| Sodium dihexyl-α-sulfosuccinate | 12 mg/m$^2$ |
| Sodium polystyrenesulfonate | 10 mg/m$^2$ |
| Compound A | 1 mg/m$^2$ |

<Preparation and Coating of Back Layer Coating Solution>

To an aqueous solution of gelatin were added the following compounds. The coating solution thus obtained was then applied in such an amount that the coated amount of gelatin reached 1.94 g/m$^2$.

| | |
|---|---|
| Gelatin (Ca$^{++}$ content: 30 ppm) | 1.94 mg/m$^2$ |
| Particulate polymethyl methacrylate (average grain diameter: 3.4 μm) | 15 mg/m$^2$ |
| Compound H | 140 mg/m$^2$ |
| Compound I | 140 mg/m$^2$ |
| Compound J | 30 mg/m$^2$ |
| Compound K | 40 mg/m$^2$ |
| Sodium p-dodecylbenzenesulfonate | 7 mg/m$^2$ |
| Sodium dihexyl-α-sulfosuccinate | 29 mg/m$^2$ |
| Compound L | 5 mg/m$^2$ |
| N-perfluorooctanesulfonyl-N-propyl glycine potassium | 5 mg/m$^2$ |
| Sodium sulfate | 120 mg/m$^2$ |
| Sodium acetate | 40 mg/m$^2$ |
| Compound E (film hardener) | 105 mg/m$^2$ |

(Preparation of Support and Undercoating Layer)

To both sides of a biaxially oriented polyethylene terephthalate support (thickness: 100 μm) were applied first and second undercoating layers having the following composition, respectively.

<First Undercoating Layer>

| | |
|---|---|
| Core-shell type vinylidene chloride copolymer (1) | 15 g |
| 2,4-Dichloro-6-hydroxy-s-triazine | 0.25 g |
| Particulate polystyrene (average grain diameter: 3 μm) | 0.05 g |
| Compound M | 0.20 g |
| Colloidal silica (Snowtex ZL; grain diameter: 70 to 100 μm, available from Nissan Chemical Industries, Ltd.) | 0.12 g |
| Water to make | 100 g |

To the solution was then added a 10 wt % KOH to give a coating solution having pH 6. The coating solution was then applied to the support in such an amount that the coating thickness reached 0.9 μm after 2 minutes of drying at 180° C.

| <Second Undercoating Layer> | |
|---|---|
| Gelatin | 1 g |
| Methyl cellulose | 0.05 g |
| Compound N | 0.02 g |
| $C_{12}H_{25}O(CH_2CH_2O)_{10}H$ | 0.03 g |
| Compound A | 3.5 × 10$^{-3}$ g |
| Acetic acid | 0.2 g |
| Water to make | 100 g |

The coating solution thus obtained was then applied to the support in such an amount that the coating thickness reached 0.1 μm after 2 minutes of drying at 170° C. Thus, a specimen was prepared.

Compound A
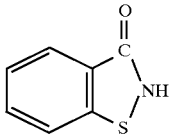
Compound B
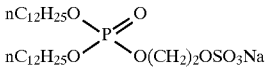
Compound C
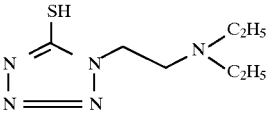
Compound D
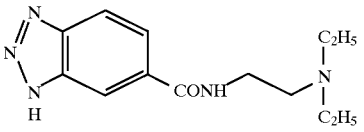
Compound E
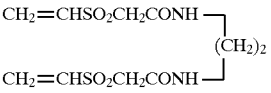
Compound F
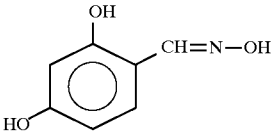
Solid Dispersed Dye $G_1$
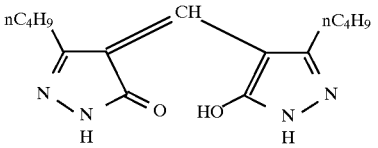
Solid Dispersed Dye $G_2$
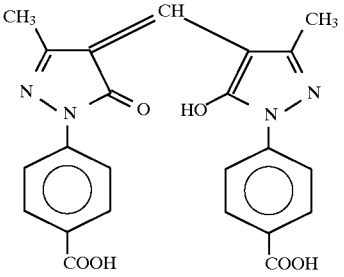
-continued
Compound H
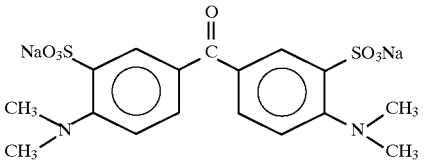
Compound I
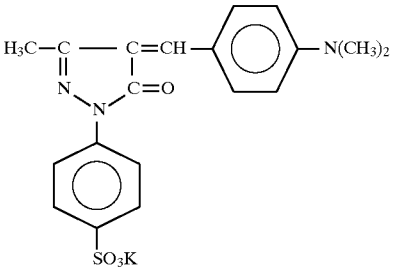
Compound J
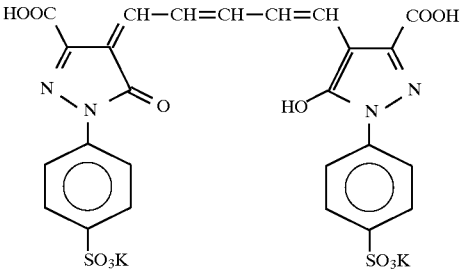
Compound K
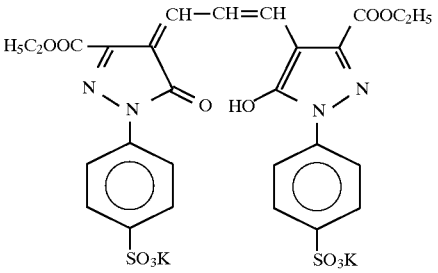
Compound L
$C_8F_{17}SO_3Li$
Core-shell type Vinylidene Copolymer (1)
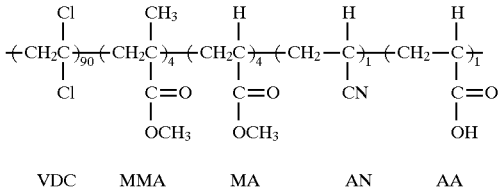
VDC MMA MA AN AA
Core: VDC/MMA/MA (80 wt. %)
Shell: VDC/AN/AA (20 wt. %)
Average grain size: 70 nm -continued Compound M

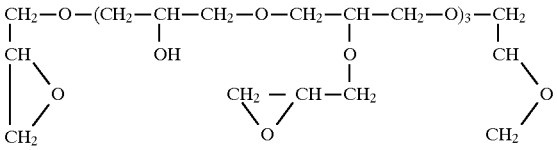

Compound N

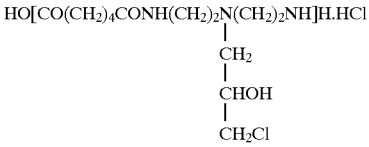

<Evaluation of Performance>

Extract Letter Image Quality

In order to evaluate extract letter image quality, an original configured as shown in FIG. 1 of JP-B-2-28856, i.e., laminate of transparent cladding base/film having a line positive image formed thereon (line image original)/transparent cladding base/film having a half tone image formed thereon (half tone original) in this order was prepared. The original was then each laminated with the above-prepared specimens in such a manner that it came into contact with the emulsion surface of the specimen. The laminates were each exposed to light in a Type P-627FM printer available from Dainippon Ink & Chemicals, Inc., processed with Developer A at 38° C. for 20 seconds in a Type FG-680AG automatic processor available from Fuji Photo Film Co., Ltd., fixed, rinsed, and then dried. As the fixing solution there was used a solution having the same formulation as used in Example 1.

For the various specimens, the exposure time was determined such that a half tone original having 50% half tone area proportion was reproduced on the specimen as a half tone having 50% half tone area proportion.

Extract letter image quality 5 is a very excellent extract letter image quality which enables reproduction of 30-$\mu$m wide letters when exposure is effected through an original as shown in Figure as mentioned above in such a manner that 50% dot area turns out 50% dot area on a light-sensitive material for contact work. On the contrary, extract letter image quality 1 is a poor extract letter image quality which can only reproduce letters having a width of 150 $\mu$m or more under the same exposure conditions as extract letter image quality. Between extract letter image quality 5 and extract letter image quality 1 are organoleptically provided extract letter image qualities 4, 3 and 2. Extract letter image quality 3 or higher are practicable levels.

Gamma

The coating specimens of the present example were each exposed to light through a stepwedge in a Type P-627FM printer, developed with Developer A and Developer B in FG-680AG at 38° C. for 20 seconds, fixed, rinsed, and then dried. As the fixing solution there was used a solution having the same formulation as used in Example 1.

The results are set forth in Table 4.

TABLE 4

| No. | Hydrazine Derivative No. | Compound No. of Formula (1) | Gamma | Extract Letter Image Quality | Developer | Remarks |
|---|---|---|---|---|---|---|
| 401 | 3-32 | — | 9.0 | 2 | A | Comparison |
| 402 | " | 1-12 | 22.6 | 5 | A | Invention |
| 403 | 3-40 | " | 20.5 | 5 | A | " |
| 404 | 3-52 | " | 19.2 | 5 | A | " |
| 405 | 4-7 | " | 18.2 | 5 | A | " |
| 406 | 4-13 | " | 17.2 | 4 | A | " |
| 407 | 4-22 | " | 20.3 | 5 | A | " |
| 408 | 4-26 | " | 20.5 | 5 | A | " |
| 409 | 3-32 | 1-1* | 21.7 | 4 | A | " |
| 410 | " | 1-42 | 22.2 | 5 | A | " |
| 411 | " | 1-46 | 18.6 | 4 | A | " |
| 412 | " | 1-47 | 21.4 | 5 | A | " |
| 402 | " | 1-12 | 9.2 | 2 | B | Comparison |
| 403 | 3-40 | " | 9.5 | 2 | B | " |
| 405 | 4-7 | " | 9.0 | 2 | B | " |
| 410 | 3-32 | 1-42 | 9.5 | 2 | B | " |

*Added twice as much as standard

Table 4 shows that the present invention could also provide an ultrahigh contrast and an excellent extract letter image quality on photographic light-sensitive materials for contact work.

Example 5

The procedure of Example 1 was followed to prepare a specimen except that the sensitizing dyes were replaced by the following sensitizing dyes S-2 ($5\times10^{-4}$ mol/mol Ag) and S-3 ($5\times10^{-4}$ mol/mol Ag).

Additives of Example 5

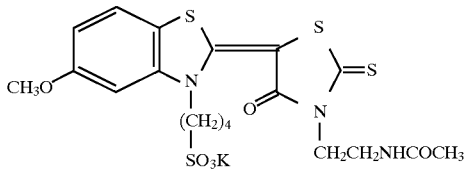

(S-2)

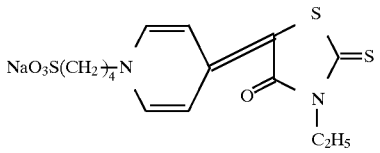

(S-3)

The foregoing specimen was exposed to light from a xenon flash lamp having an emission time of $10^{-5}$ sec. through an interference filter having a peak at 488 nm and a stepwedge. The specimen was developed with Developer A and Developer B at 35° C. for 30 seconds, fixed, rinsed, and then dried. As a result, all the specimens processed according to the image formation process of the present invention exhibited an ultrahigh contrast.

Example 6

The procedure of Example 1 was followed to prepare a specimen except that the sensitizing dye to be incorporated in EM layer was replaced by the following compound S-4.

(S-4)

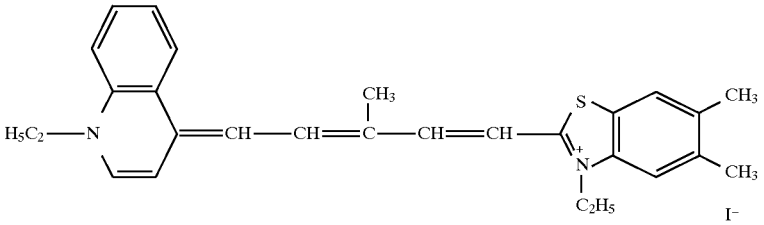

The foregoing specimen was exposed to light from a xenon flash lamp having an emission time of $10^{-6}$ sec. through an interference filter having a peak at 780 nm and a stepwedge. The specimen was developed at 35° C. for 30 seconds in a Type FG-680AG automatic processor, fixed, rinsed, and then dried. As the developer there was used Developer A. As the fixing solution there was used a solution having the same formulation as described in Example 1.

<Result>

All the specimens of the present invention exhibited a high gamma value and hence excellent properties suitable for semiconductor laser scanner.

Example 7

<Preparation of Silver Halide Photographic Light-sensitive Material>

Preparation of Emulsion A'

An aqueous solution of silver nitrate and an aqueous solution of halide containing potassium bromide, sodium chloride, $K_3IrCl_6$ in an amount of $3.5\times10^{-7}$ mol per mol of silver and $K_2Rh(H_2O)Cl_5$ in an amount of $2.0\times10^{-7}$ mol per mol of silver were added to an aqueous solution of gelatin containing sodium chloride and 1,3-dimethyl-2-imidazolidinethione with stirring by a double jet process to prepare an emulsion of silver bromochloride grains having an average grain size of 0.25 μm and a silver chloride content of 70 mol %.

The emulsion thus prepared was then rinsed by an ordinary flocculation method. To the emulsion was then added gelatin in an amount of 40 g per mol of silver. To the emulsion were then added sodium benzenethiosulfonate and benzenesulfinic acid in an amount of 7 mg and 2 mg per mol of silver, respectively. The emulsion was then adjusted to pH 6.0 and pAg 7.5. The emulsion was then subjected to chemical sensitization with sodium thiosulfate in an amount of 2 mg per mol of silver and chloroauric acid in an amount of 4 mg per mol of silver at a temperature of 60° C. to have an optimum sensitivity. Thereafter, to the emulsion were added 150 mg of 4-hydroxy-6-methyl-1,3,3a,7-tetraazaindene as a stabilizer and 100 mg of Proxel as a preservative. As a result, an emulsion of cubic grains of silver bromochloride having an average grain size of 0.25 μm and a silver chloride content of 70 mol % was obtained (variation coefficient: 10%).

Preparation of Coating Specimen

To a polyethylene terephthalate film having a moisture-proofing undercoating layer containing vinylidene chloride were sequentially applied UL layer, EM layer, PC layer and OC layer to prepare a coating specimen.

The preparation method and coated amount of the various layers will be given below.

(UL layer)

To an aqueous solution of gelatin was added a polyethyl acrylate dispersion in an amount of 30% by weight based on gelatin. The coating solution was applied to the support in such an amount that the coated amount of gelatin reached 0.5 g/m$^2$.

(EM layer)

To Emulsion A' were added the following compounds (S-1') and (S-2') as sensitizing dyes each in an amount of $5\times10^{-4}$ mol per mol of silver. To the emulsion were then added a mercapto compound represented by the following general formula (a) in an amount of $3\times10^{-4}$ mol per mol of silver, a mercapto compound represented by the following formula (b) in an amount of $4\times10^{-4}$ mol per mol of silver, a triazine compound represented by formula (c) in an amount of $4\times10^{-4}$ mol per mol of silver, 5-chloro-8-hydroxyquinoline in an amount of $2\times10^{-3}$ mol per mol of silver, a compound represented by the following formula (p) in an amount of $5\times10^{-4}$ mol per mol of silver, and a compound represented by formula (A) as a nucleation accelerator in an amount of $4\times10^{-4}$ mol per mol of silver. To the emulsion was then added hydroquinone and N-oleyl-N-methyltaurine sodium salt in such an amount that the coated amount thereof reached 100 mg/m$^2$ and 30 mg/m$^2$, respectively. To the emulsion were then added a hydrazine derivative (Compound No. 3'-17), a water-soluble latex represented by the general formula (d), a polyethyl acrylate dispersion, a latex copolymer of methyl acrylate, sodium 2-acrylamide-2-methylpropanesulfonate (weight ratio: 88:5:7), colloidal silica having an average grain diameter of 0.02 μm, sodium dodecylbenzenesulfonate, and 1,3-divinylsulfonyl-2-propanol as a film hardener in such an amount that the coated amount thereof reached $1\times10^{-5}$ mol/m$^2$, 200 mg/m$^2$, 200 mg/m$^2$, 200 mg/m$^2$, 200 mg/m$^2$, 30 mg/m$^2$, and 200 mg/m$^2$, respectively. The pH of the coating solution was then adjusted to 5.65 with acetic acid. The coating solution thus obtained was then applied in such an amount that the coated amount of silver reached 3.5 g/m$^2$.

(PC layer)

To an aqueous solution of gelatin was added an ethyl acrylate dispersion in an amount of 50% by weight based on gelatin. To the solution were further added the following surface active agent (w) and 1,5-dihydroxy-2-benzaldoxim in such an amount that the coated amount thereof reached 5 mg/m$^2$ and 10 mg/m$^2$, respectively. The PC layer coating solution thus prepared was then applied in such an amount that the coated amount of gelatin reached 0.5 g/m$^2$.

(OC layer)

Gelatin, an amorphous $SiO_2$ matting agent having an average grain size of about 3.5 μm, methanol silica, a polyacrylamide, a silicone oil, and a fluorine surface active agent having the following structural formula (e) and sodium dodecylbenzenesulfonate as coating aids were applied in such an amount that the coated amount thereof reached 0.5 g/m$^2$, 40 mg/m$^2$, 0.1 g/m$^2$, 100 mg/m$^2$, 20 mg/m$^2$, 5 mg/m$^2$ and 100 mg/m$^2$, respectively.

(S-1')

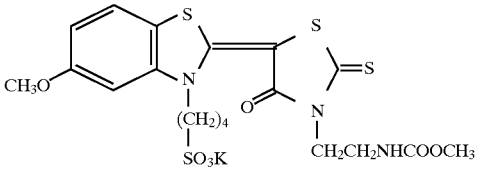

(S-2')

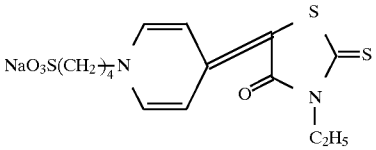

(a)

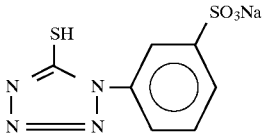

(b)

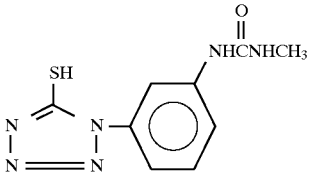

(c)

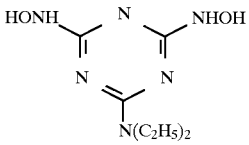

(A)

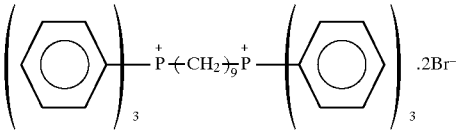

(p)

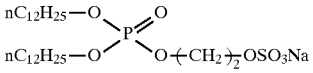

(d)

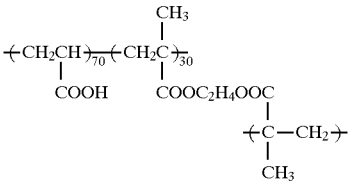

(e)

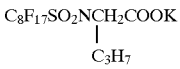

(w)

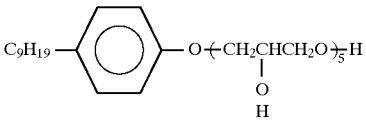

These coating specimens had a back layer and back protective layer having the following composition.

| Back Layer | |
|---|---|
| Gelatin | 3 g/m$^2$ |
| Latex: Polyethyl acrylate | 2 g/m$^2$ |
| Surface active agent: Sodium p-dodecylbenzenesulfonate | 40 mg/m$^2$ |

-continued

| | |
|---|---|
| $CH_2{=}CHSO_2CH_2CONH$ ┐ $(CH_2)_2$ $CH_2{=}CHSO_2CH_2CONH$ ┘ | 110 mg/m$^2$ |
| $SnO_2$/Sb (weight ratio: 90/10; average grain diameter: 0.20 $\mu$m) | 200 mg/m$^2$ |
| Dye: Mixture of Dye (a), Dye (b) and Dye (c) | |
| Dye (a) (same as in Example 1) | 70 mg/m$^2$ |
| Dye (b) (same as in Example 1) | 70 mg/m$^2$ |
| Dye (c) (same as in Example 1) | 90 mg/m$^2$ |
| Back Protective Layer | |
| Gelatin | 0.8 mg/m$^2$ |
| Particulate polymethyl methacrylate (average grain diameter: 4.5 $\mu$m) | 30 mg/m$^2$ |
| Sodium dihexyl-α-sulfosuccinate | 15 mg/m$^2$ |
| Sodium p-dodecylbenzenesulfonate | 15 mg/m$^2$ |
| Sodium acetate | 40 mg/m$^2$ |

<Evaluation of Photographic Performance>

(1) Exposure and Development

The foregoing specimen was exposed to light from a xenon flash lamp having an emission time of $10^{-5}$ sec. through an interference filter having a peak at 488 nm and a stepwedge. The specimen was developed at 35° C. for 30 seconds with Developers A' to C' set forth in Table 5, fixed, rinsed, and then dried. The amount of sodium sulfite set forth in Table 5 was 0.08 mol/l. Developer B' was a comparative developer obtained by replacing N-methyl-p-aminophenol in Developer A' by 1-phenyl-3-pyrazolidone in the equimolar amount. Developer C' was a comparative developer having the same formulation as Developer DC described in examples of EP573,700A1.

TABLE 5

| | Developer A' (Invention) | Developer B' (Comparison) | Developer C' (Comparison) |
|---|---|---|---|
| Potassium hydroxide | 25.0 | 25.0 | 11 |
| Diethylenetriamine-pentaacetic acid | 2.0 | 2.0 | 2.0 |
| Potassium carbonate | 30.0 | 30.0 | 61 |
| Potassium sulfite | — | — | 65 |
| Sodium sulfite | 10.0 | 10.0 | — |
| Potassium bromide | 2.0 | 2.0 | 10 |
| 5-Methylbenzotriazole | 1.0 | 1.0 | — |
| N-Methyl-p-aminophenol | 7.5 | — | — |
| 1-Phenyl-3-pyrazolidone | — | 9.8 | 0.5 |
| Sodium erythorbate | 30.0 | 30.0 | 60 |
| Boric acid | 12.0 | 12.0 | 12.0 |
| Sodium 2-mercaptobenz-imidazole-5-sulfonate | 0.1 | 0.1 | — |
| 1-Phenyl-5-mercapto-tetrazole | — | — | 0.039 |
| Water to make | 1 l | 1 l | 1 l |
| pH adjusted with KOH or acetic acid to | 9.7 | 9.7 | 9.9 |

The fixing solution had the following formulation.

| Fixing Solution | |
|---|---|
| Ammonium thiosulfate | 359.1 g |
| Disodium ethylenediamine-tetraacetate dihydrate | 0.09 g |
| Sodium thiosulfate pentahydrate | 32.8 g |
| Sodium sulfite | 64.8 g |
| NaOH | 37.2 g |
| Glacial acetic acid | 87.3 g |

-continued

| Fixing Solution | |
|---|---|
| Tartaric acid | 8.76 g |
| Sodium gluconate | 6.6 g |
| Aluminum sulfate | 25.3 g |
| pH adjusted with sulfuric acid or sodium hydroxide to | 4.85 |
| Water to make | 3 l |

(2) Evaluation of Contrast of Image and Sensitivity

For the evaluation of the index representing the image contrast (gamma), the inclination of the straight line between the point of (fog+density 0.1) and the point of (fog+density 3.0) on the characteristic curve was determined. In other words, gamma is represented by (3.0–0.1) /[log(exposure amount giving a density of 3.0)—(exposure amount giving a density of 0.1)]. The more gamma value is, the harder is the contrast. A photographic light-sensitive material for graphic arts preferably has a gamma value of not less than 10, more preferably not less than 15. The photographic sensitivity was represented by the logarithm of the reciprocal of the exposure giving a density of 1.5, relative to that with Developer A'.

(3) Evaluation of Dot Quality (DQ)

The photographic light-sensitive material which had been exposed to light through a contact screen was observed for dot quality through a magnifier. The dot quality was evaluated by five steps. In the 5-step evaluation, Step "5" indicates a level most excellent in sharpness and smoothness. Step "1" indicates the worst level. Steps "3" or higher are practically acceptable in sharpness on the on/off area and smoothness of an image actually obtained by scanner exposure.

The results are set forth in Table 2. The results show that Developer A' provides an extremely high contrast and Dmax, a high sensitivity and a high dot quality. On the contrary, Comparative Developers B' and C' provide an insufficient effect of enhancing contrast.

TABLE 6

| Developer | Contrast (gamma) | Photographic Sensitivity | Dmax | Dot Quality |
|---|---|---|---|---|
| A' | 18.0 | ±0 | 4.91 | 5 |
| B' | 9.3 | −0.21 | 4.25 | 3 |
| C' | 7.1 | −0.33 | 3.39 | 2 |

The difference between Developer A' and Developer B' is the difference between N-methyl-p-aminophenol and 1-phenyl-3-pyrazolidone. It was quite an unexpected effect that this difference makes such a big difference in contrast.

<Evaluation of Performance after Running Processing>

Using a Type FG-680AG available from Fuji Photo Film Co., Ltd., the photographic light-sensitive material was processed at a rate of 10 $m^2$ per day for 2 weeks. As a replenisher there was used a solution having the same formulation as Developer A' but having a pH value raised by the addition of sodium hydroxide. The replenishment rate was 150 ml per $m^2$ of photographic light-sensitive material.

| Replenisher No. | A-1 | A-2 | A-3 | A-4 | A-5 | A-6 |
|---|---|---|---|---|---|---|
| pH (Difference from mother liquor) | 9.7 (0) | 10.0 (+0.3) | 10.3 (+0.6) | 10.5 (+0.7) | 10.7 (+1.0) | 11.0 (+1.3) |

The number of running days and the change in the pH value of developer and the photographic sensitivity are set forth in Table 7. The results give the following conclusions:

1) The higher the pH value of the replenisher is, the lower is the pH drop due to running. However, with A-5 and A-6, the pH rises.
2) On the other hand, the higher the pH value of the replenisher is, the better can be maintained contrast and dot quality even after running. However, with A-5 or A-6, these properties are deteriorated in the range where the pH value rises due to running.

Even after 2 weeks of running, the dot quality was maintained 4 or higher with A-2 to A-5, i.e., with replenishers having a pH value of from 0.3 to 1.0 higher than that of the fresh developer.

TABLE 7

| Replenisher No. | Number of running days | pH | Contrast (gamma) | Dot Quality |
|---|---|---|---|---|
| A-1 | 0 | 9.7 | 18.0 | 5 |
| | 7 | 9.4 | 12.1 | 4 |
| | 14 | 9.1 | 9.7 | 3 |
| A-2 | 0 | 9.7 | 18.0 | 5 |
| | 7 | 9.5 | 13.2 | 4 |
| | 14 | 9.3 | 11.5 | 4 |
| A-3 | 0 | 9.7 | 18.0 | 5 |
| | 7 | 9.6 | 15.7 | 5 |
| | 14 | 9.5 | 13.6 | 5 |
| A-4 | 0 | 9.7 | 18.0 | 5 |
| | 7 | 9.7 | 17.3 | 5 |
| | 14 | 9.6 | 16.6 | 5 |
| A-5 | 0 | 9.7 | 18.0 | 5 |
| | 7 | 9.7 | 14.6 | 5 |
| | 14 | 10.1 | 18.7 | 4 |
| A-6 | 0 | 9.7 | 18.0 | 5 |
| | 7 | 9.9 | 17.4 | 4 |
| | 14 | 10.5 | 11.0 | 3 |

Example 8

<Preparation of Silver Halide Photographic Material>

(Preparation of Emulsion B')

Emulsion B' was prepared in the following manner.

Emulsion B' was prepared in the same manner as Emulsion A' except that the emulsion was subjected to chemical sensitization with a selenium sensitizer having the following structural formula, sodium thiosulfate and chloroauric acid in an amount of 1 mg, 1 mg and 4 mg per mol of silver, respectively, at 60° C. to have an optimum sensitivity.

Selenium Sensitizer

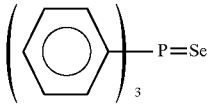

(Preparation of Coating Specimen)

A coating specimen was prepared in the same manner as in Example 7 except that the following compound (S-3') was added in an amount of $2.1\times10^{-4}$ mol per mol of silver instead of the sensitizing dye to be incorporated in EM layer and as the emulsion for the EM layer there was used Emulsion B'.

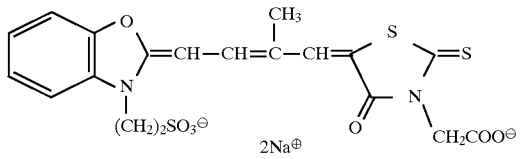

(S-3')

<Evaluation of Photographic Performance>

(1) Exposure and development

The foregoing specimen was exposed to light from a xenon flash lamp having an emission time of $10^{-6}$ sec. through an interference filter having a peak at 633 nm and a stepwedge. As the developer there was used a solution having the same formulation as Developer A' but having different sodium sulfite content as shown below. The processing procedure of Example 7 was followed.

| Developer No. | A-21 | A-22 | A-23 | A-24 | A-25 | A-26 |
|---|---|---|---|---|---|---|
| Sodium sulfite content (mol/l) | 0.01 | 0.02 | 0.08 | 0.20 | 0.30 | 0.40 |

As a result, the specimen exhibited excellent contrast, Dmax and dot quality similar to Example 7.

The specimen was then evaluated for residual color. Residual color is a phenomenon that dyes or sensitizing dyes coated are not thoroughly eluted through development, fixing and fixing, leaving the film somewhat undecolored, In general, when the temperature of the fixing solution or rinsing solution is low, residual color is worsened. Thus, residual color was visually observed at 5° C. Residual color level 1 indicates that tints can be definitely recognized. Residual color level 2 indicates that tints can be slightly recognized. Residual color level 3 indicates that no tints can be recognized. The results are set forth in Table 8.

The developers were evaluated for silver sludge.

For the evaluation of silver sludge in the developers, the photographic light-sensitive material was processed over 16 $m^2$ with 2 l of the developer without being replenished. The developers used were each visually evaluated. Rank 1 indicates that the developer is so turbid that precipitates can be observed at the bottom of the development tank. Rank 2 indicates that the developer can be recognized slightly turbid. Rank 3 indicates that the developer can be recognized clear.

TABLE 8

| Developer No. | A-21 | A-22 | A-23 | A-24 | A-25 | A-26 |
|---|---|---|---|---|---|---|
| Residual Color | 1 | 2 | 3 | 3 | 3 | 3 |
| Silver Sludge | 3 | 3 | 3 | 3 | 3 | 2 |

The date set forth in Table 8 show that the sulfite concentration should be not more than 0.4 mol/l, preferably from 0.02 to 0.3 mol/l, to cause little or no residual color and silver sludge.

Example 9

<Preparation of Silver Halide Photographic Light-sensitive Material>

A silver halide photographic light-sensitive material specimen was prepared in the same manner as in Example 7 except that the sensitizing dye to be incorporated in EM layer was replaced by the following compound (S-4').

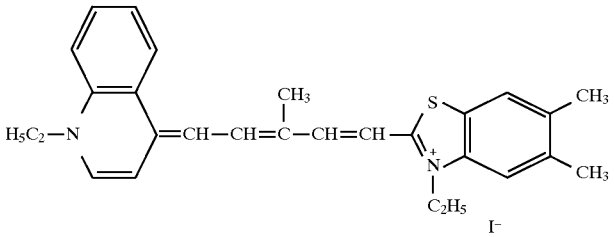

(S-4')

<Evaluation of Performance>

The foregoing specimen was exposed to light from a xenon flash lamp having an emission time of $10^{-6}$ sec. through an interference filter having a peak at 780 nm and a stepwedge. The specimen was developed with Developer A' described in Example 7 at 35° C. for 30 seconds, fixed (in the same manner as in Example 7), rinsed, and then dried.

The specimen was then evaluated for various properties in the same manner as in Examples 7 and 8.

<Results>

The use of the photographic light-sensitive material and developer of the present invention made it possible to provide a photographic light-sensitive material for semiconductor laser scanner which exhibits a high image quality and an excellent processing stability.

Example 10

<Preparation of Silver Halide Photographic Light-sensitive Material>

A silver halide photographic light-sensitive material specimen was prepared in the same manner as in Example 7 except that the sensitizing dye to be incorporated in EM layer was replaced by the following compound (S-5').

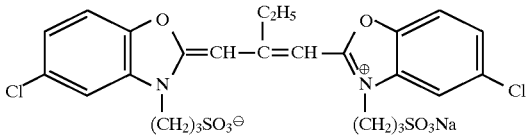

(S-5')

<Evaluation of Performance>

The foregoing specimen was exposed to tungsten light of 3,200° K through a stepwedge. The specimen was developed with Developer A' described in Example 7 at 35° C. for 30 seconds, fixed, rinsed, and then dried. As the fixing solution there was used GR-F1 (available from Fuji Photo Film Co., Ltd.).

The specimen was then evaluated for various properties in the same manner as in Examples 7 and 8.

<Results>

The use of the photographic light-sensitive material and developer of the present invention made it possible to provide a photographic light-sensitive material which exhibits a high image quality and an excellent processing stability similarly to Example 7.

Example 11

A coating specimen comprising a hydrazine derivative of the present invention incorporated therein was prepared on the basis of the formulation of photographic light-sensitive material described in Example 5 of Japanese Patent Application No. 5-202547. The coating specimen thus prepared was then developed and evaluated in the same manner as in Examples 7 and 8.

As a result, an excellent photographic light-sensitive material for picture taking was obtained similarly to Example 7.

Example 12

Preparation of Emulsion C'

To a 1.5% aqueous solution of gelatin having pH 2.0 and containing sodium chloride and a compound represented by the following formula (f) in an amount of $3\times10^{-5}$ mol per mol of silver which had been kept at 40° C. were added simultaneously an aqueous solution of silver nitrate and an aqueous solution of sodium chloride containing $(NH_4)_2Rh(H_2O)Cl_5$ in an amount of $3.5\times10^{-5}$ mol per mol of silver by a double jet process at a potential of 95 mV in 3 minutes and 30 seconds. Thus, cores having a grain size of 0.12 μm were prepared. Thereafter, to the emulsion were then added an aqueous solution of silver nitrate and an aqueous solution of sodium chloride containing $(NH_4)_2Rh(H_2O)Cl_5$ in an amount of $10.5\times10^{-5}$ mol per mol of silver in 7 minutes in the same manner as above to prepare an emulsion of cubic grains of silver chloride having an average grain size of 0.15 μm (variation coefficient: 12%).

Thereafter, to the emulsion was added 4-hydroxy-6-methyl-1,3,3a,7-tetraazaindene in an amount of $1.5\times10^{-}$mol per mol of silver.

The emulsion was then rinsed by a flocculation method well known in the art to remove soluble salts therefrom. To the emulsion was then added gelatin. The emulsion was not then subjected to chemical ripening. To the emulsion were then added the following compound (g) and phenoxyethanol as a preservatives each in an amount of 50 mg per mol of silver each and 4-hydroxy-6-methyl-1,3,3a,7-tetraazaindene as a stabilizer in an amount of $3\times10^{-3}$ mol per mol of silver (pH: 5.7; pAg: 7.5; Rh: $6\times10^{-5}$ mol/mol Ag).

<Preparation and Coating of Coating Solution for Emulsion Layer>

To Emulsion C' were added the following compounds. The silver halide emulsion layer coating solution thus obtained was then applied in such an amount that the coated amount of gelatin and silver reached 1.1 g/m$^2$ and 2.5 g/m$^2$, respectively.

| | |
|---|---|
| 4-Hydroxy-6-methyl-1,3,3a, 7-tetraazaindene | 10 mg/m$^2$ |
| N-oleyl-N-methyltaurin sodium salt | 35 mg/m$^2$ |
| Compound (h) | 10 mg/m$^2$ |
| Compound (i) | 20 mg/m$^2$ |
| n-Butyl acrylate/2-acetoacetoxyethyl methacrylate/acrylic acid copolymer (89/8/3) | 900 mg/m$^2$ |
| Compound (j) (film hardener) | 150 mg/m$^2$ |

To the emulsion were then added a nucleation accelerator (k) and a nucleating agent in such an amount that the coated amount of the former reached 20 mg/m$^2$ and the coated amount of the latter was as set forth in Table 7.

A lower emulsion protective layer and an upper emulsion protective layer were applied to the foregoing emulsion layer.

<Preparation and coating of lower emulsion protective layer coating solution>

To an aqueous solution of gelatin were added the following compounds. The coating solution thus obtained was then applied in such an amount that the coated amount of gelatin reached 0.7 g/m$^2$.

| | |
|---|---|
| Gelatin ($Ca^{++}$ content: 2,700 ppm) | 0.7 g/m$^2$ |
| Sodium p-dodecylbenzenesulfonate | 15 mg/m$^2$ |
| Compound (g) | 5 mg/m$^2$ |
| Compound (l) | 10 mg/m$^2$ |
| Compound (m) | 20 mg/m$^2$ |

<Preparation and coating of upper emulsion protective layer coating solution>

To an aqueous solution of gelatin were added the following compounds. The coating solution thus obtained was then applied in such an amount that the coated amount of gelatin reached 0.8 g/m$^2$.

| | |
|---|---|
| Gelatin ($Ca^{++}$ content: 2,700 ppm) | 0.8 g/m$^2$ |
| Amorphous silica matting agent (average grain diameter: 3.5 μm; pore diameter: 25Å; surface area: 700 m$^2$/g) | 40 mg/m$^2$ |
| Amorphous silica matting agent (average grain diameter: 2.5 μm; pore diameter: 170Å; surface area: 300 m$^2$/g) | 10 mg/m$^2$ |
| N-perfluorooctanesulfonyl-N-propylglycine potassium | 5 mg/m$^2$ |
| Sodium dodecylbenzenesulfonate | 30 mg/m$^2$ |
| Compound (g) | 5 mg/m$^2$ |
| Solid Dispersed Dye $G_1$ | 100 mg/m$^2$ |
| Solid Dispersed Dye $G_2$ | 50 mg/m$^2$ |

Subsequently, the following electrically-conductive layer and back layer were simultaneously applied to the back side of the support.

<Preparation and Coating of Coating Solution for Electrically-conductive Layer>

To an aqueous solution of gelatin were added the following compounds. The coating solution thus obtained was then applied in such an amount that the coated amount of gelatin reached 77 mg/m$^2$.

| | |
|---|---|
| $SnO_2$/Sb (9/1 by weight; average grain diameter: 0.25 μm) | 200 mg/m$^2$ |
| Gelatin ($Ca^{++}$ content: 3,000 ppm) | 77 mg/m$^2$ |
| Sodium dodecylbenzenesulfonate | 10 mg/m$^2$ |
| Sodium dihexyl-α-sulfosuccinate | 40 mg/m2 |
| Sodium polystyrenesulfonate | 9 mg/m$^2$ |
| Compound (g) | 7 mg/m$^2$ |

<Preparation and Coating of Coating Solution for Back Layer>

To an aqueous solution of gelatin were added the following compounds. The coating solution thus obtained was then applied in such an amount that the coated amount of gelatin reached 2.92 g/m$^2$.

| | |
|---|---|
| Gelatin ($Ca^{++}$ content: 30 ppm) | 2.92 g/m$^2$ |
| Particulate polymethyl methacrylate (average grain diameter: 3.4 μm) | 54 mg/m$^2$ |

-continued

| | |
|---|---|
| Compound (h) | 140 mg/m$^2$ |
| Compound (r) | 140 mg/m$^2$ |
| Compound (s) | 40 mg/m$^2$ |
| Sodium p-dodecylbenzenesulfonate | 75 mg/m$^2$ |
| Sodium dihexyl-α-sulfosuccinate | 20 mg/m$^2$ |
| Compound (t) | 5 mg/m$^2$ |
| N-perfluorooctanesulfonyl-N-propyl glycine potassium | 5 mg/m$^2$ |
| Sodium sulfate | 50 mg/m$^2$ |
| Sodium acetate | 85 mg/m$^2$ |

(Preparation of Support and Undercoating Layer)

To both sides of a biaxially-oriented polyethylene terephthlate support (thickness: 100 μm) were applied first and second undercoating layers having the following composition, respectively.

| <First Undercoating Layer> | |
|---|---|
| Core-shell type vinylidene chloride copolymer (1) | 15 g |
| 2,4-Dichloro-6-hydroxy-s-triazine | 0.25 g |
| Particulate polystyrene (average grain diameter: 3 μm) | 0.05 g |
| Compound (u) | 0.20 g |
| Colloidal silica (Snowtex ZL; grain diameter: 70 to 100 μm, available from Nissan Chemical Industries, Ltd.) | 0.12 g |
| Water to make | 100 g |

To the solution was then added a 10 wt % KOH to give a coating solution having pH 6. The coating solution was then applied to the support in such an amount that the coating thickness reached 0.9 μm after 2 minutes of drying at 180° C.

| <Second Undercoating Layer> | |
|---|---|
| Gelatin | 1 g |
| Methyl cellulose | 0.05 g |
| Compound (v) | 0.02 g |
| $C_{12}H_{25}O(CH_2CH_2O)_{10}H$ | 0.03 g |
| Compound (g) | $3.5 \times 10^{-3}$ g |
| Acetic acid | 0.2 g |
| Water to make | 100 g |

The coating solution thus obtained was then applied to the support in such an amount that the coating thickness reached 0.1 μm after 2 minutes of drying at 170° C.

(f)

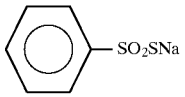

(g)

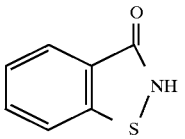

(h)

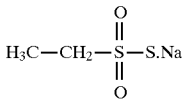

(i)

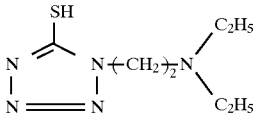

(j)

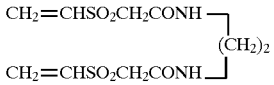

(k)

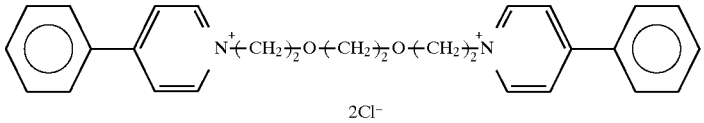

(l)

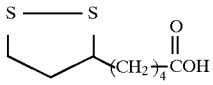

-continued
(m)
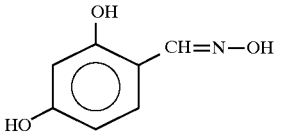
Solid Dispersed Dye $G_1$
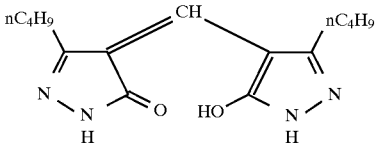
Solid Dispersed Dye $G_2$
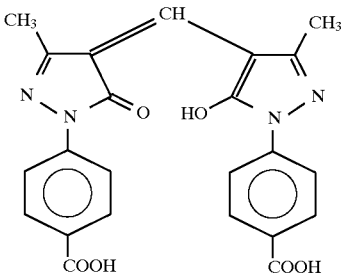
(n)
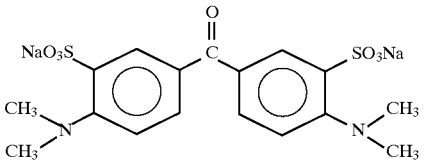
(r)
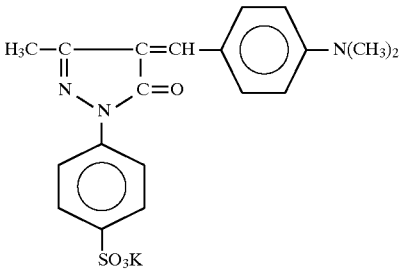
(s)
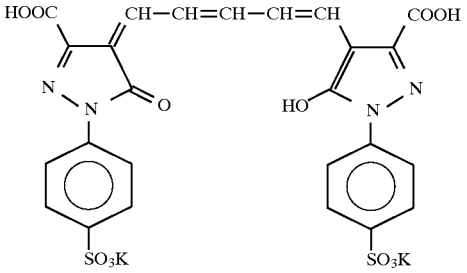
$C_8F_{17}SO_3Li$ (t)
Core-shell type Vinylidene Copolymer (1)
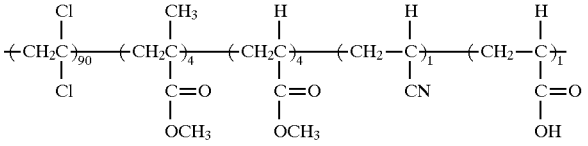
VDC MMA MA AN AA
Core: VDC/MMA/MA (80 wt %)
Shell: VDC/AN/AA (20 wt %)
Average grain size: 70 nm -continued

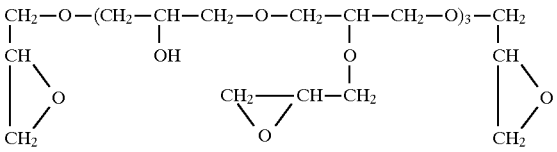

(u)

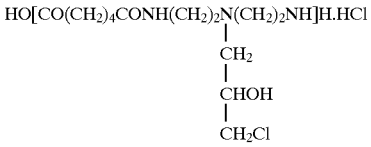

(v)

<Evaluation of Performance>

(1) Exposure and Development

The specimen thus obtained was exposed to light through an optical wedge in a Type P-627FM printer available from Dainippon Ink & Chemicals, Inc., developed with Developer A' of Example 7 in a Type FG-680AG available from Fuji Photo Film Co., Ltd. at 38° C. for 20 seconds, fixed, rinsed, and then dried. As the fixing solution there was used a solution having the same formulation as used in Example 7.

The specimen was then evaluated for various properties in the same manner as in Examples 7 and 8.

<Results>

A bright-room photographic light-sensitive material for contact work which exhibits a high gamma and an excellent processing stability was obtained.

Example 13

A developer was prepared from a pack of Developer A' of Example 7 which had been stored in solid form. The preparation of the pack of solid processing agent was accomplished by packing a laminate of developer components in solid form into a bag made of an aluminum foil-coated plastic substance. The order of lamination from top to bottom was as follows:

1st layer: Sodium erythorbate

2nd layer: Other components

3rd layer: Sodium bisulfite

4th layer: Potassium carbonate

5th layer: Potassium hydroxide pellet

The air in the bag was then evacuated by a common method. The bag was then sealed.

<Results>

The procedure of development of Examples 7 to 12 were allowed except that the developer prepared from the solid processing agent was used. Results similar to that of Examples 7 to 12 were obtained.

While the invention has been described in detail and with reference to specific embodiments thereof, it will be parent to one skilled in the art that various changes and modifications can be made therein without departing from the spirit and scope thereof.

What is claimed is:

1. An image formation process which comprises:

exposing a photographic light-sensitive material to light, the photographic light-sensitive material comprising a support having provided thereon at least one photosensitive silver halide emulsion layer, and at least one hydrazine derivative and at least one of phosphonium compounds represented by formula (1) each incorporated in at least one of the silver halide emulsion layer and other hydrophilic colloid layers, and then developing said photographic light-sensitive material with a developer, wherein said developer is substantially free of a dihydroxybenzene developing agent, contains at least one of developing agents represented by formula (2) and at least one of p-aminophenol derivatives, and has a pH value of not more than 10:

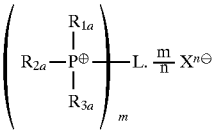

(1)

wherein $R_{1a}$, $R_{2a}$ and $R_{3a}$ each represent an alkyl group, a cycloalkyl group, an aryl group, an alkenyl group, a cycloalkenyl group or a heterocyclic residue, which may have substituent(s); m represents an integer of 1 or 2; L represents an organic group having a valence of m, which is bonded to P atom via its carbon atom; n represents an integer of from 1 to 3; X represents an anion having a valence of n, which may be connected to L;

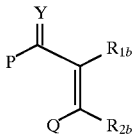

(2)

wherein $R_{1b}$ and $R_{2b}$ each represent a hydroxyl group, an amino group, an acylamino group, an alkylsulfonylamino group, an arylsulfonylamino group, an alkoxysulfonylamino group, a mercapto group or an alkylthio group; P and Q each represent a hydroxyl group, a hydroxyalkyl group, a carboxyl group, a carboxyalkyl group, a sulfo group, a sulfoalkyl group, an amino group, an aminoalkyl group, an alkyl group, an alkoxy group or a mercapto group or an atomic group necessary for the formation of a 5- to 7-membered ring along with two vinyl carbon atoms to which $R_{1b}$ and $R_{2b}$ are connected, respectively, and the carbon atom to which Y is connected; and Y represents =O or =N—$R_{3b}$ in which $R_{3b}$ represents a hydrogen atom, a hydroxyl group, an alkyl group, an acyl group, a hydroxyalkyl group, a sulfoalkyl group or a carboxyalkyl group.

2. The image formation process of claim 1, wherein said hydrazine derivative is at least one of compounds represented by formula (3):

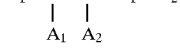

(3)

wherein $R_1$ represents an aliphatic group or an aromatic group; $R_2$ represents a hydrogen atom, an alkyl group, an aryl group, an unsaturated heterocyclic group, an alkoxy group, an aryloxy group, an amino group or a hydrazino group; $G_1$ represents —CO— group, —$SO_2$— group, —SO— group, —PO($R_3$)— group where $R_3$ is selected from the groups defined as $R_2$ and may be different from $R_2$, a —CO—CO— group, a thiocarbonyl group or an iminomethylene group; $A_1$ and $A_2$ both represent a hydrogen atom or one of $A_1$ and $A_2$ represents a hydrogen atom and the other represents a substituted or unsubstituted alkylsulfonyl group, a substituted or unsubstituted arylsulfonyl group or a substituted or unsubstituted acyl group.

3. The image formation process of claim 1, wherein said hydrazine derivative is a compound represented by any one of formulae (4) to (6):

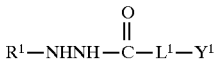

(4)

wherein $R^1$ represents an alkyl group, an aryl group or a heterocyclic group; $L^1$ represents a divalent connecting group having an electron-withdrawing group; and $Y^1$ represents an anionic group or a nonionic group which forms an intramolecular hydrogen bond with a hydrogen atom in the hydrazine;

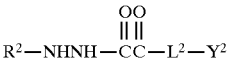

(5)

wherein $R^2$ represents an alkyl group, an aryl group or a heterocyclic group; $L^2$ represents a divalent connecting group; $Y^2$ represents an anionic group or a nonionic group which forms an intramolecular hydrogen bond with a hydrogen atom in the hydrazine;

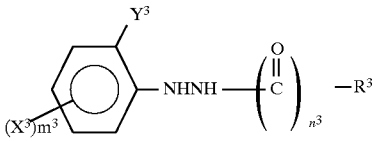

(6)

wherein $X^3$ represents a group capable of becoming a substituent on the benzene ring; $R^3$ represents an alkyl group, an alkenyl group, an alkinyl group, an aryl group, a heterocyclic group, an alkoxy group or an amino group; $Y^3$ represents an anionic group or a nonionic group which forms an intramolecular hydrogen bond with a hydrogen atom in the hydrazine; $m^3$ represents an integer of from 0 to 4; and $n^3$ represents an integer of 1 or 2, with the proviso that when $n^3$ is 1, $R^3$ has an electron-withdrawing group.

4. A development process which comprises:

developing a silver halide photographic material comprising a support having provided thereon at least one silver halide emulsion layer, and a hydrazine derivative and a nucleation accelerator each incorporated in at least one of the silver halide emulsion layer and other hydrophilic colloid layers, with a developer having a pH value of from 9.0 to not more than 10 and containing at least one first developing agent selected from the group consisting of ascorbic acid and a derivative thereof and at least one second developing agent selected from the group consisting of aminophenol and a derivative thereof, wherein a solution comprising the same developing agents as the developer but having a higher pH value than the developer is used as a development replenisher.

5. The development process of claim 4, wherein the replenishment rate of the development replenisher is not more than 200 ml/$m^2$.

6. The development process of claim 4, wherein said fresh developer and said development replenisher each contain a sulfite in an amount of not more than 0.3 mol/l and the replenishment rate of the development replenisher is not more than 150 ml/$m^2$.

7. The development process of claim 4, wherein the pH value of said development replenisher is from 0.3 to 1.0 higher than that of said fresh developer.

* * * * *